United States Patent [19]

Fujimaki et al.

[11] Patent Number: 4,540,651

[45] Date of Patent: Sep. 10, 1985

[54] ELECTROPHOTOGRAPHIC PHOTOSENSITIVE MEMBER

[75] Inventors: Yoshihide Fujimaki; Yoshiaki Takei; Hiroyuki Nomori, all of Hachioji, Japan

[73] Assignee: Konishiroku Photo Industry Co., Ltd., Tokyo, Japan

[21] Appl. No.: 549,601

[22] Filed: Nov. 7, 1983

[30] Foreign Application Priority Data

| | | | |
|---|---|---|---|
| Nov. 10, 1982 | [JP] | Japan | 57-197165 |
| Nov. 10, 1982 | [JP] | Japan | 57-197166 |
| Nov. 30, 1982 | [JP] | Japan | 57-208512 |
| Nov. 30, 1982 | [JP] | Japan | 57-208513 |
| Nov. 30, 1982 | [JP] | Japan | 57-208515 |
| Nov. 30, 1982 | [JP] | Japan | 57-208516 |
| Nov. 30, 1982 | [JP] | Japan | 57-208518 |
| Nov. 30, 1982 | [JP] | Japan | 57-208519 |
| Dec. 8, 1982 | [JP] | Japan | 57-214033 |
| Dec. 8, 1982 | [JP] | Japan | 57-214036 |
| Dec. 8, 1982 | [JP] | Japan | 57-214037 |
| Dec. 8, 1982 | [JP] | Japan | 57-214034 |

[51] Int. Cl.[3] ..... G03G 5/06; G03G 5/14

[52] U.S. Cl. ..... 430/72; 430/58; 430/59; 430/76

[58] Field of Search ..... 430/58, 59, 72, 76

[56] References Cited

U.S. PATENT DOCUMENTS

| | | | |
|---|---|---|---|
| 4,399,207 | 8/1983 | Sakai et al. | 430/58 |
| 4,427,753 | 1/1984 | Fujimura et al. | 430/59 |
| 4,450,218 | 5/1984 | Takei et al. | 430/59 |

*Primary Examiner*—John D. Welsh

*Attorney, Agent, or Firm*—Frishauf, Holtz, Goodman & Woodward

[57] ABSTRACT

There is disclosed an electrophotographic photosensitive member comprising a photosensitive layer comprising a combination of a carrier generating layer and a carrier transporting layer provided on an electroconductive support, the carrier generating layer containing a bisazo compound and the carrier transporting layer containing a styryl compound and/or an amine derivative, a hydrazone compound or a carbazole derivative.

The electrophotographic photosensitive member according to the present invention has a high sensitivity and can form constantly good visible images.

31 Claims, 5 Drawing Figures

ELECTROPHOTOGRAPHIC PHOTOSENSITIVE MEMBER

BACKGROUND OF THE INVENTION

This invention relates to an electrophotographic photosensitive member having a photosensitive layer comprising a combination of a carrier generating phase and a carrier transporting phase provided on an electroconductive support.

Up to date, it has been proposed to constitute the photosensitive layer of an electrophotographic photosensitive member by combining a carrier generating layer (hereinafter referred to as "CGL") comprising a carrier generating material (hereinafter referred to as "CGM") which generates charged carrier (hereinafter referred to merely as "carrier") with a carrier transporting layer (hereinafter referred to as "CTL") comprising a carrier transporting material (hereinafter referred to as "CTM") for transporting either one or both of the positive or negative carrier generated in the CGL. Thus, by imposing the two basic necessary functions of generation of carrier and its transportation on separate layers, the materials available for constitution of the photosensitive layer can be chosen from wider scope of materials, and also it is rendered possible to select materials or material systems capable of fulfilling optimally the respective functions independently. Also, by doing so, it is rendered possible to constitute an electrophotographic photosensitive member having various characteristics required in electrophotographic process, for example, excellent characteristics such as high surface potential when it is charged, great charge retentivity, high photosensitivity and great stability in repeated uses.

As the photosensitive layers of the prior art, for example, the following constitutions are known:

(1) Constitution wherein a CGL comprising amorphous selenium or cadmium sulfide and a CTL comprising poly-N-vinylcarbazole are laminated.

(2) Constitution wherein a CGL comprising amorphous selenium or cadmium sulfide and a CTL containing 2,4,7-trinitro-9-fluorenone are laminated.

(3) Constitution wherein a CGL comprising a perylene derivative and a CTL containing an oxadiazole derivative are laminated (see U.S. Pat. No. 3,871,882).

(4) Constitution wherein a CGL comprising Chlorodian Blue or Methyl Scarilium and a CTL containing a pyrazoline derivative are laminated (see Japanese Provisional Patent Publication No. 90827/1976).

(5) Constitution wherein a CGL comprising amorphous selenium or its alloy and a CTL containing a polyaryl alkane type aromatic amino compound are laminated (Japanese Provisional Patent Publication No. 80130/1979).

(6) Constitution wherein a CGL containing a perylene derivative and a CTL containing a polyaryl alkane type aromatic amino compound are laminated (Japanese Provisional Patent Publication No. 126036/1979).

Thus, a large number of this kind of photosensitive layer have been known, but the electrophotographic photosensitive member having such a photosensitive member has the drawback of a very short usage life due to excessive electrical fatigue of the photosensitive layer when provided for use repeatedly in electrophotographic process.

For example, when provided for use repeatedly in electrophotographic process, the history of the potential of said electrophotographic photosensitive member cannot be maintained stably to give no stable image forming characteristic.

Also, use of a specific bisazo compound as CGM is disclosed in, for example, Japanese Provisional Patent Publications No. 117151/1980 and No. 145142/1979. However, the above drawback is considerably great even in the combination of this CGM with the CTM which is stated to be combinable. As can be understood also from this fact, a carrier transporting material effective for a specific carrier generating material is not necessarily always effective for other carrier generating materials, or conversely a carrier generating material effective for a specific carrier transporting material cannot be stated to be always effective for other carrier transporting materials. When the combination of both materials is inadequate, not only the electrophotographic sensitivity is lowered, but the so called residual potential becomes large, particularly due to poor discharging efficiency during low electric field, and, in the worst case, potential is accumulated every time of repeated uses, whereby it can be no longer practically useful for electrophotography.

Thus, as to the preferable combination of a material for constituting a carrier generating phase and a material for constituting a carrier transporting phase, there is no general rule in choice thereof, but it is required to determine practically an advantageous combination from among a large number of groups of materials.

An object of the present invention is to provide an electrophotographic photosensitive member which is provided with a carrier generating phase and a carrier transporting phase, has a high sensitivity and can form constantly good visible images while maintaining the history of the potential even when provided for use repeatedly in electrophotographic process.

SUMMARY OF THE INVENTION

The above object can be accomplished by an electrophotographic photosensitive member comprising a photosensitive layer comprising a combination of a carrier generating phase and a carrier transporting phase provided on an electroconductive support, said carrier generating phase containing a bisazo compound represented by the formula [I] shown below and said carrier transporting phase containing a carrier transporting material of styryl compounds represented by the formula [II] shown below and/or amine derivatives represented by the formula [III], hydrazone compounds represented by the formula [IV], [V] or [VI], or carbazole derivatives represented by the formula [VII]:

$$A-N=N-Ar_1-\overset{R_1}{\overset{|}{C}}=\overset{R_2}{\overset{|}{C}}-Ar_2-\overset{R_3}{\overset{|}{C}}=\overset{R_4}{\overset{|}{C}}-Ar_3-N=N-A \qquad \text{Formula [I]}$$

wherein each of $Ar_1$, $Ar_2$ and $Ar_3$ represents a divalent carbocyclic aromatic residue or a divalent heterocyclic aromatic residue; each of $R_1$, $R_2$, $R_3$ and $R_4$ represents an electron attracting group or a hydrogen atom, provided that 1 or 2 of $R_1$ to $R_4$ are electron attracting groups and the case where $R_1$ and $R_2$ or $R_3$ and $R_4$ are electron attracting groups at the same time is excluded; A is a group represented by the following formula:

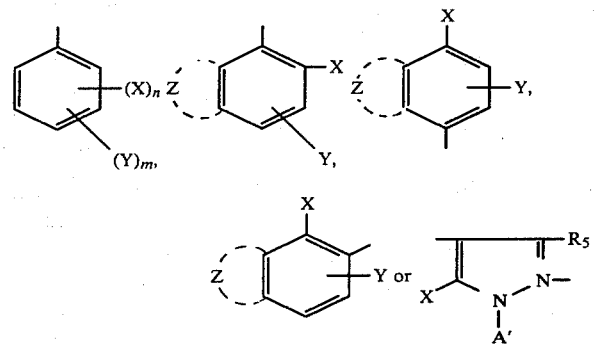

wherein X is a hydroxyl group,

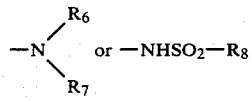

(where each of $R_6$ and $R_7$ is a hydrogen atom, an alkyl group and $R_8$ is an alkyl group or an aryl group when n is 2 or 3, the plural groups may be different from each other); Y is a hydrogen atom, a halogen atom such as a bromine atom and chlorine atom, an alkyl group, an alkoxy group, a carboxyl group, a sulfo group, a carbamoyl group or a sulfamoyl group (when m is 2 or more, the plural groups may be different from each other); Z is a group of atoms necessary for constituting a carbocyclic aromatic ring or a heterocyclic aromatic ring; $R_5$ is a hydrogen atom, an amino group, an alkyl group, a carbamoyl group, a carboxyl group or its ester group; A' is an aryl group; n is an integer of 1 to 3; and m is an integer of 0 to 4.

The above groups include substituted or unsubstituted groups.

Preferable $Ar_1$, $Ar_2$ and $Ar_3$ are a phenyl group, a naphthyl group or a pyridine group.

Preferable substituents are an alkyl group such as a methyl group and an ethyl group, a halogen atom such as a bromine atom and chlorine atom and an alkoxy group such as a methoxy group.

Preferable electron attracting groups are a nitro group, a cyano group and a halogen atom such as a bromine atom and chlorine atom.

A preferable alkyl group of each $R_6$ and $R_7$ is a lower alkyl group such as a methyl group and ethyl group and a preferable substituent is the above-mentioned electron attracting group, and more preferably, a cyano group.

Preferable $R_8$ groups are a lower alkyl group such as a methyl group and ethyl group, a phenyl group, a naphthyl group. A preferable substituent is an alkyl group.

Substituents for an alkyl group in Y are preferably a cyano group or a hydroxyl group, and substituents for a carbamoyl group or a sulfamoyl group in Y are preferably an alkyl group such as a methyl group, a heterocyclic aromatic ring such as a dibenzofuran, a carbocyclic aromatic ring such as a phenyl group and naphthyl group, which may be substituted with an alkyl group, a nitro group, an alkoxy group, a halogen atom or the like.

Preferable carbocyclic aromatic rings or heterocyclic aromatic rings for Z are a phenyl group, a naphthyl group, a carbazole ring, an indole ring and the like, which may be substituted with a sulfamoyl group such as a phenyl sulfamoyl group or a halogen atom.

$R_5$ is preferably a hydrogen atom, a lower alkyl group such as a methyl group, or a carboxyl group or its ester group.

A' is preferably a phenyl group which may be substituted with a halogen atom, a sulfo group, an amino group or a $—NHSO_2—R_8$ group such as those described in abovementioned group X (e.g. an alkylamino group).

Formula [II]

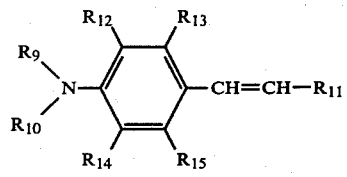

wherein each of $R_9$ and $R_{10}$ represents an alkyl group or phenyl group which includes substituted one. The preferable substituents for $R_9$ and $R_{10}$ are an alkyl group, an alkoxy group or a phenyl group; $R_{11}$ represents a phenyl group, naphthyl group, anthryl group, fluorenyl group or heterocyclic group such as a carbazole ring which includes substituted one. The preferable substituents for $R_{11}$ are an alkyl group, an alkoxy group, a halogen atom, a hydroxyl group, a phenyl group or a amino group such as an alkylamino group and phenylamino group; each of $R_{12}$ to $R_{15}$ represents a hydrogen atom, a halogen atom, an alkyl group, an alkoxy group or an amino group such as an alkylamino group, unsubstituted alkyl group, unsubstituted alkoxy group or alkylamino groups are preferred.

$R_9$ and $R_{10}$ are preferably a lower alkyl group, a phenyl group which may be substituted with an alkyl group, an alkoxy group or a benzyl group.

Formula [III]

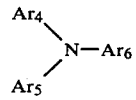

wherein each of $Ar_4$ and $Ar_5$ represents a phenyl group which includes substituted one, the substituent being preferably selected from a halogen atom, an alkyl group, a nitro group or an alkoxy group; and $Ar_6$ represents a phenyl group, naphthyl group, anthryl group, fluorenyl group or heterocyclic group which includes substituted one, the substituent being preferably selected from an alkyl group, an alkoxy group, a haloen atom, a hydroxyl group, an aryloxy group, an amino group such as an amino group, acylamino group, alkylamino group, arylamino group and aralkylamino group, a nitro group, a piperidino group, a morphorino group, a naphthyl group or an anthryl group.

Formula [IV]

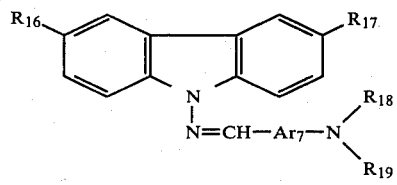

wherein each of $R_{16}$ to $R_{17}$ represents a hydrogen atom or a halogen atom; each of $R_{18}$ and $R_{19}$ represents an aryl group which includes substituted one. The substituents are preferably an alkyl group, an alkoxy group and a halogen atom; and $Ar_7$ represents an arylene group such as a phenylene group.

Formula [V]

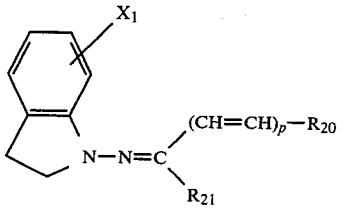

wherein $R_{20}$ represents an aryl group such as a phenyl group and naphthyl group or a heterocyclic ring, which includes substituted one; $R_{21}$ represents a hydrogen atom, an alkyl group or an aryl group which includes substituted one; $X_1$ represents a hydrogen atom, a halogen atom, an alkyl group, an amino group such as an alkylamino group or an alkoxy group which includes substituted one; and p represents an integer of 0 or 1.

Preferable heterocyclic rings are a furan, thiophene, indole, carbazole and the like. Preferable substituents for $R_{20}$ are an alkylamino group, a phenylamino group, an alkoxy group, an alkyl group, a phenyl group and the like.

Formula [VI]

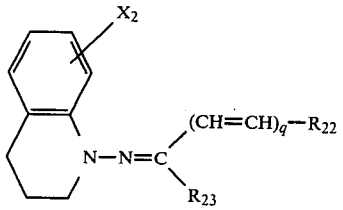

wherein $R_{22}$ represents an aryl group or a heterocyclic group which includes substituted one; $R_{23}$ represents a hydrogen atom or an alkyl group; $X_2$ represents a hydrogen atom, a halogen atom, an alkyl group, an amino group such as an alkylamino group, an alkoxy group or a cyano group; and q represents an interger of 0 or 1.

Preferable groups are those as described in Formula [V].

Formula [VII]

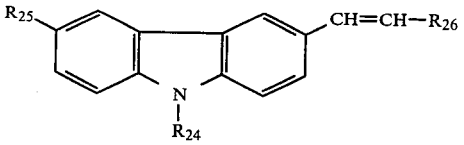

wherein $R_{24}$ represents an aryl group such as a phenyl group and naphthyl group which includes substituted one; $R_{25}$ represents a hydrogen atom, a halogen atom, an alkyl group, an alkoxy group, an amino group such as an amino group and alkylamino group, or a hydroxyl group; and $R_{26}$ represents an aryl group such as a phenyl group and naphthyl group or a heterocyclic group such as thiophene and carbozole group which includes substituted one.

Preferable substituents for $R_{24}$ are an alkyl group, an alkoxy group, an alkylamino group and the like.

Preferable substituents for $R_{26}$ are an alkyl group, an alkoxy group, an alkylamino group, a phenylamino group and the like.

DESCRIPTION OF THE PREFERRED EMBODIMENTS

Figure 1:
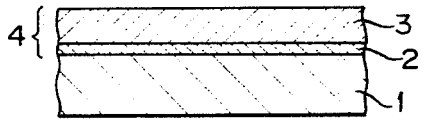
FIG. 1 shows a sectional view for illustration of an embodiment of the constitution of the electrophotographic photosensitive member of this invention.

Among the bisazo compounds represented by the above formula [I], preferable compounds are those having the following formula [Ia-1] to [Ia-4]:

Formula [Ia - 1]

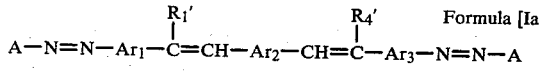

Formula [Ia - 2]

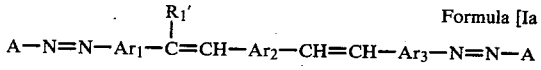

Formula [Ia - 3]

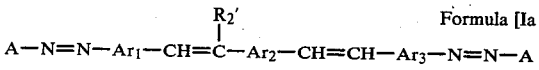

Formula [Ia - 4]

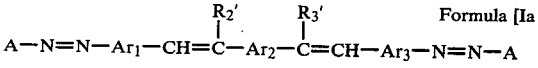

wherein $R_1'$, $R_2'$, $R_3'$ and $R_4'$ each represents an electron attracting group; $Ar_1$, $Ar_2$, $Ar_3$ and A are the same as defined in Formula [I].

Among the above $R_1'$ to $R_4'$, a cyano group is preferable.

More preferable compounds are those represented by the following formula [Ib-1] to [Ib-4]:

Formula [Ib - 1]

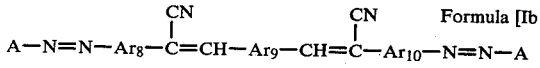

Formula [Ib - 2]

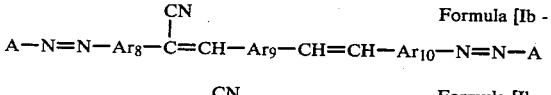

Formula [Ib - 3]

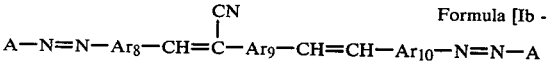

Formula [Ib - 4]

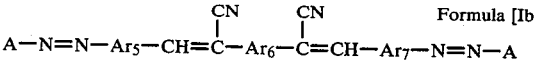

wherein A is the same as defined in Formula [I], each of $Ar_8$, $Ar_9$ and $Ar_{10}$ represents a phenyl group which includes substituted one, the substituent being preferably selected from an alkyl group such as methyl or ethyl, an alkoxy group such as methoxy or ethoxy, a halogen atom such as chlorine atom or bromine atom, a hydroxyl group or a cyano group.

That is, in this invention, the bisazo compound represented by the above formula [I] is used as CGM and also the styryl compounds represented by the formula [II] and/or the amine derivatives represented by the formula [III], the hydrazone compounds represented by the formula [IV], the hydrazone compounds represented by the formula [V], the hydrazone compounds represented by the formula [VI] or the carbazole derivatives represented by the formula [VII] is used as CTM, and by combining these, a photosensitive layer for so called function separation type photosensitive member in which generation and transportation of carriers are effected by separate materials is constituted. And, with such a constitution, it is possible to provide an electrophotographic photosensitive member which is great in sensitivity, and capable of maintaining stably the history of the potential even when provided for use repeatedly in electrophotographic process and therefore capable of forming constantly good visible images.

Also in the electrophotographic photosensitive member of this invention, a great spectral sensitivity is obtained particularly in the longer wavelength region of 600 to 700 nm, and therefore it is possible to use, for example, helium-neon laser with a wavelength of 6328 A as a light source for formation of latent images. Further, since the tail-cut of the potential during low electrical field is good to give a potential at the non-image portion at the time of developing which is zero or approximate thereto, good development can be effected also by a one-component developer comprising only a toner which cannot attain a great effective bias.

As specific examples of the bisazo compounds represented by the above formula [I], those having, for example, the following formulae may be enumerated, but this invention is not limited thereto.

Exemplary compounds (I-1)

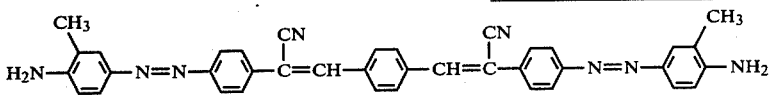

(I-2)

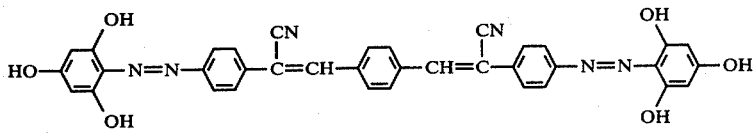

(I-3)

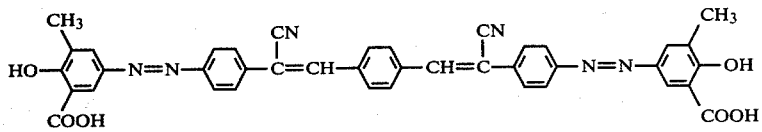

(I-4)

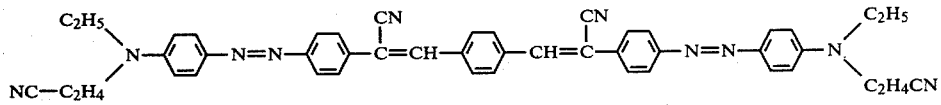

(I-5)

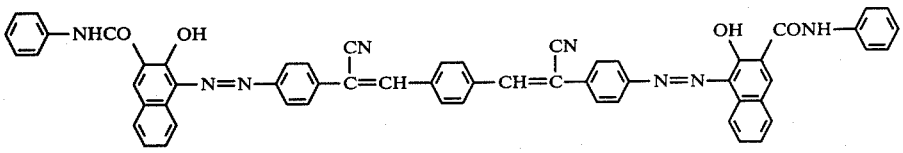

(I-6)

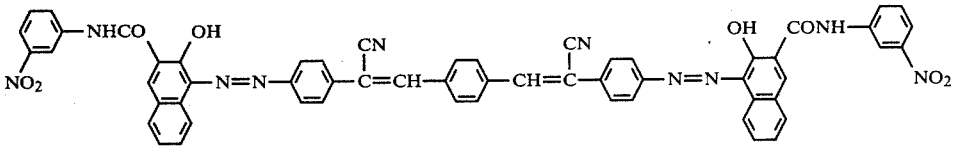

(I-7)

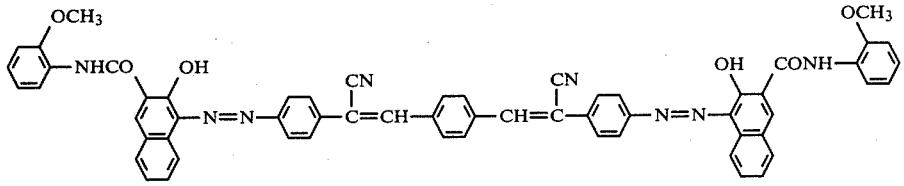

(I-8)

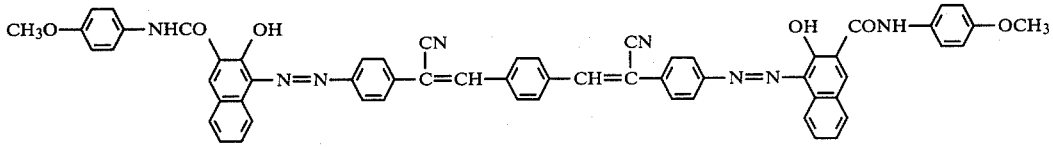

-continued
Exemplary compounds
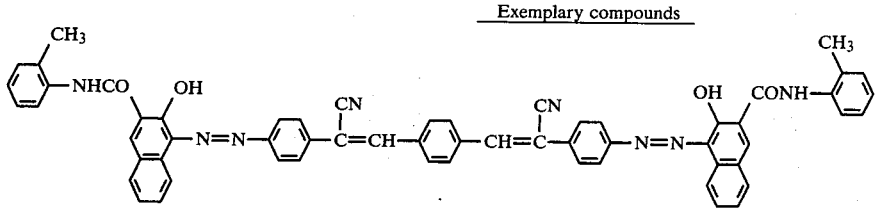
(I-9)
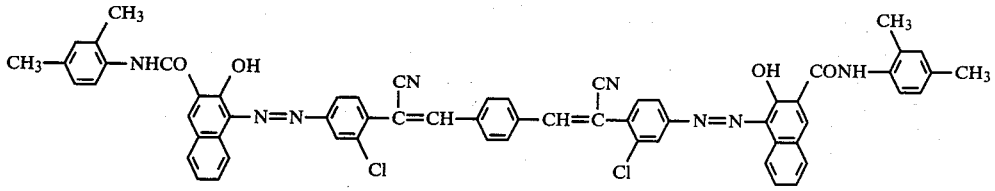
(I-10)
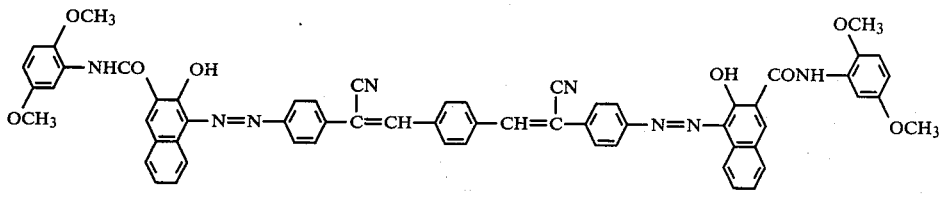
(I-11)
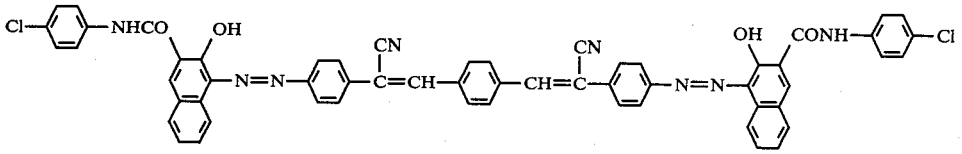
(I-12)
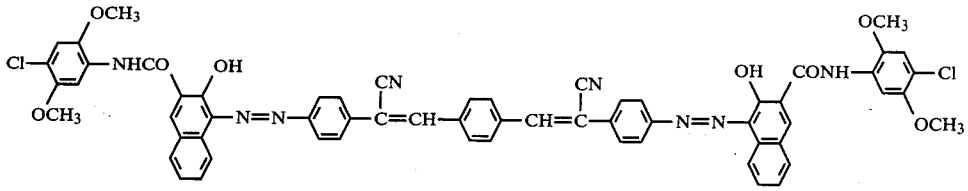
(I-13)
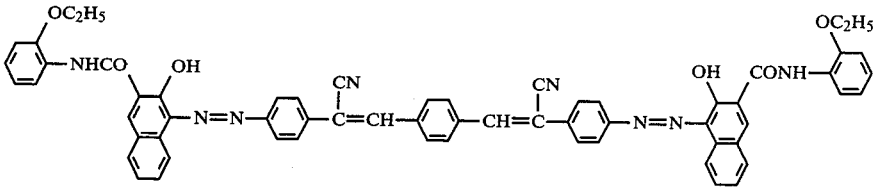
(I-14)
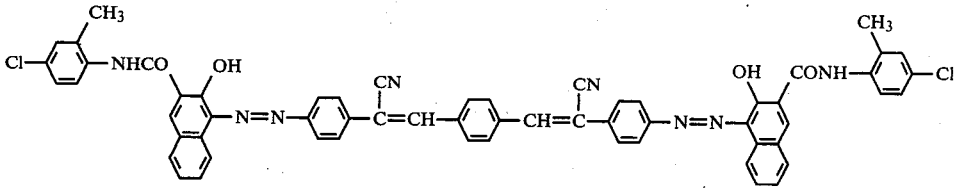
(I-15)
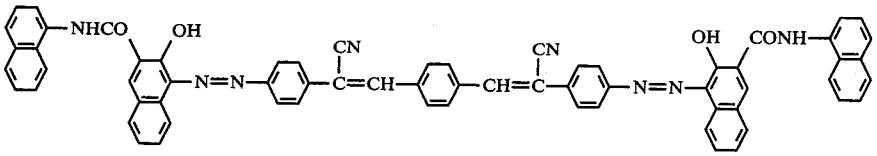
(I-16)
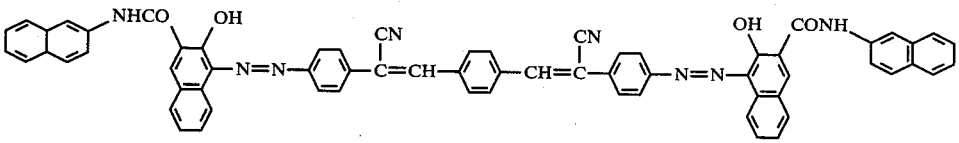
(I-17)

-continued
Exemplary compounds
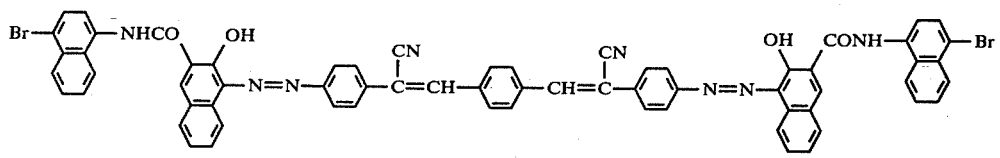
(I-18)
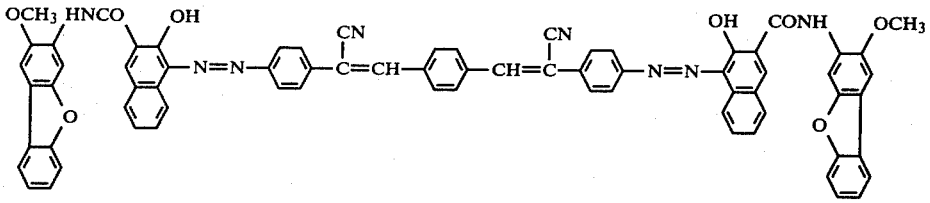
(I-19)
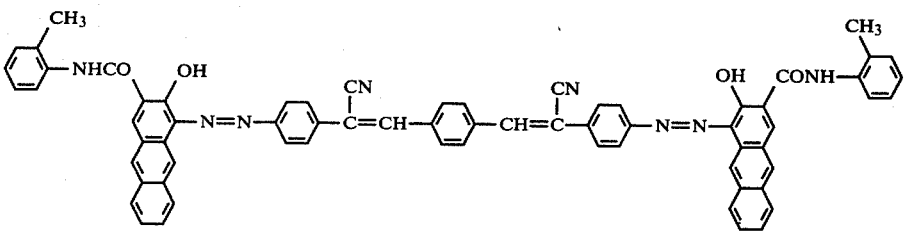
(I-20)
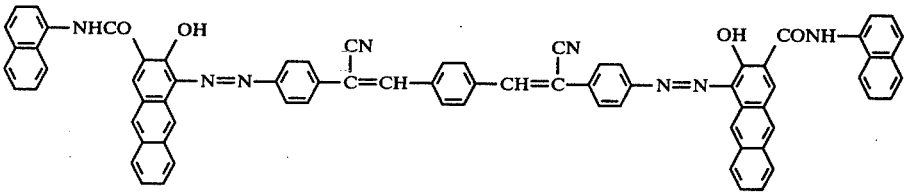
(I-21)
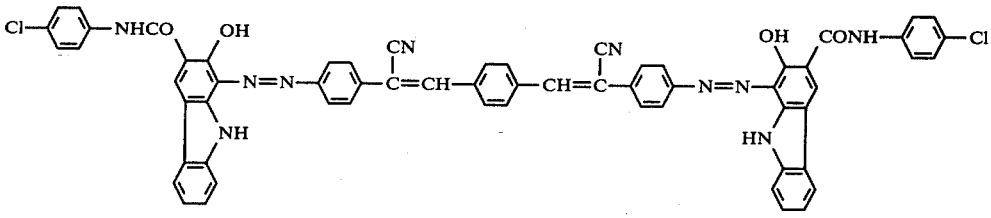
(I-22)
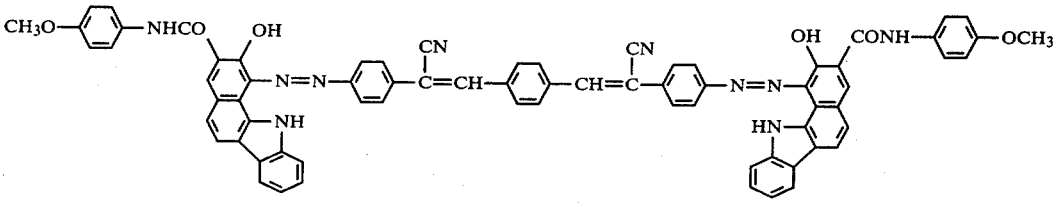
(I-23)
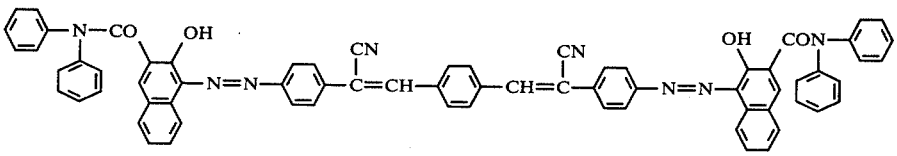
(I-24)
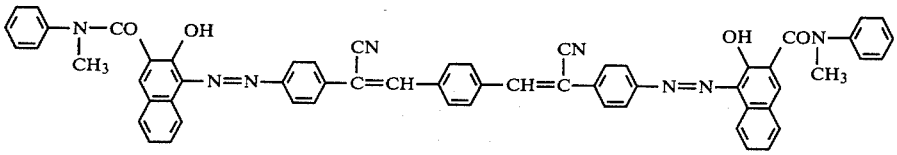
(I-25)

-continued
Exemplary compounds
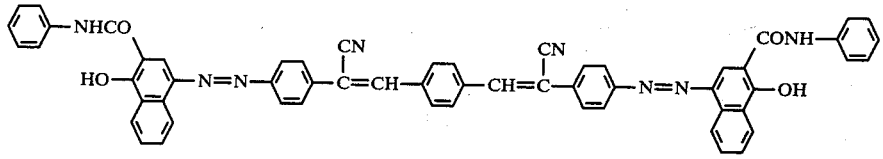
(I-26)
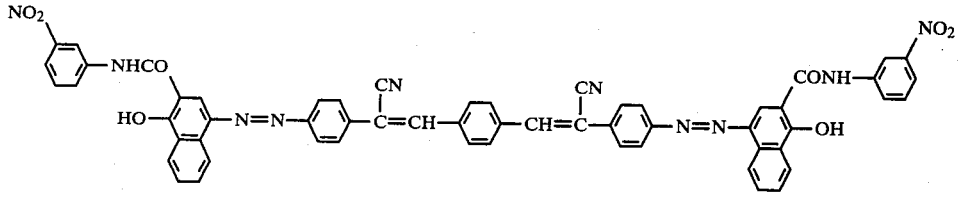
(I-27)
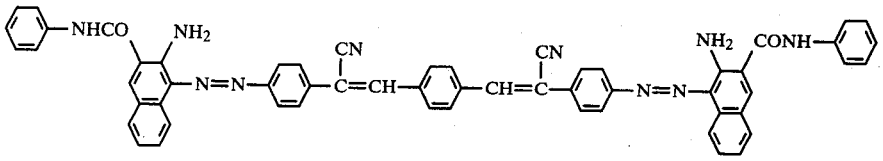
(I-28)
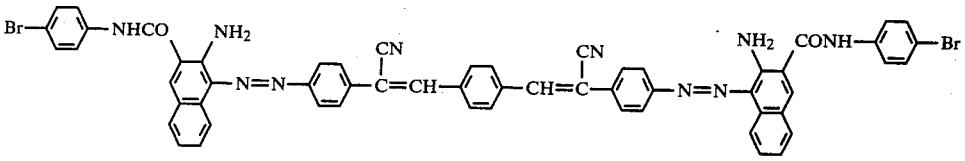
(I-29)
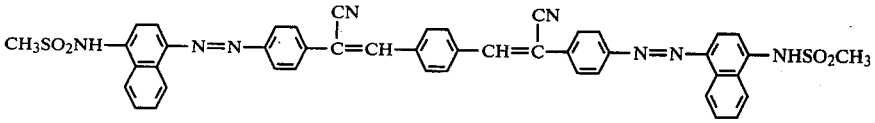
(I-30)
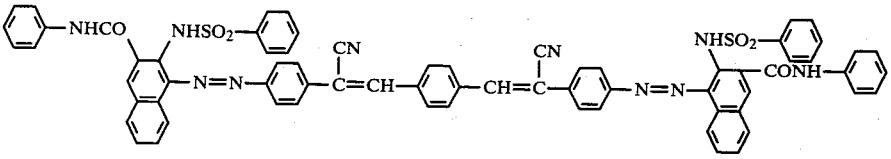
(I-31)
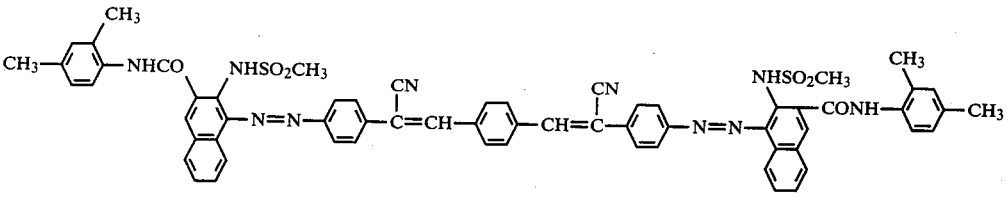
(I-32)
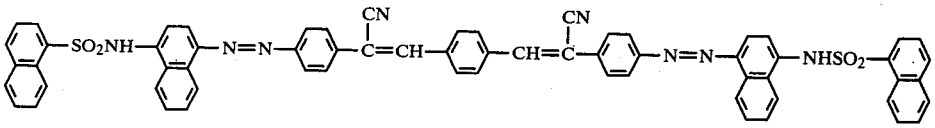
(I-33)
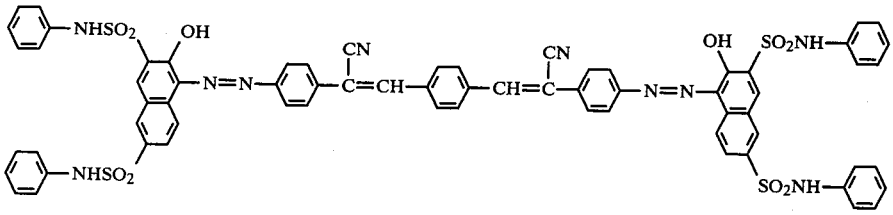
(I-34)

-continued
Exemplary compounds
(I-35)
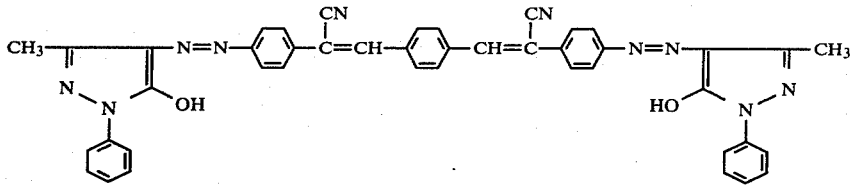
(I-36)
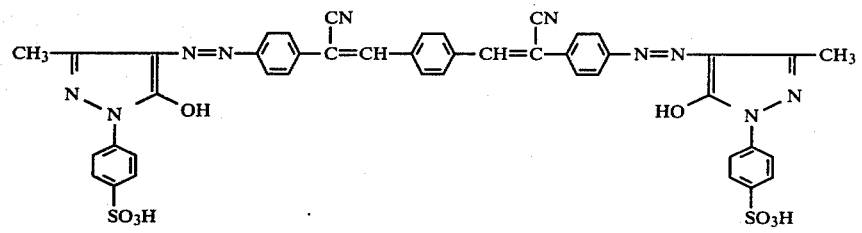
(I-37)
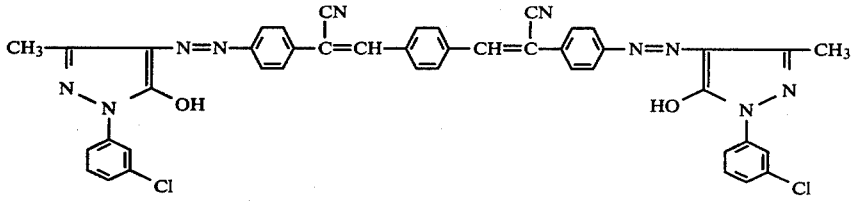
(I-38)
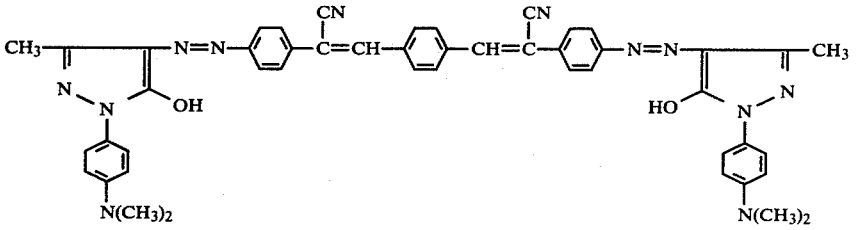
(I-39)
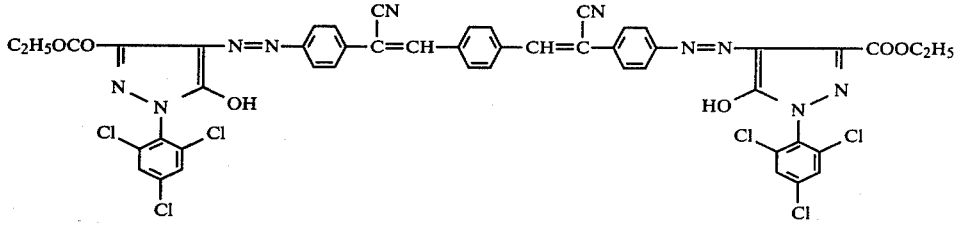
(I-40)
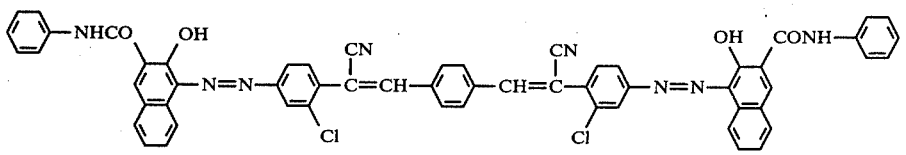
(I-41)
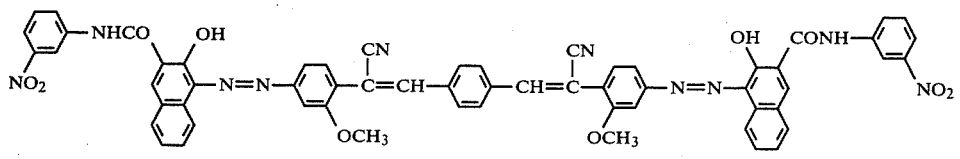
(I-42)
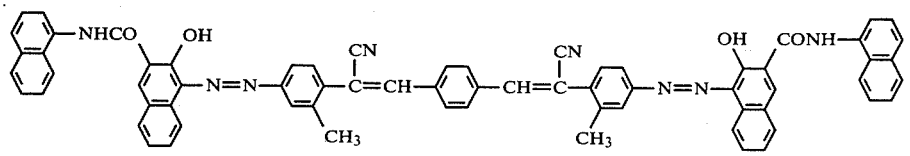

-continued
Exemplary compounds
(I-43)
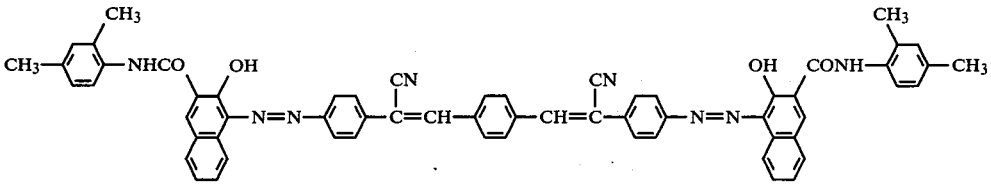
(I-44)
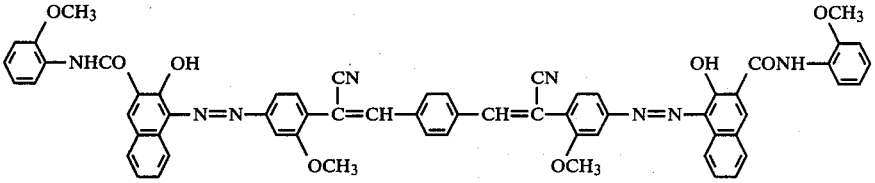
(I-45)
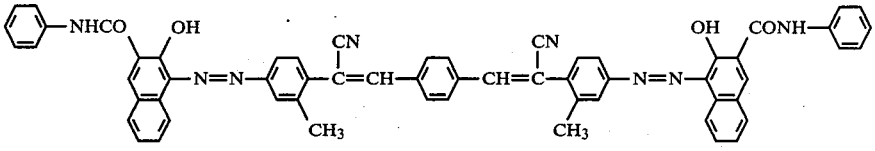
(I-46)
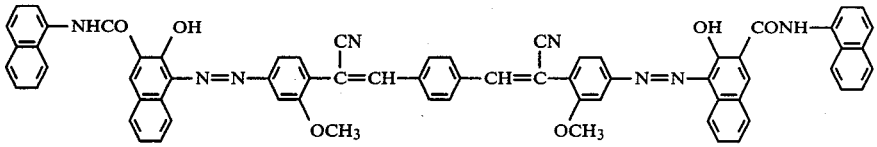
(I-47)
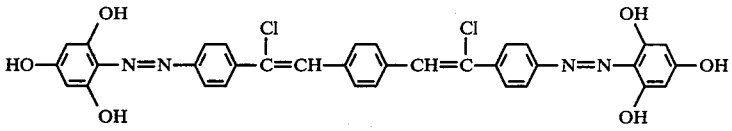
(I-48)
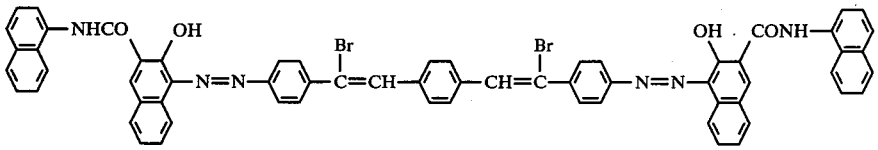
(I-49)
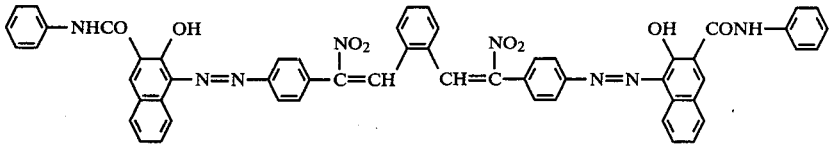
(I-50)
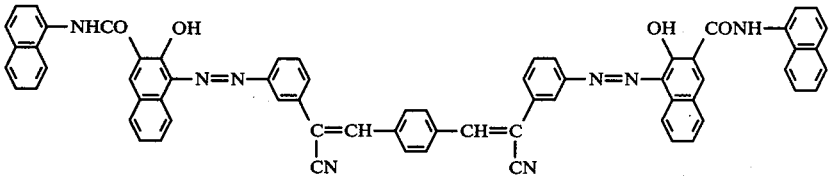
(I-51)
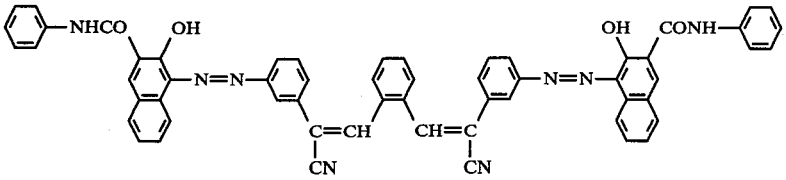

(I-52)
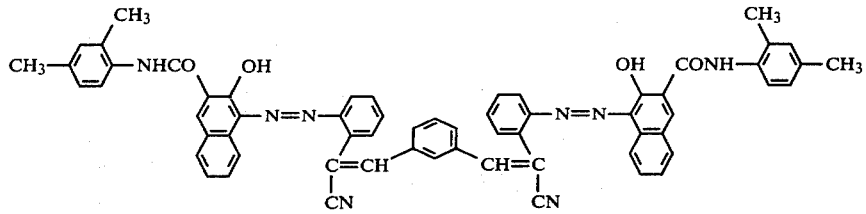
(I-53)
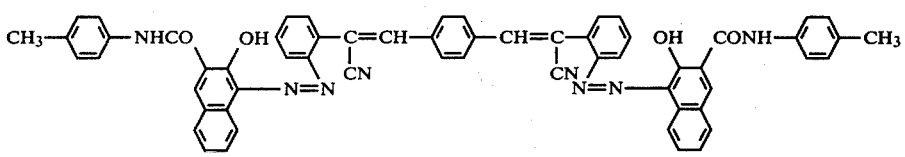
(I-54)
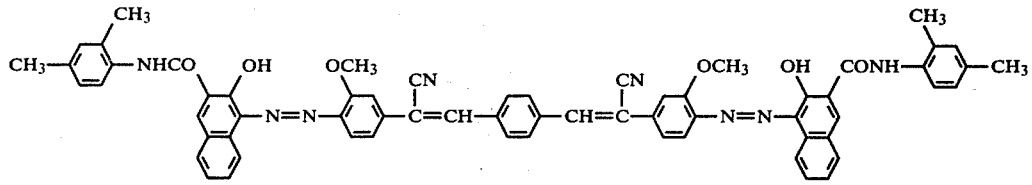
(I-55)
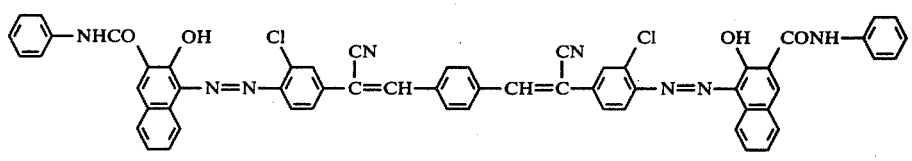
(I-56)
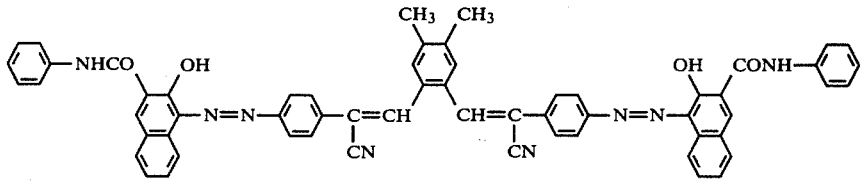
(I-57)
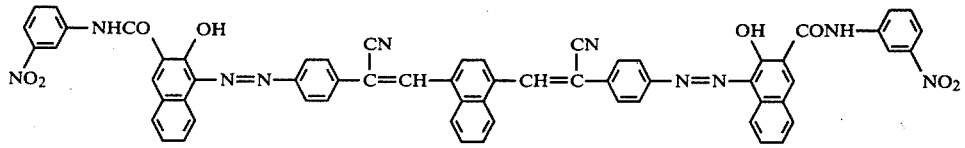
(I-58)
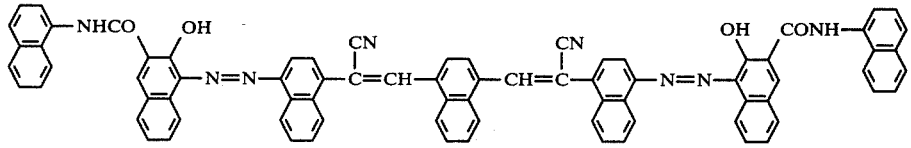
(I-59)
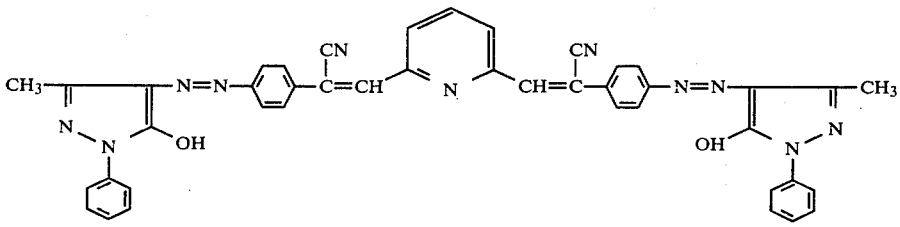

-continued
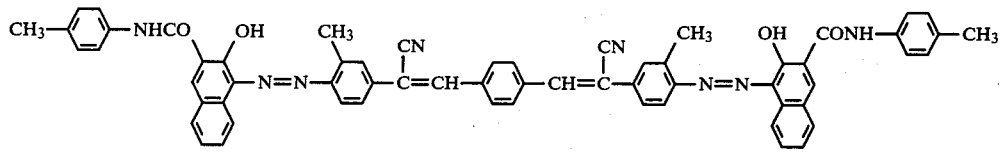
(I-60)
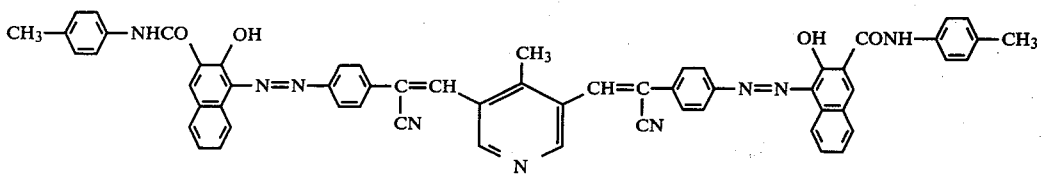
(I-61)
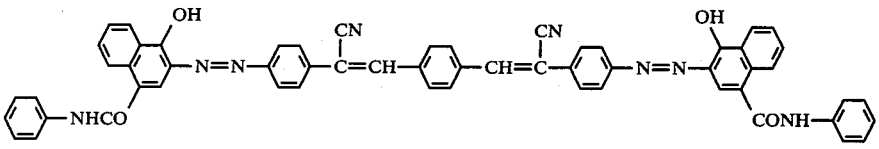
(I-62)
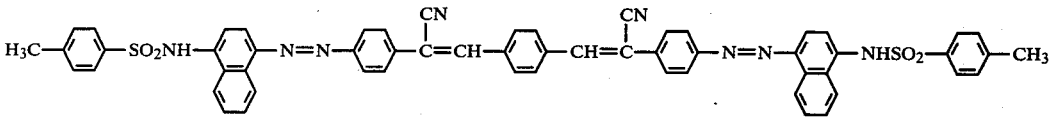
(I-63)
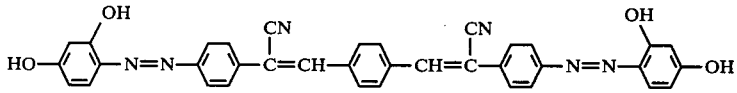
(I-64)
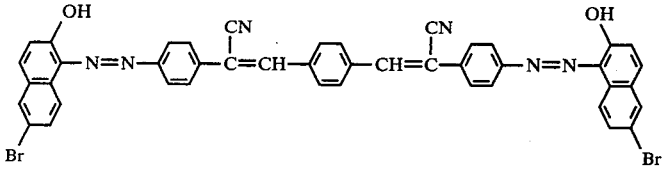
(I-65)
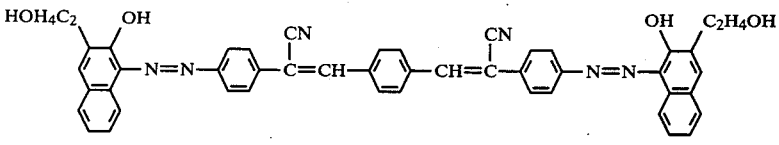
(I-66)
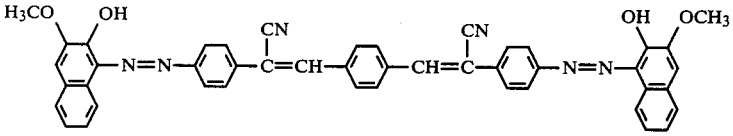
(I-67)
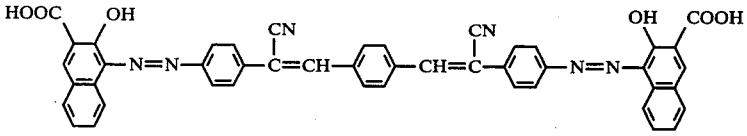
(I-68)
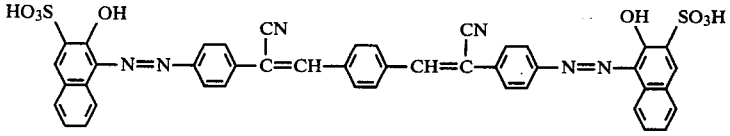
(I-69)
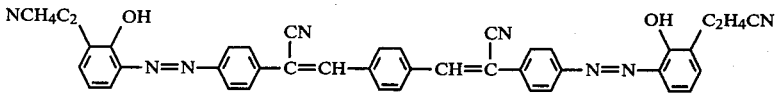
(I-70)

-continued
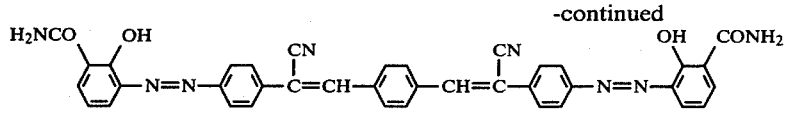
(I-71)
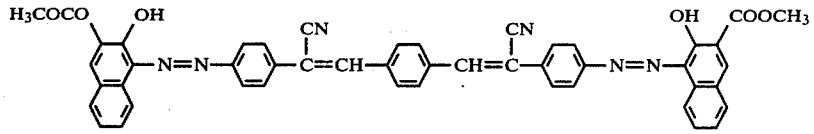
(I-72)
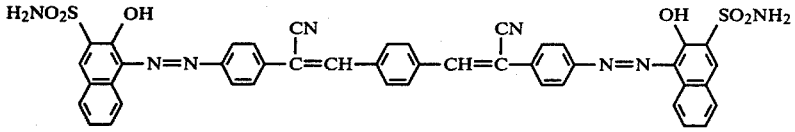
(I-73)
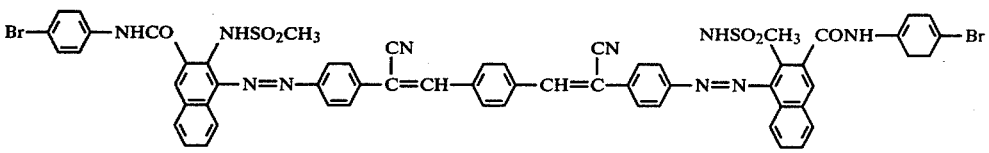
(I-74)
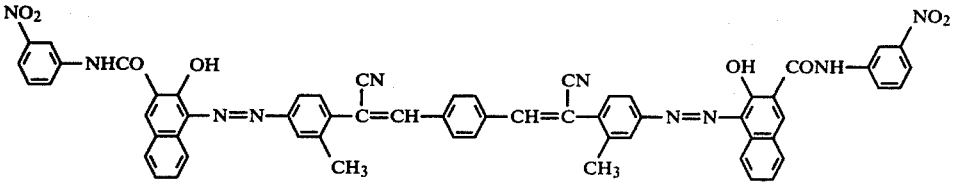
(I-75)
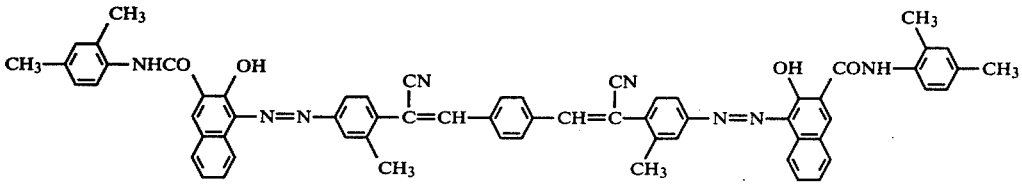
(I-76)
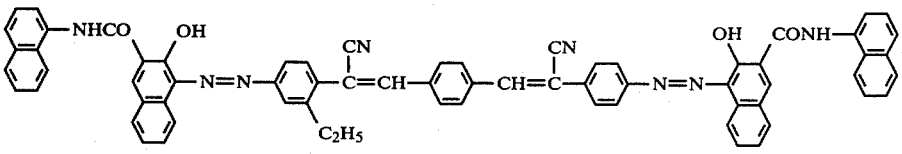
(I-77)
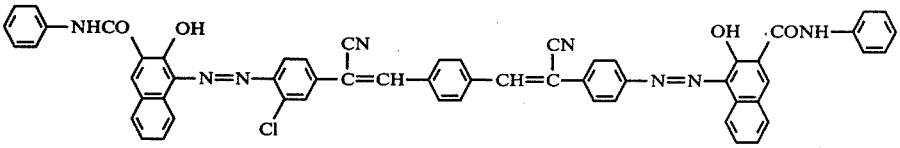
(I-78)
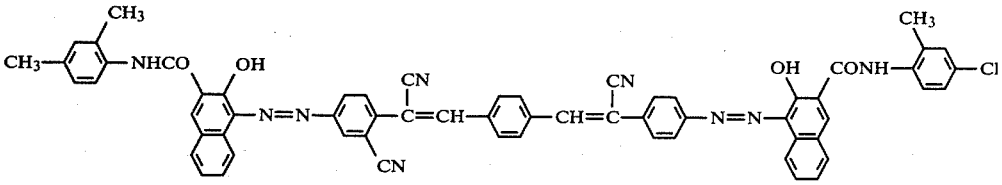
(I-79)
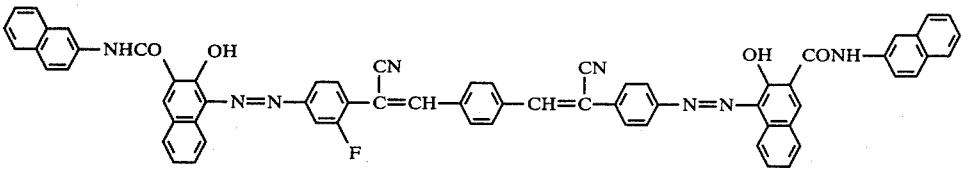
(I-80)

-continued
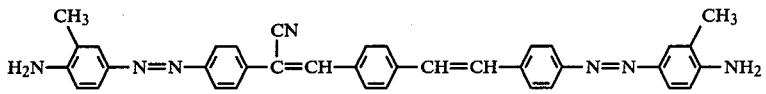
(I-81)
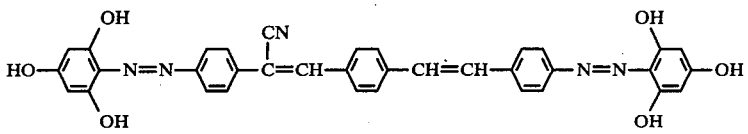
(I-82)
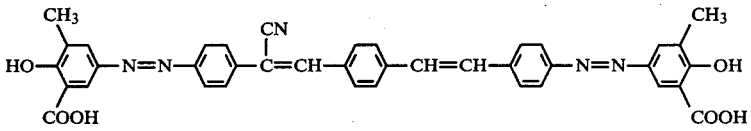
(I-83)
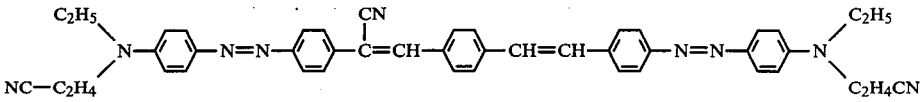
(I-84)
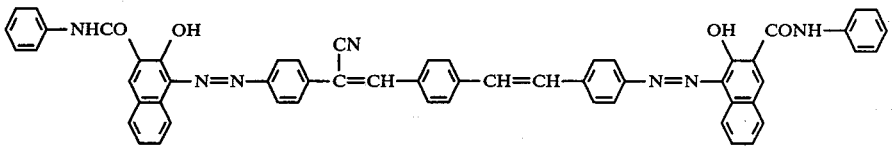
(I-85)
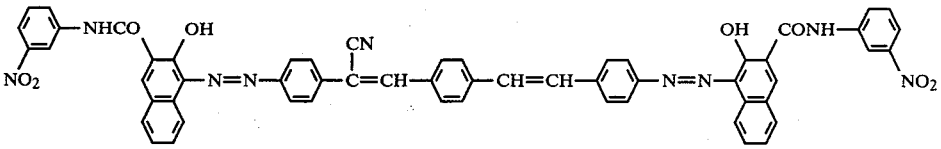
(I-86)
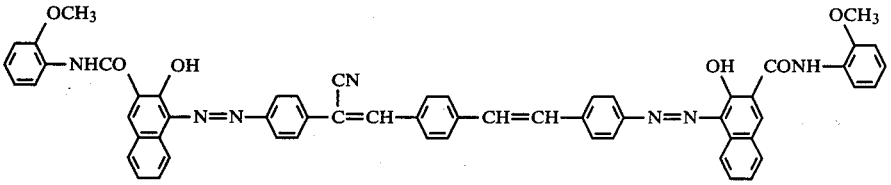
(I-87)
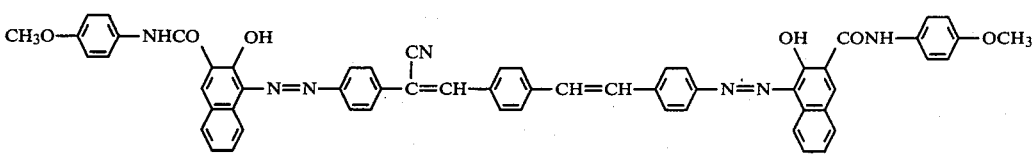
(I-88)
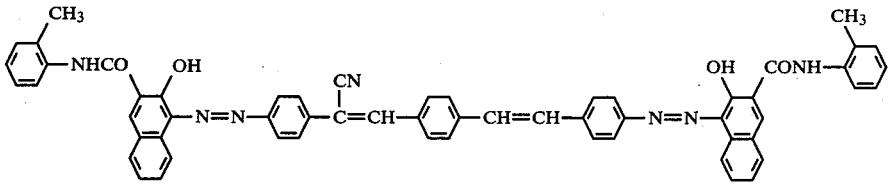
(I-89)
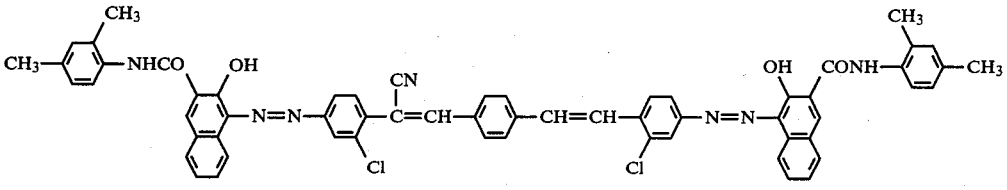
(I-90)

-continued
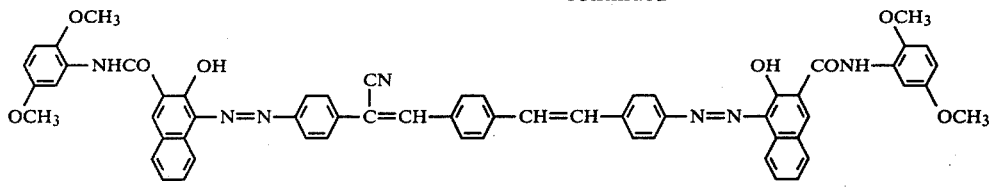
(I-91)
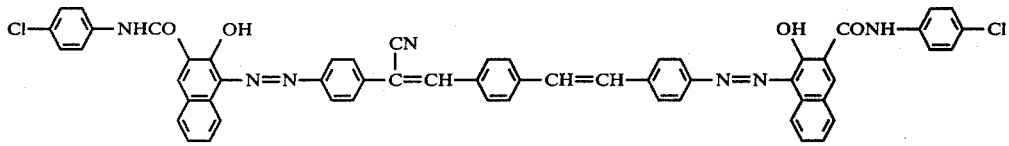
(I-92)
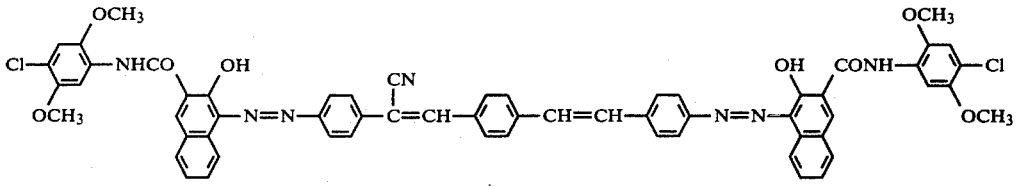
(I-93)
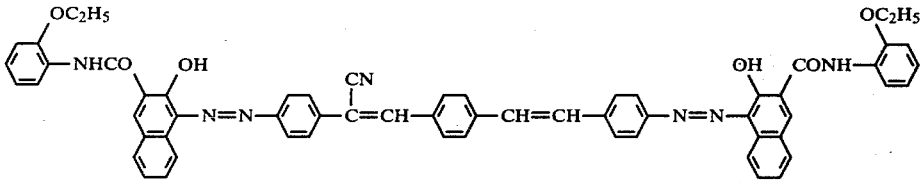
(I-94)
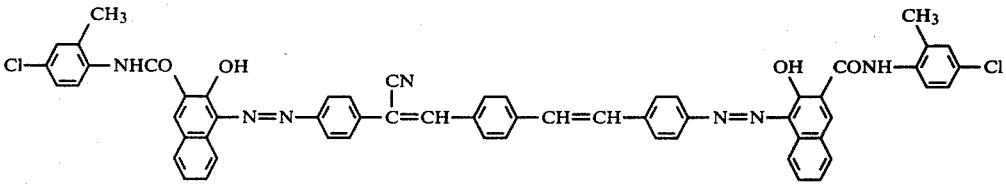
(I-95)
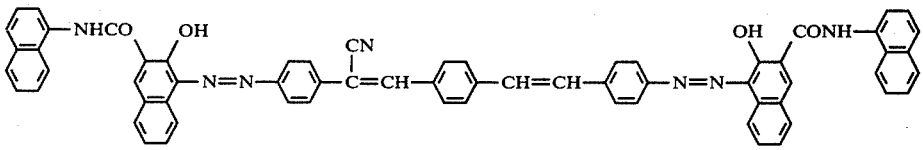
(I-96)
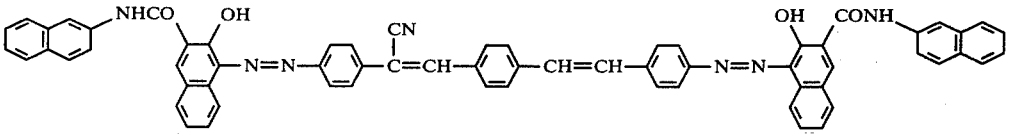
(I-97)
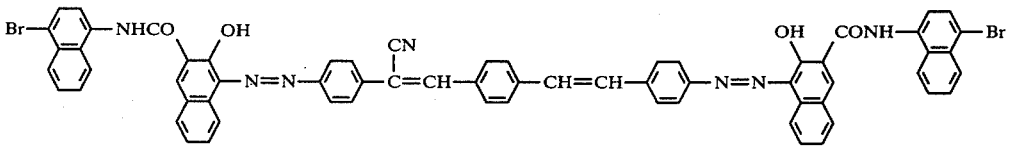
(I-98)
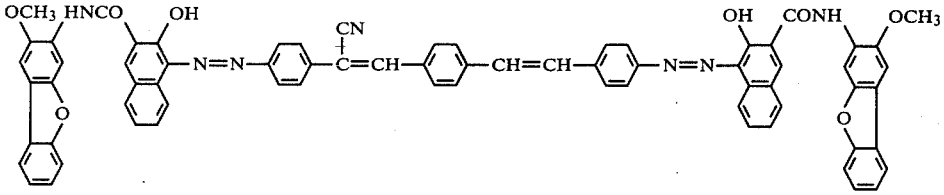
(I-99)

-continued
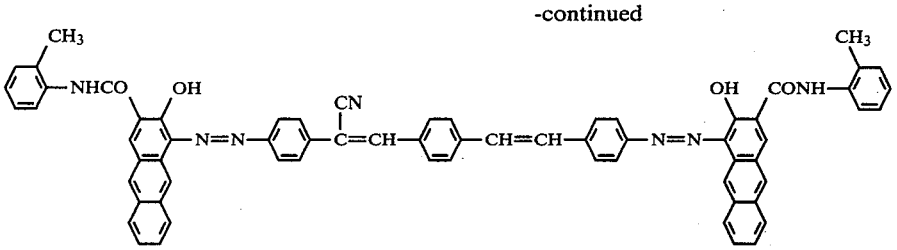
(I-100)
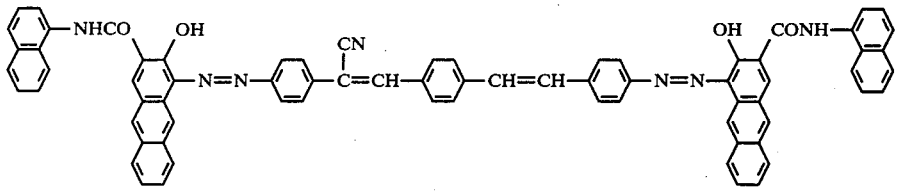
(I-101)
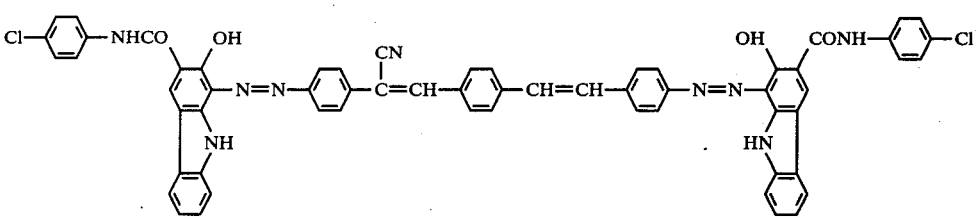
(I-102)
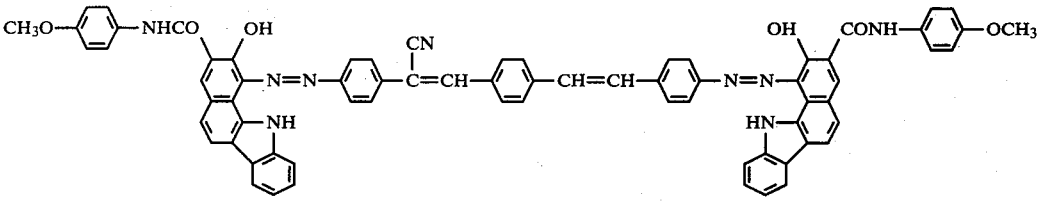
(I-103)
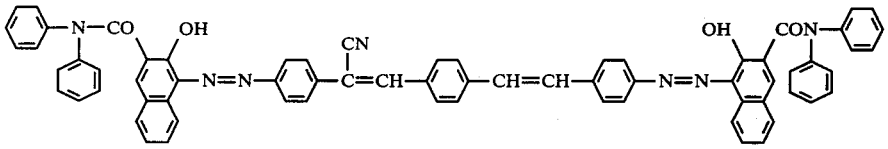
(I-104)
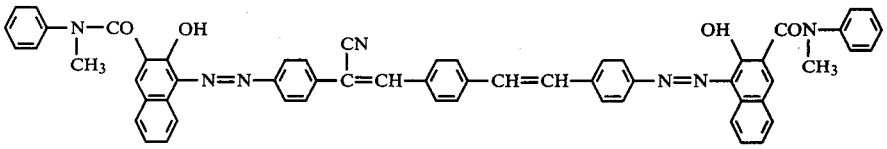
(I-105)
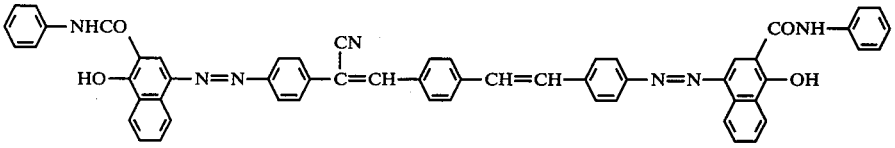
(I-106)
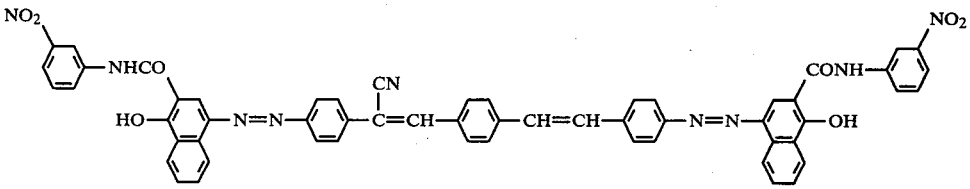
(I-107)

-continued
(I-108)
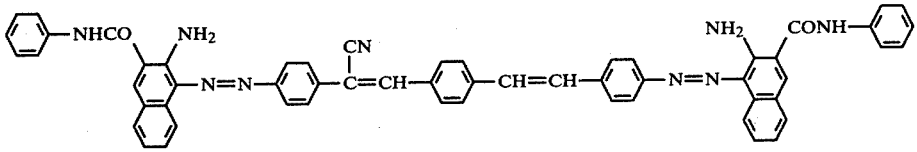
(I-109)
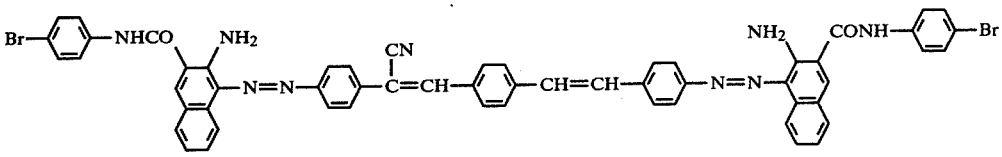
(I-110)
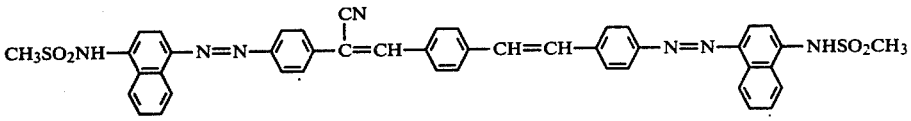
(I-111)
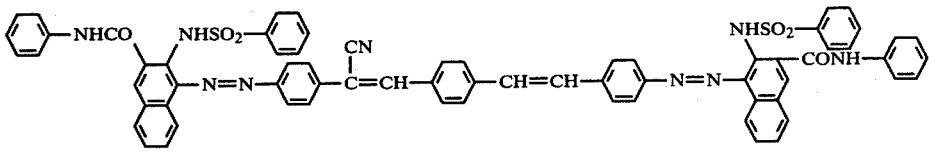
(I-112)
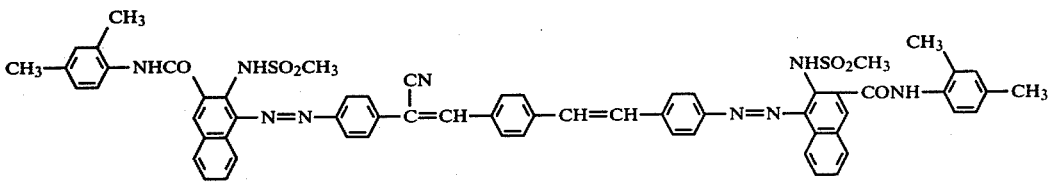
(I-113)
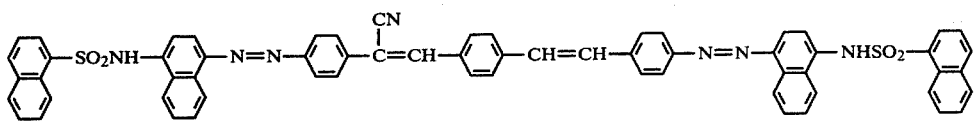
(I-114)
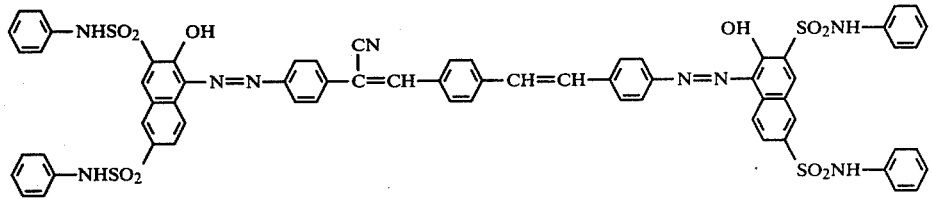
(I-115)
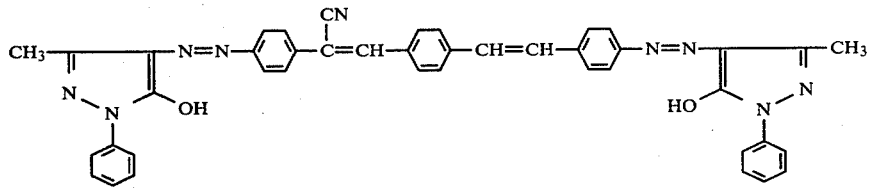
(I-116)
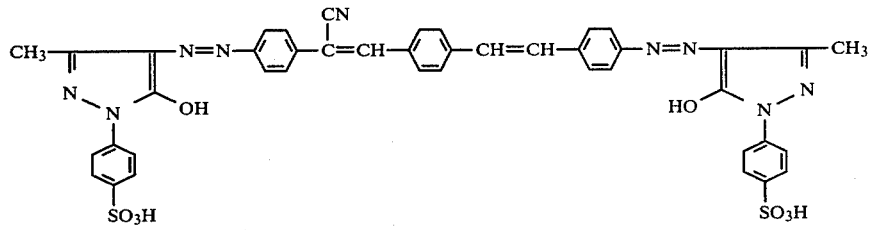

-continued
(I-117)
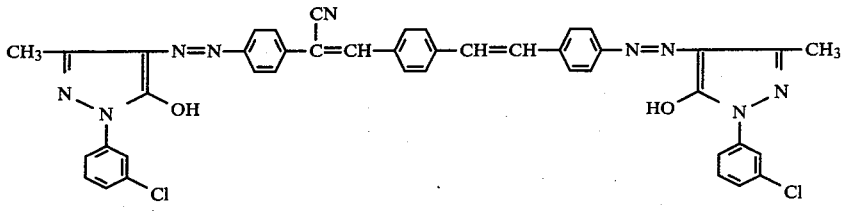
(I-118)
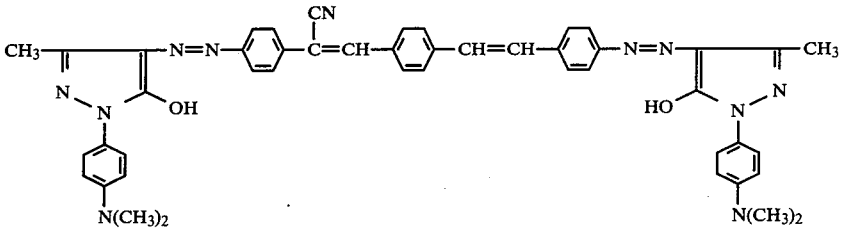
(I-119)
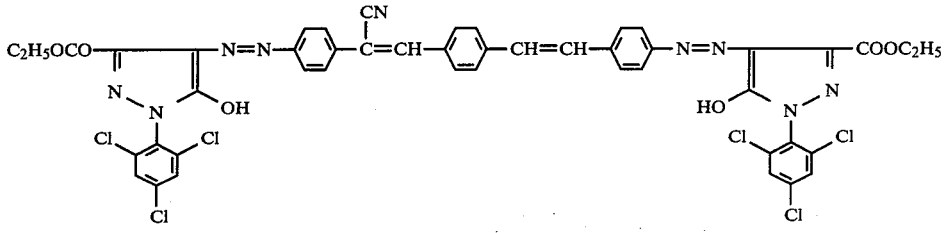
(I-120)
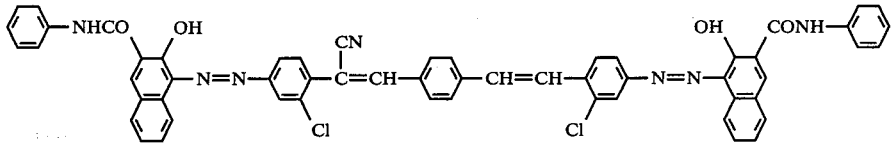
(I-121)
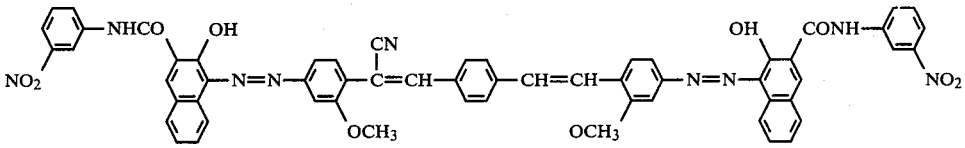
(I-122)
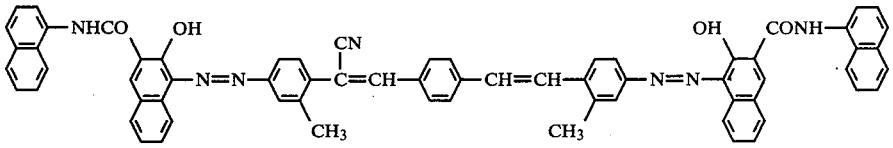
(I-123)
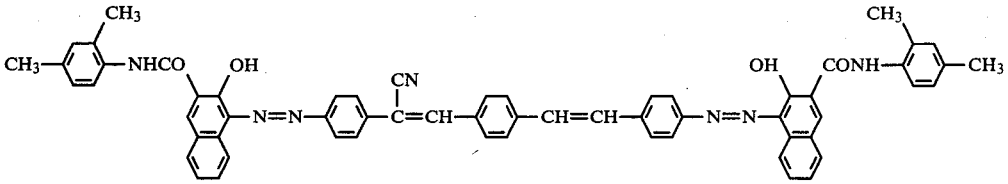
(I-124)
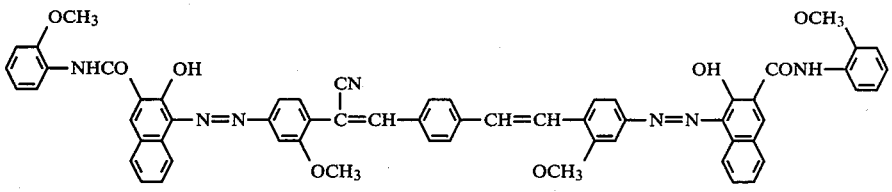

-continued
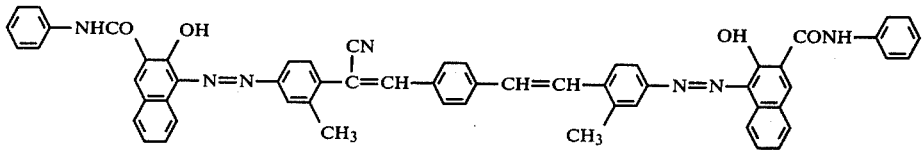
(I-125)
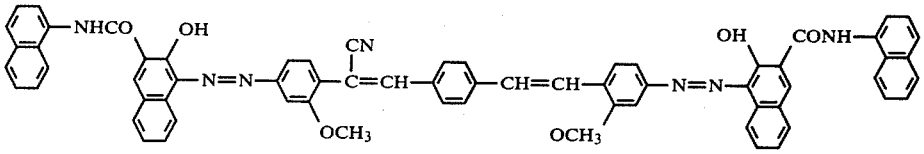
(I-126)
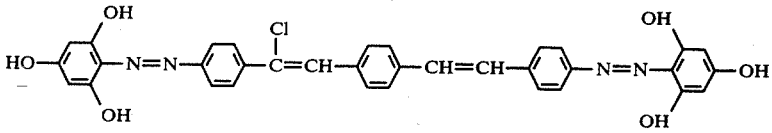
(I-127)
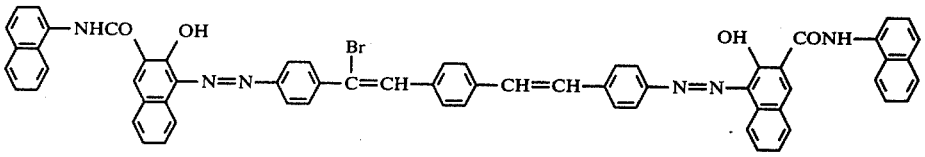
(I-128)
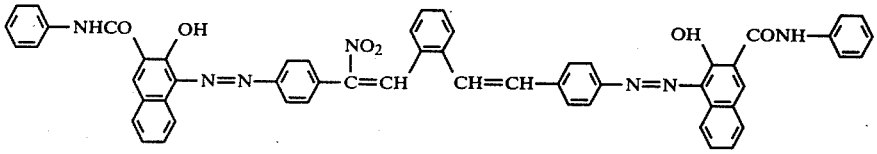
(I-129)
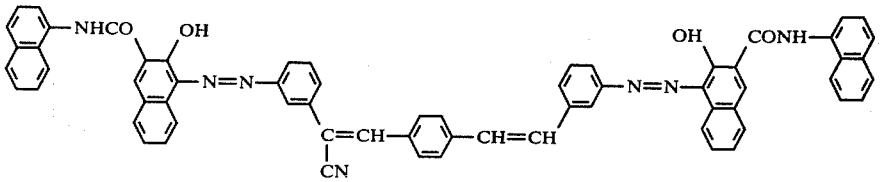
(I-130)
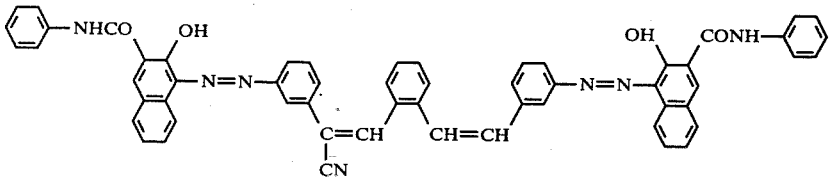
(I-131)
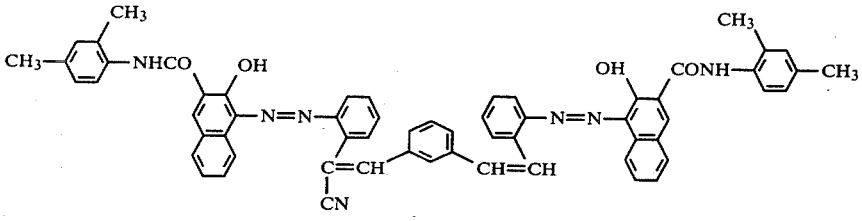
(I-132)
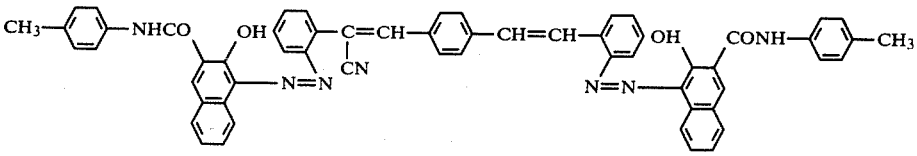
(I-133)

-continued
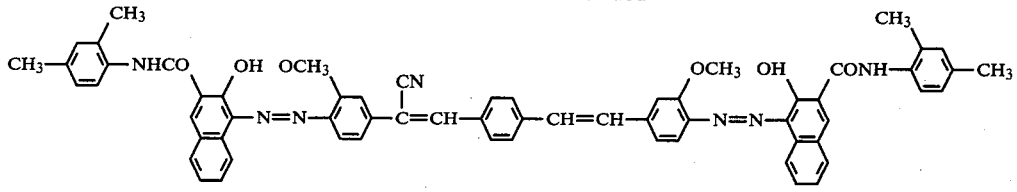
(I-134)
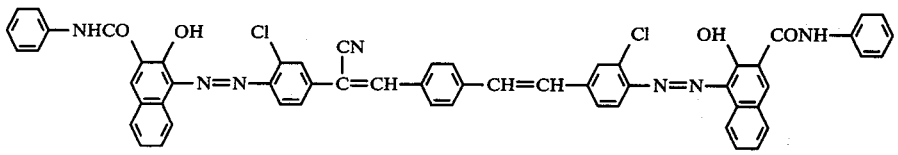
(I-135)
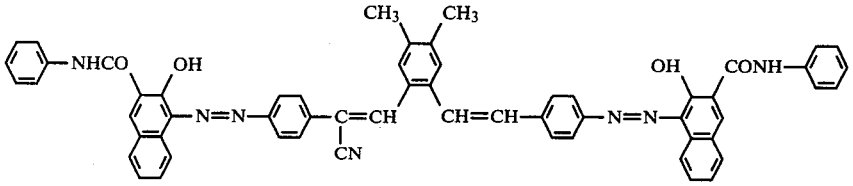
(I-136)
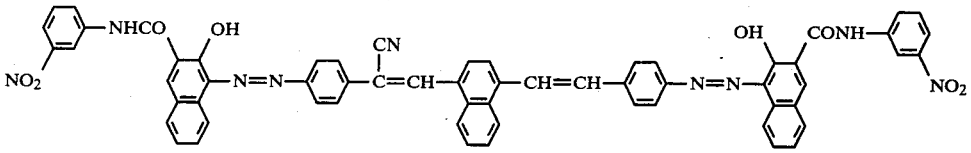
(I-137)
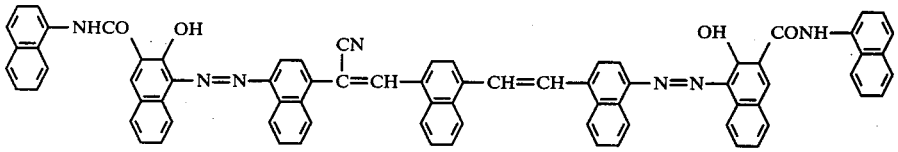
(I-138)
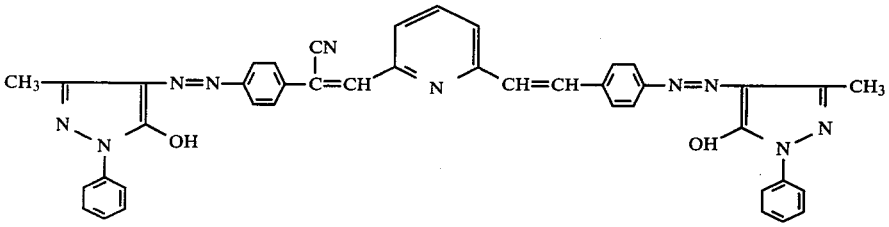
(I-139)
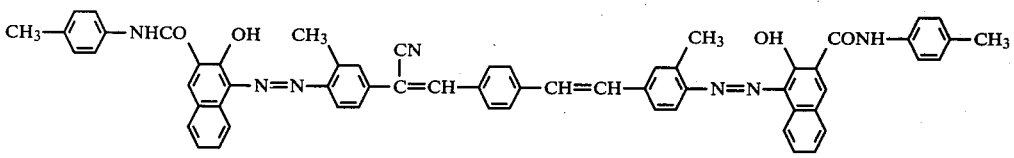
(I-140)
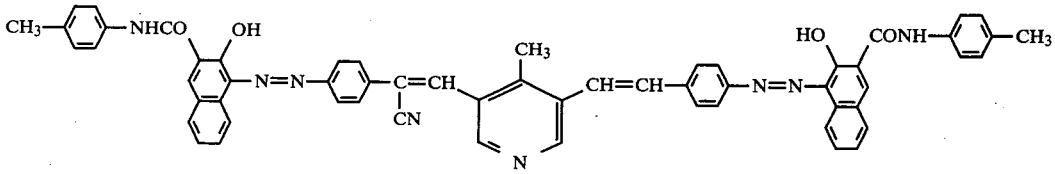
(I-141)
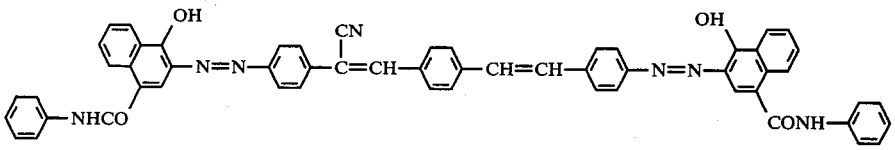
(I-142)

-continued
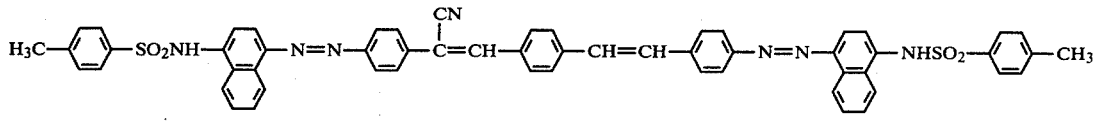
(I-143)
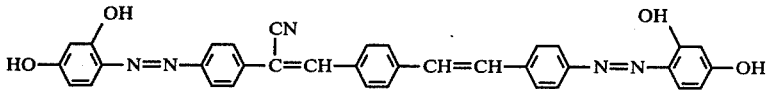
(I-144)
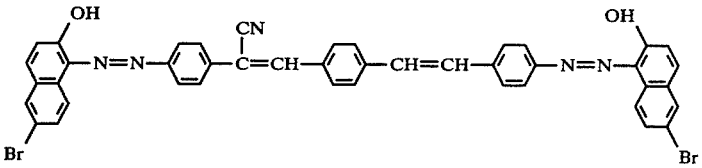
(I-145)
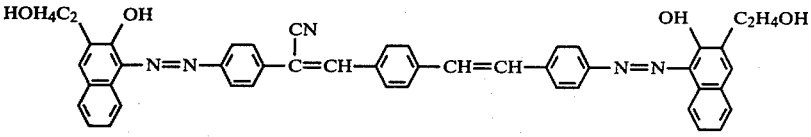
(I-146)
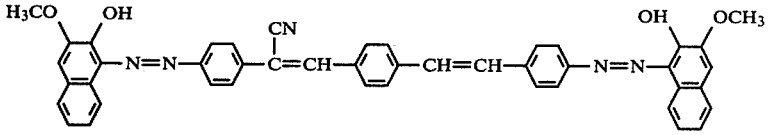
(I-147)
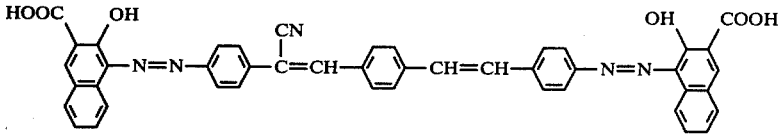
(I-148)
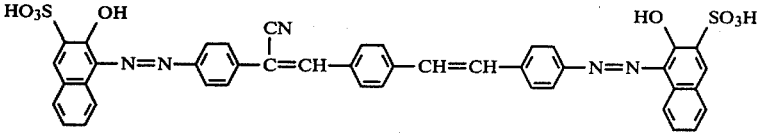
(I-149)
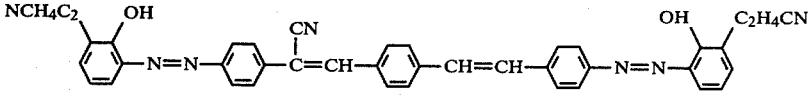
(I-150)
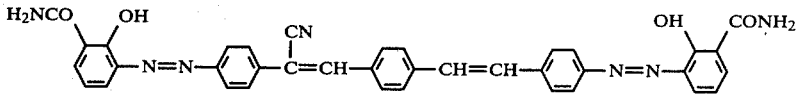
(I-151)
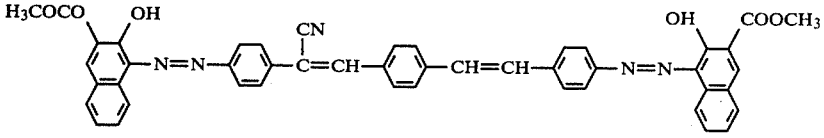
(I-152)
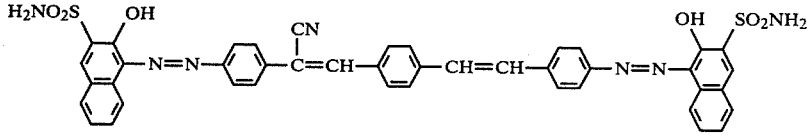
(I-153)

-continued
(I-154)
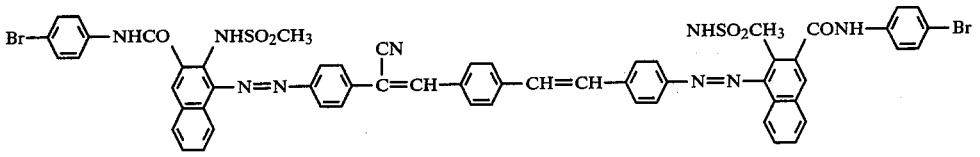
(I-155)
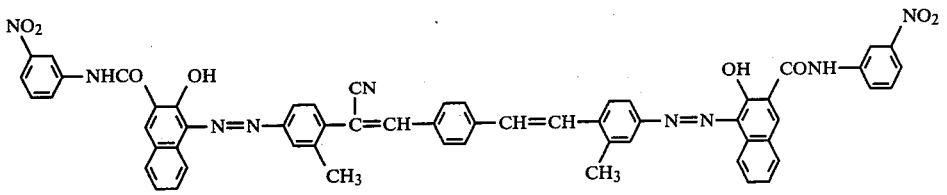
(I-156)
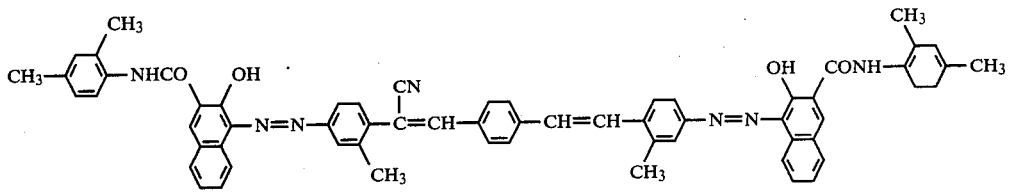
(I-157)
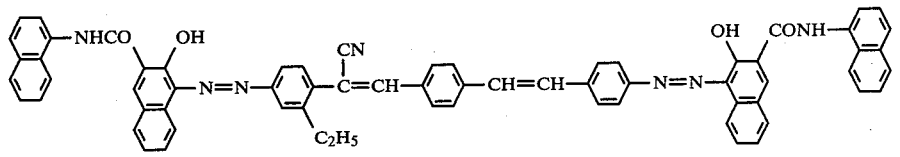
(I-158)
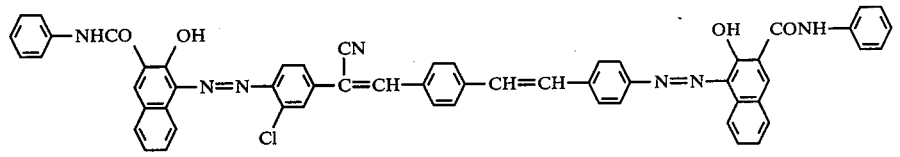
(I-159)
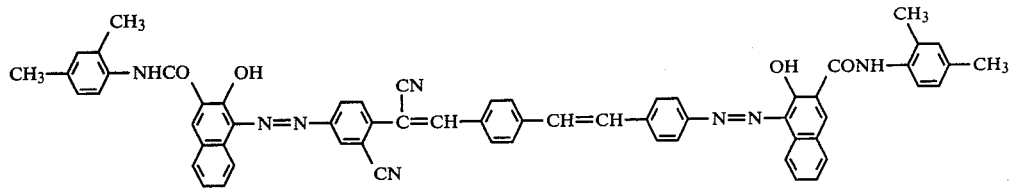
(I-160)
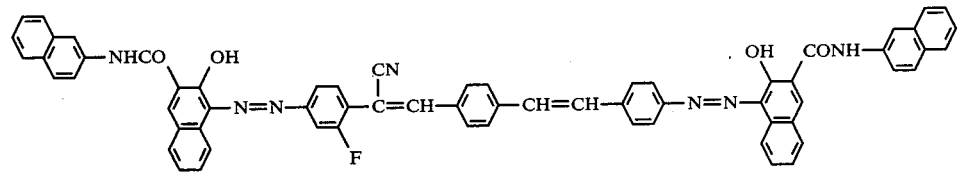
(I-161)
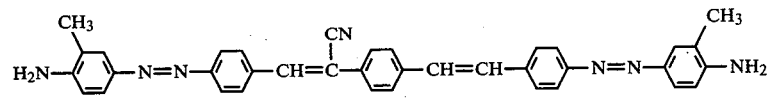
(I-162)
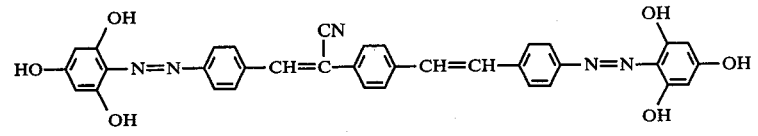
(I-163)
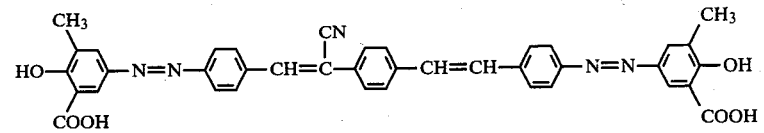

-continued
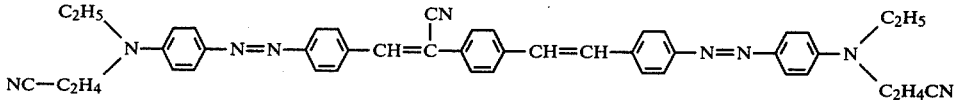
(I-164)
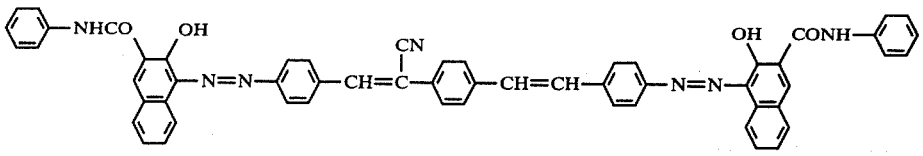
(I-165)
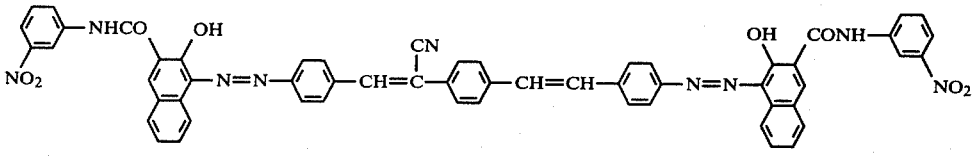
(I-166)
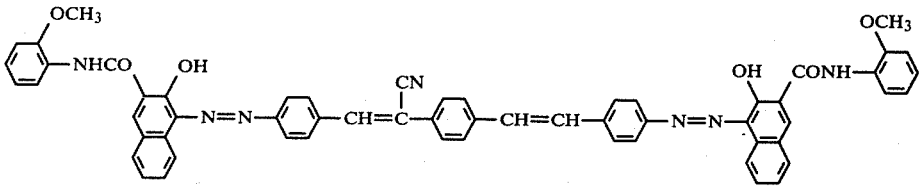
(I-167)
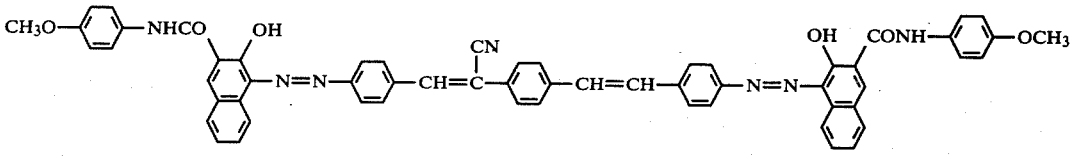
(I-168)
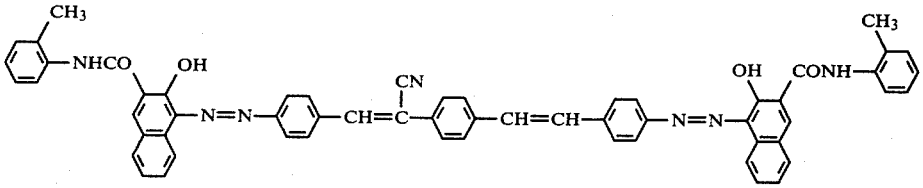
(I-169)
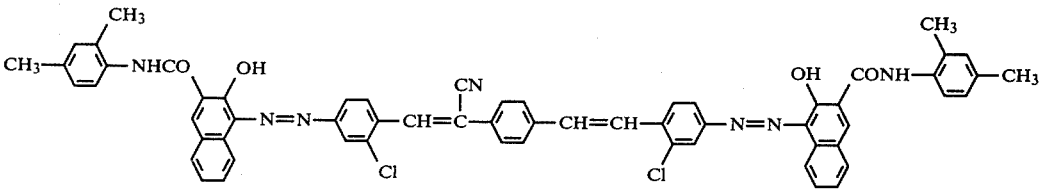
(I-170)
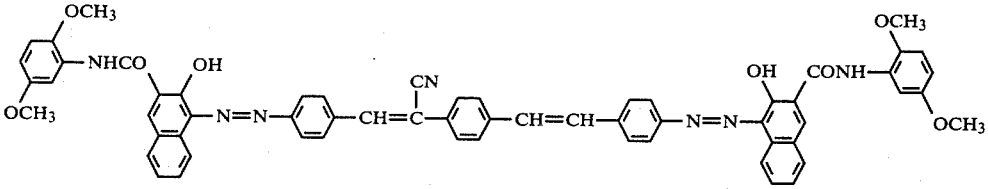
(I-171)
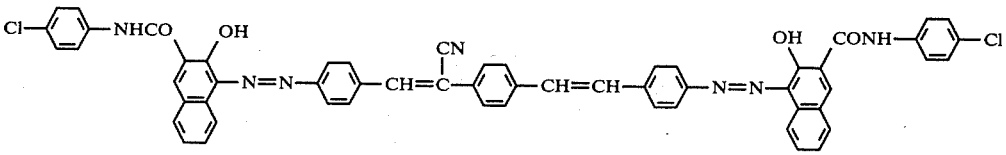
(I-172)

-continued
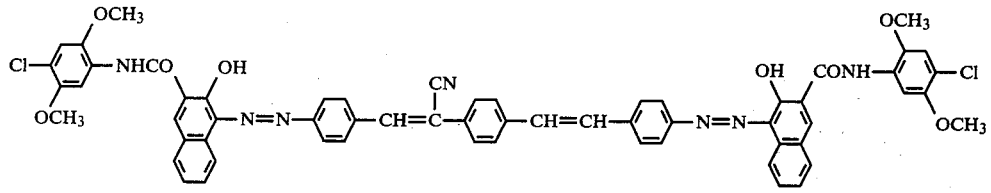
(I-173)
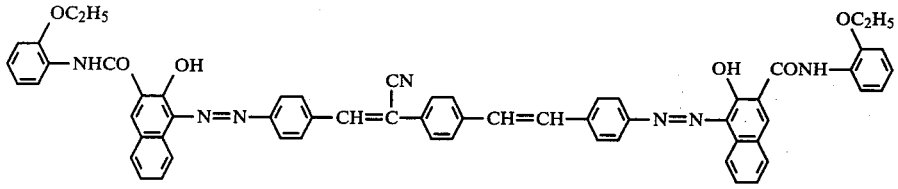
(I-174)
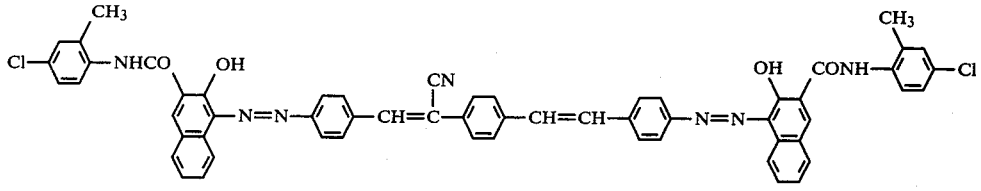
(I-175)
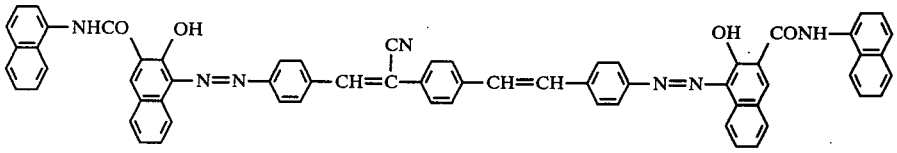
(I-176)
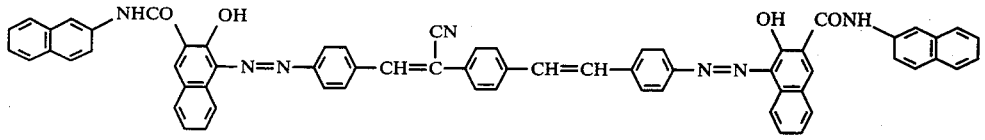
(I-177)
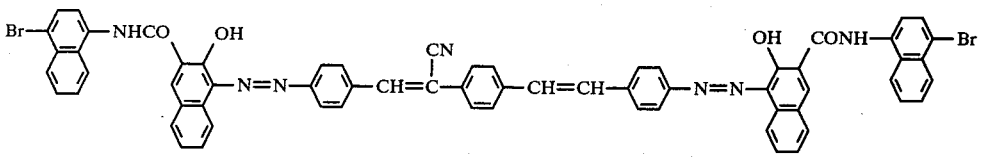
(I-178)
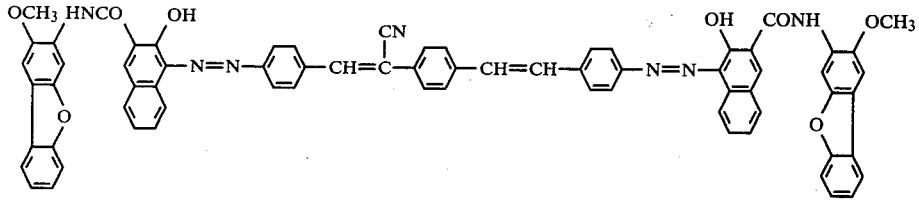
(I-179)
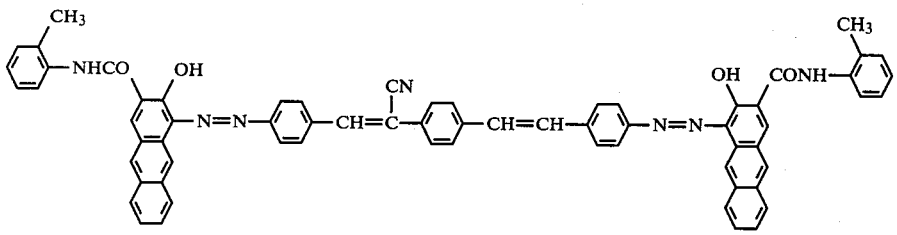
(I-180)

-continued
(I-181)
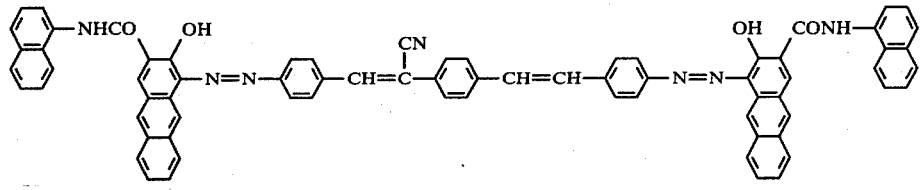
(I-182)
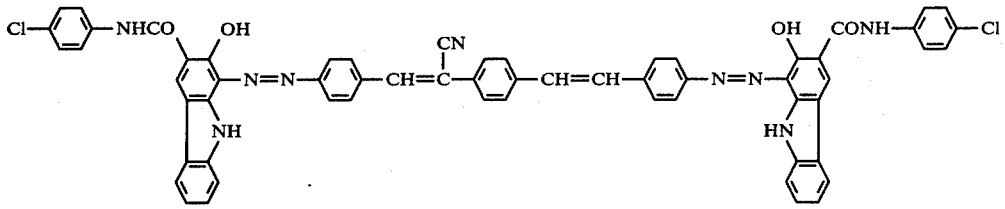
(I-183)
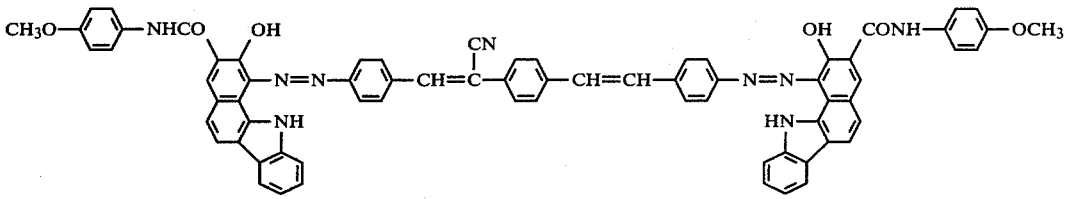
(I-184)
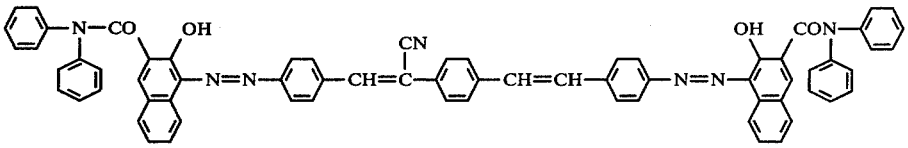
(I-185)
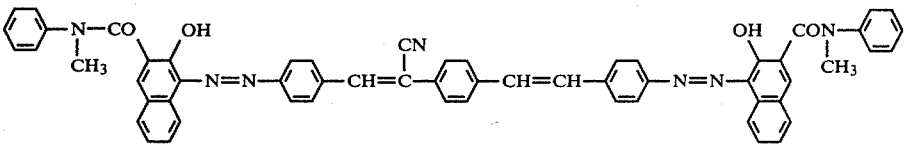
(I-186)
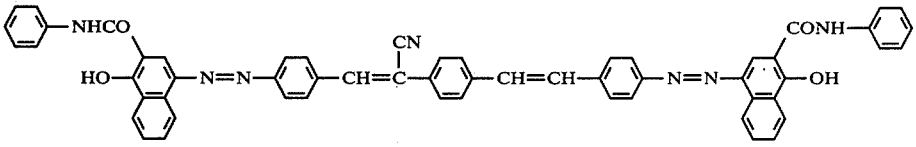
(I-187)
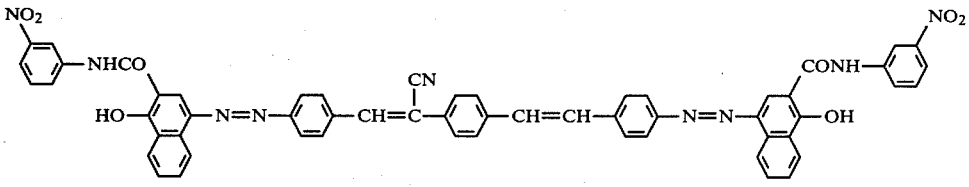
(I-188)
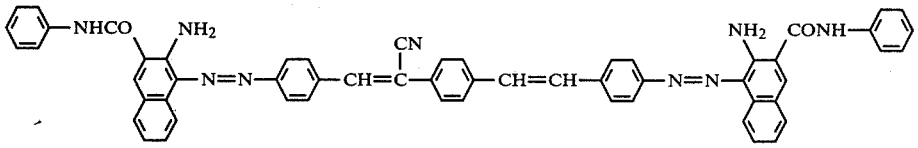

-continued
(I-189)
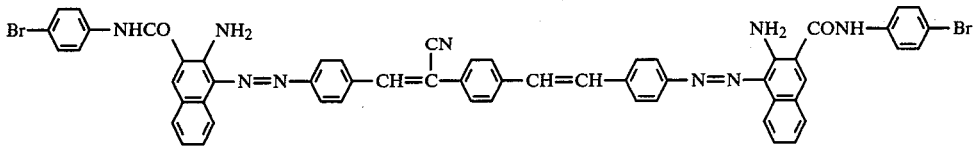
(I-190)
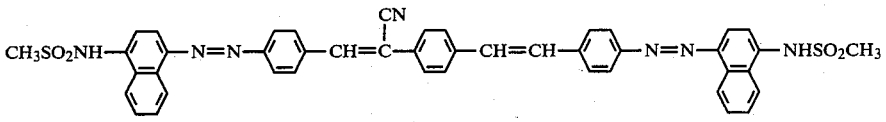
(I-191)
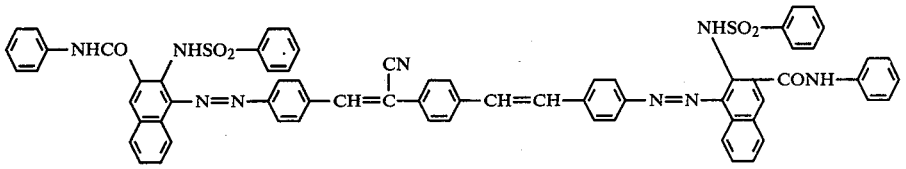
(I-192)
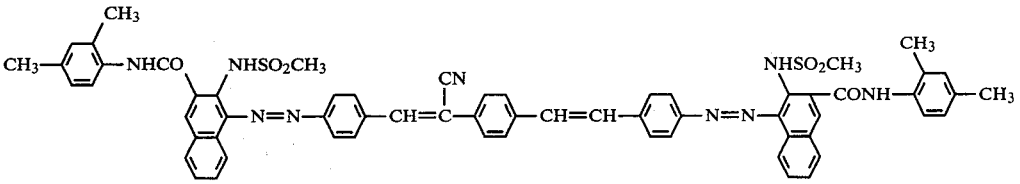
(I-193)
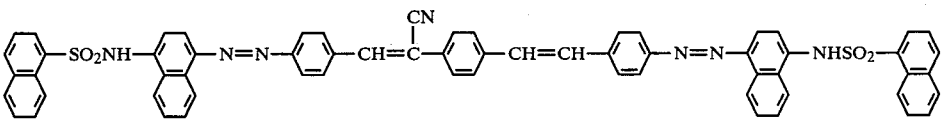
(I-194)
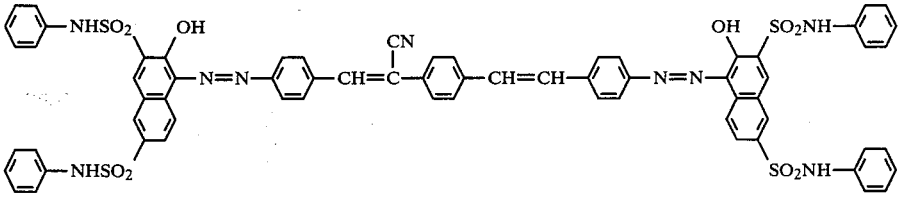
(I-195)
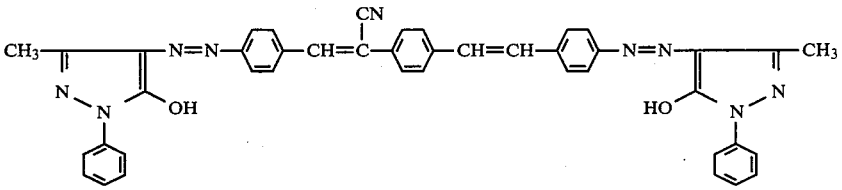
(I-196)
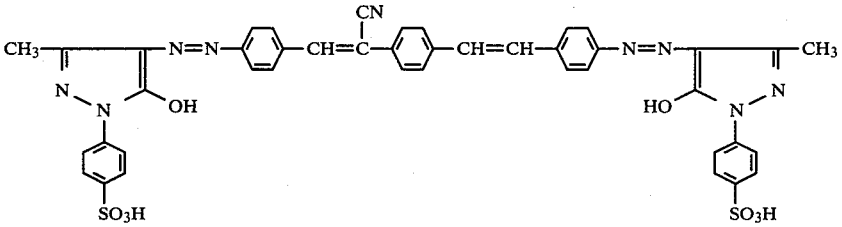

-continued
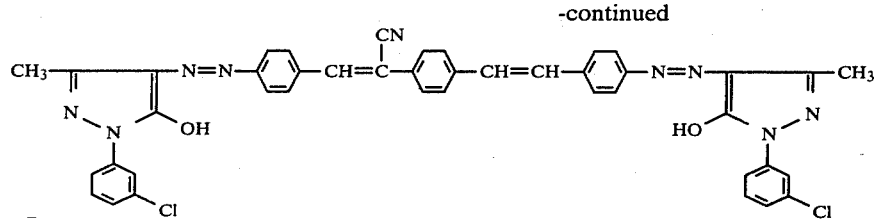
(I-197)
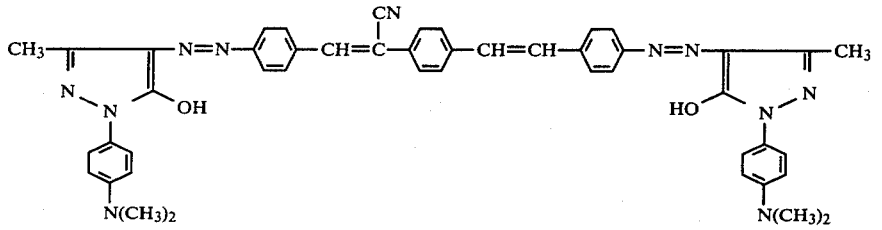
(I-198)
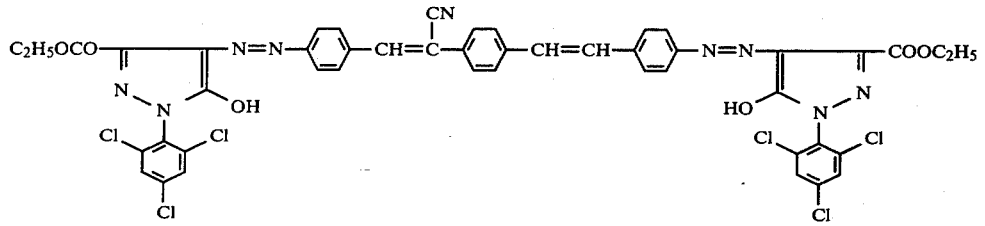
(I-199)
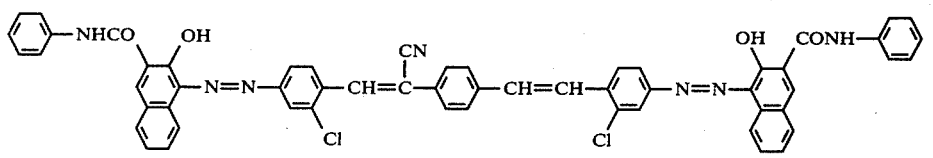
(I-200)
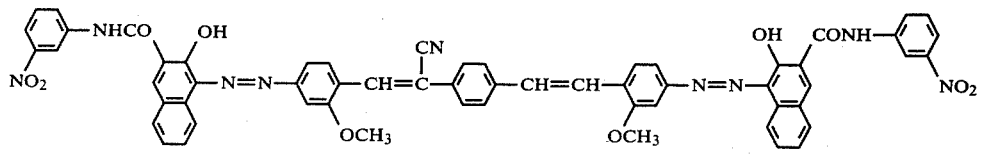
(I-201)
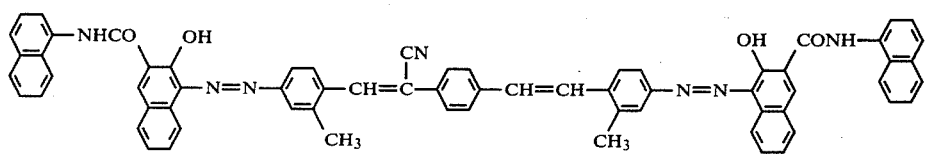
(I-202)
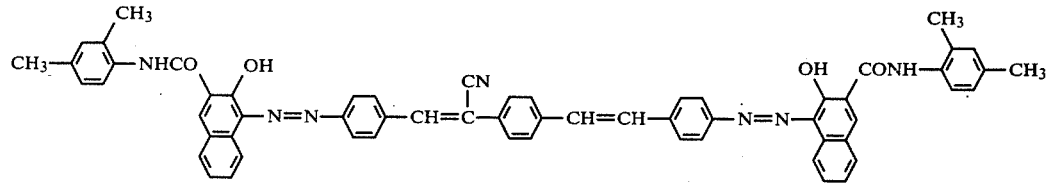
(I-203)
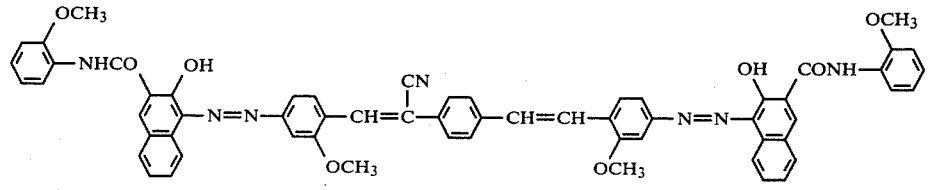
(I-204)

-continued
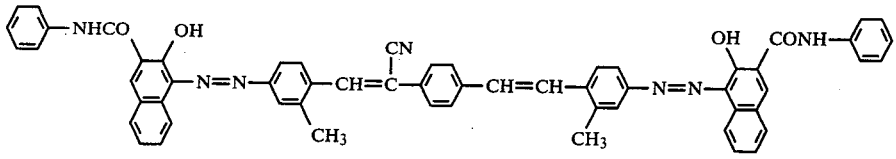
(I-205)
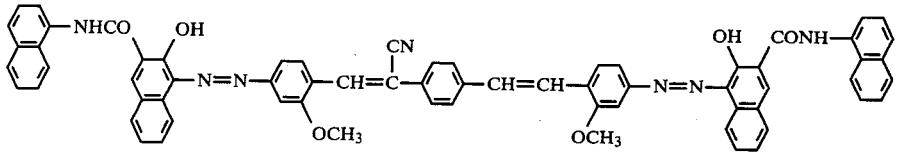
(I-206)
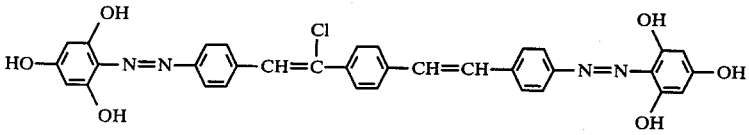
(I-207)
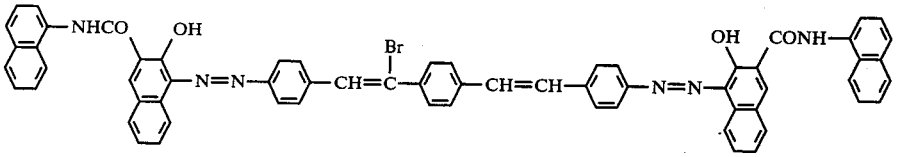
(I-208)
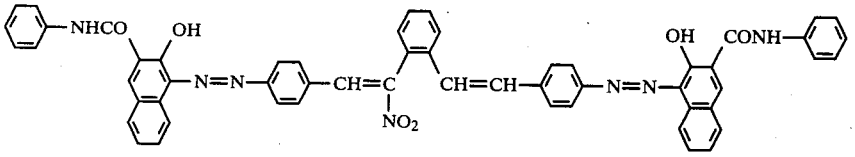
(I-209)
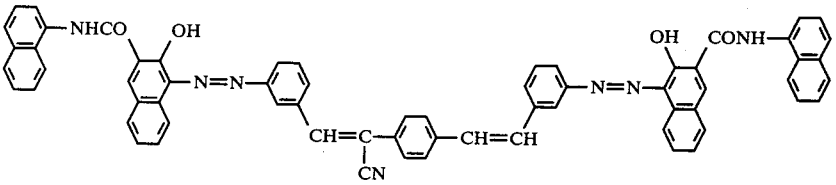
(I-210)
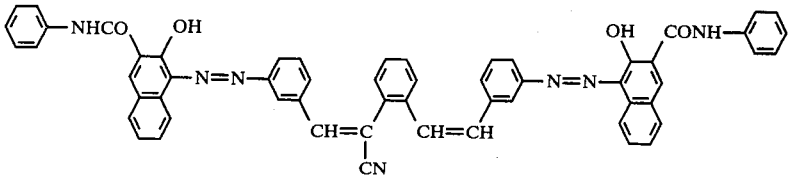
(I-211)
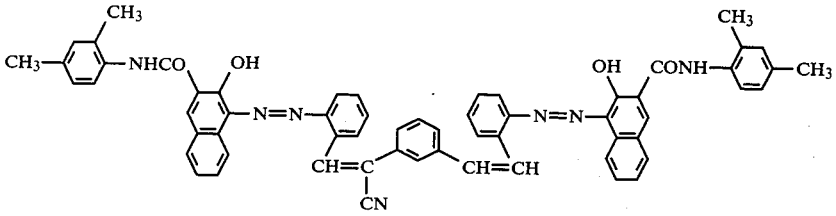
(I-212)
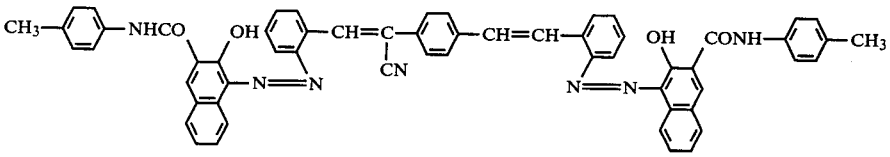
(I-213)

-continued
(I-214)
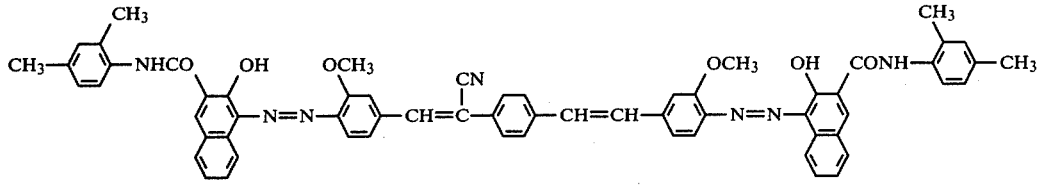
(I-215)
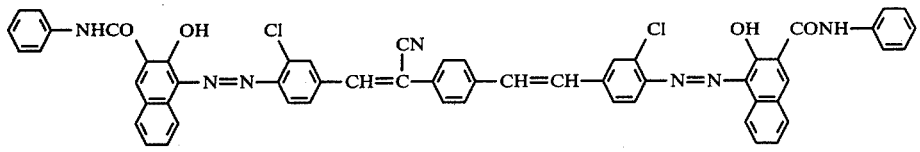
(I-216)
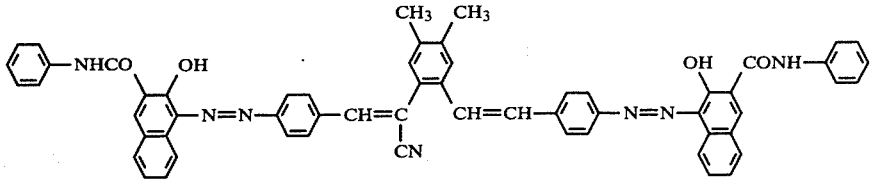
(I-217)
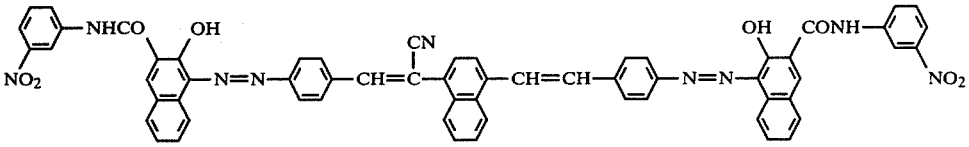
(I-218)
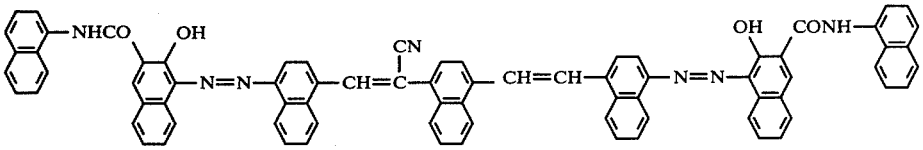
(I-219)
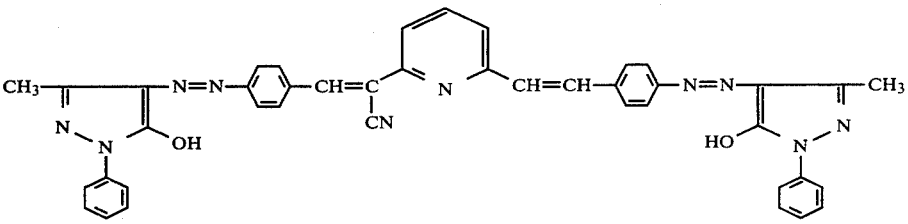
(I-220)
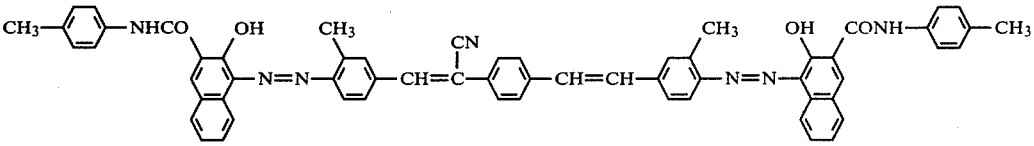
(I-221)
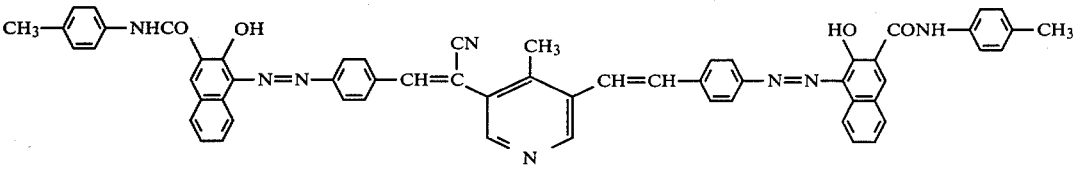
(I-222)
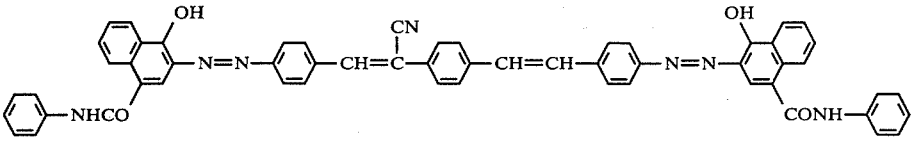

-continued
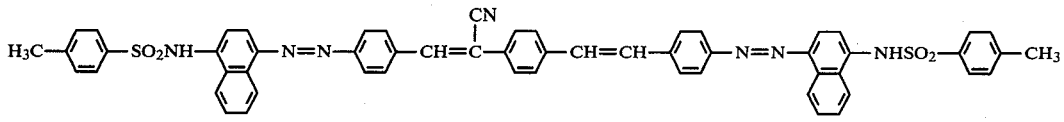
(I-223)
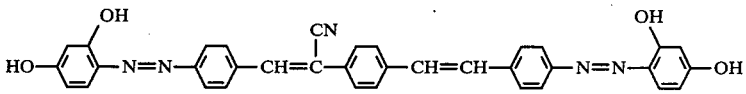
(I-224)
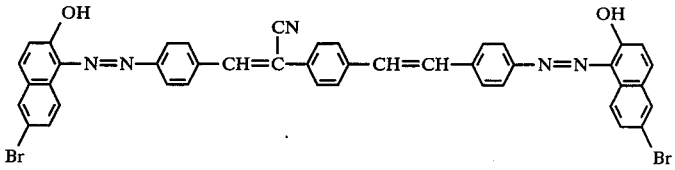
(I-225)
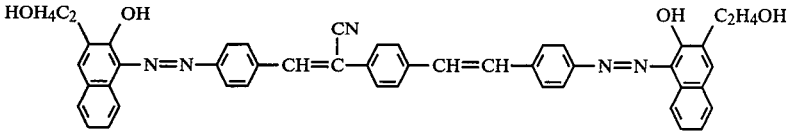
(I-226)
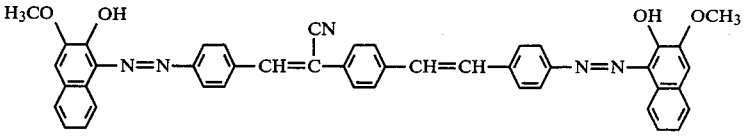
(I-227)
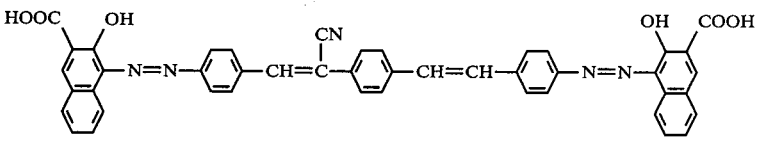
(I-228)
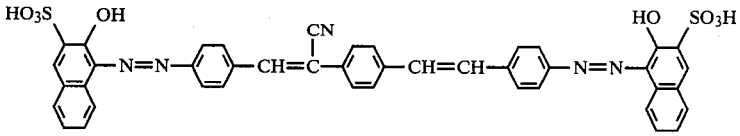
(I-229)
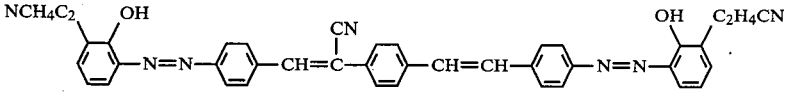
(I-230)
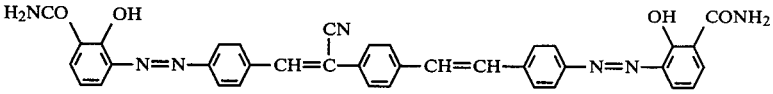
(I-231)
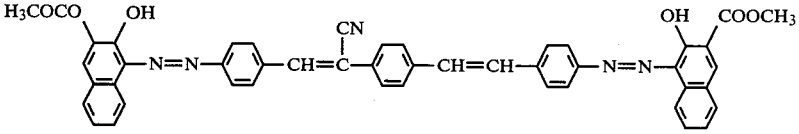
(I-232)
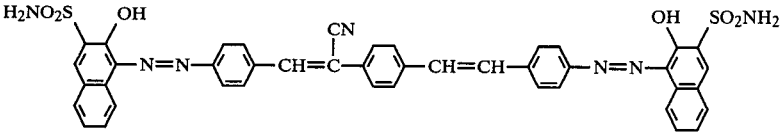
(I-233)

-continued
(I-234)
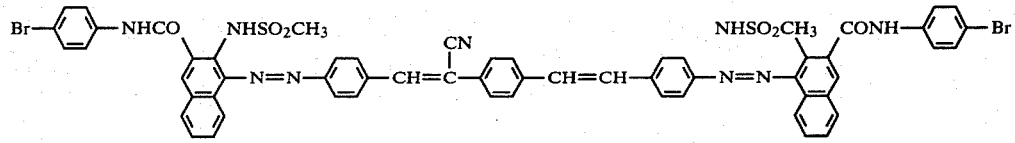
(I-235)
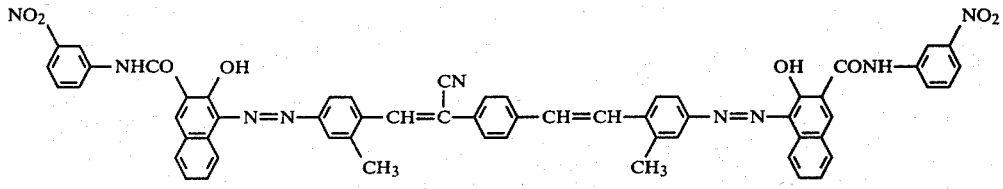
(I-236)
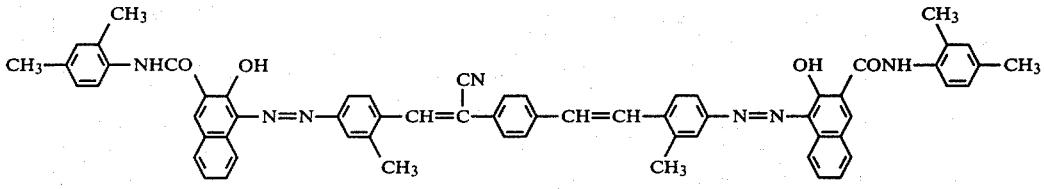
(I-237)
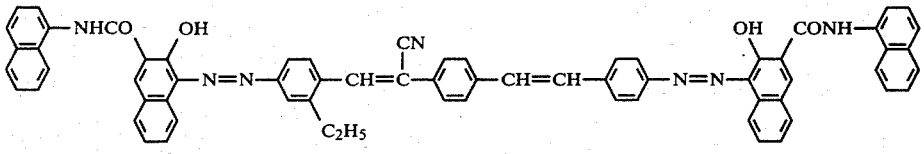
(I-238)
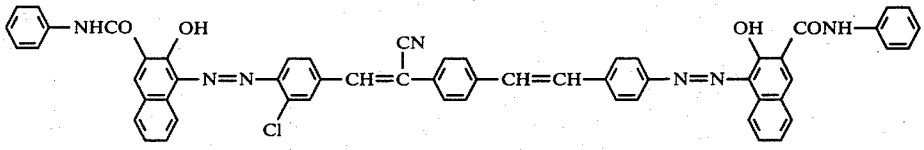
(I-239)
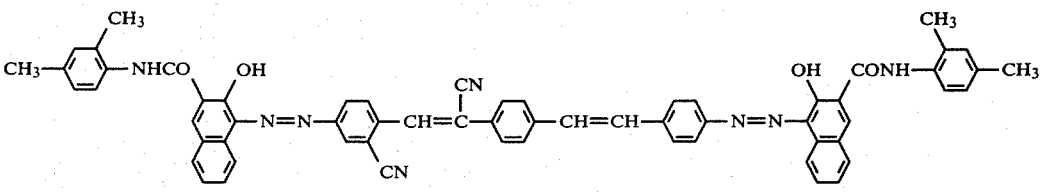
(I-240)
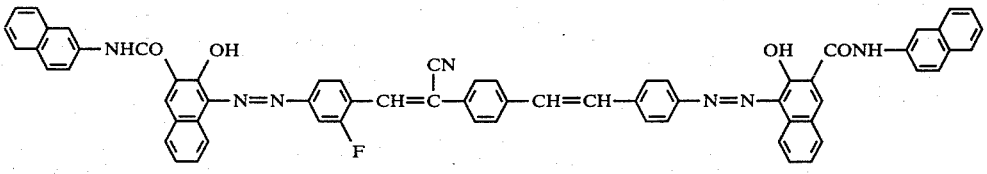
(I-241)
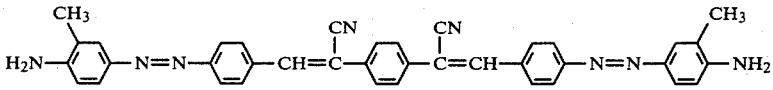
(I-242)
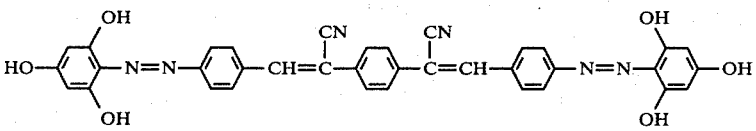
(I-243)
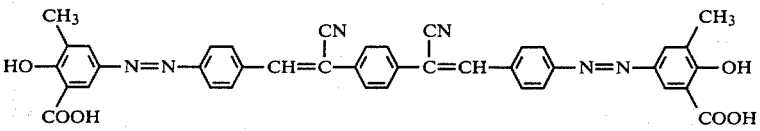

-continued
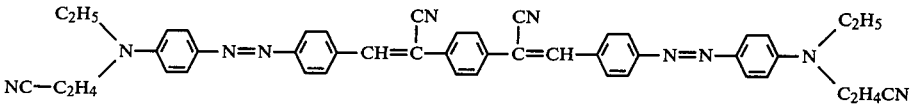
(I-244)
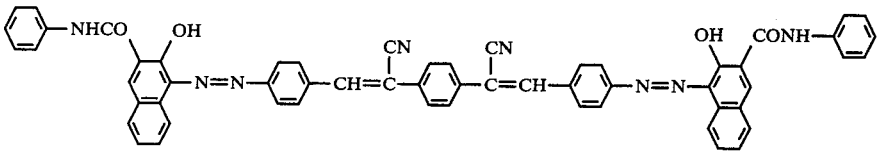
(I-245)
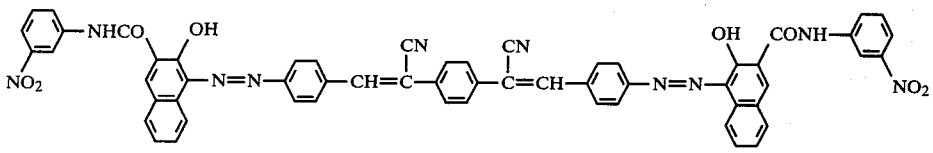
(I-246)
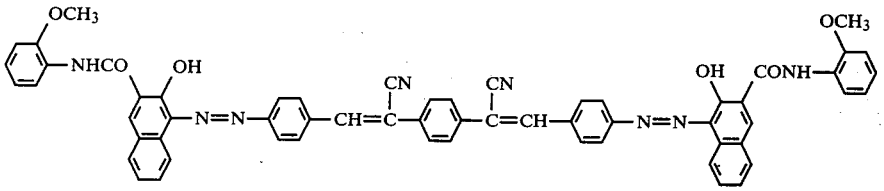
(I-247)
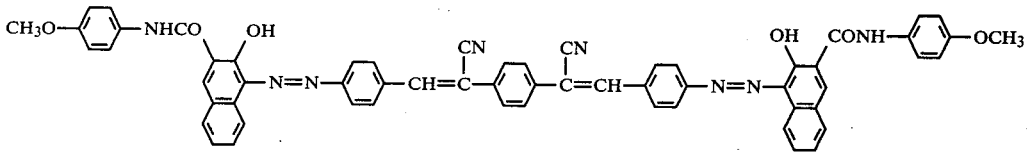
(I-248)
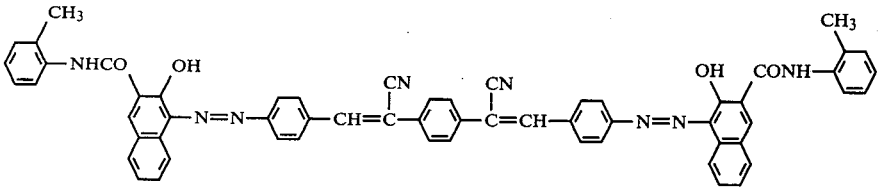
(I-249)
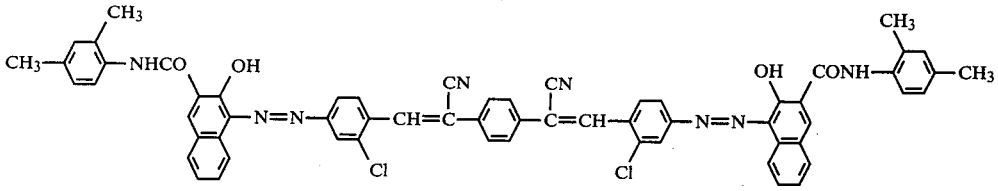
(I-250)
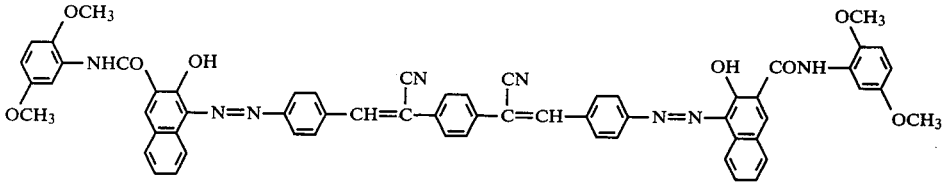
(I-251)
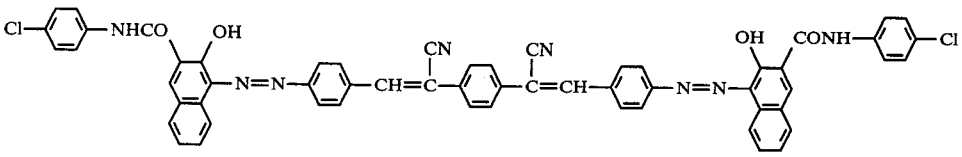
(I-252)

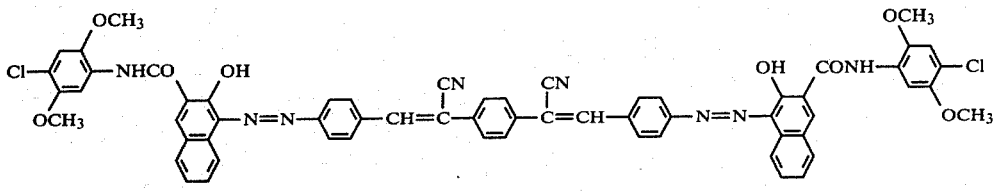
(I-253)
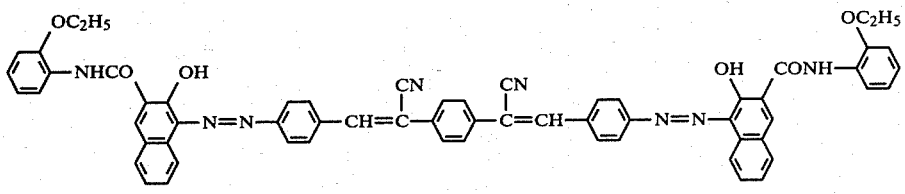
(I-254)
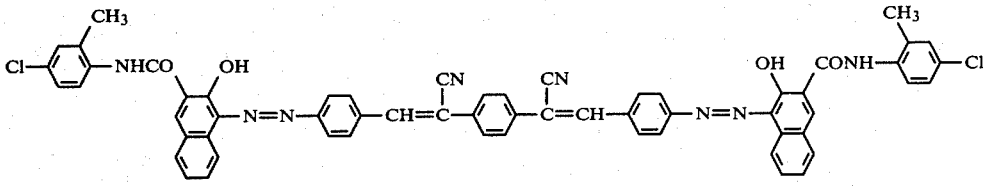
(I-255)
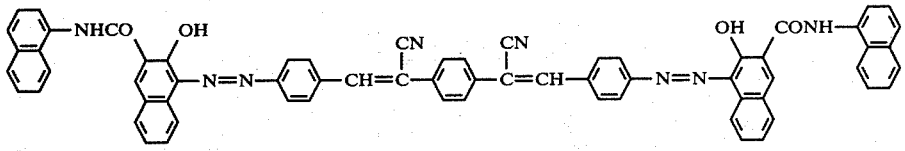
(I-256)
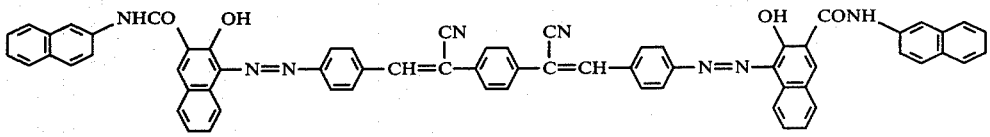
(I-257)
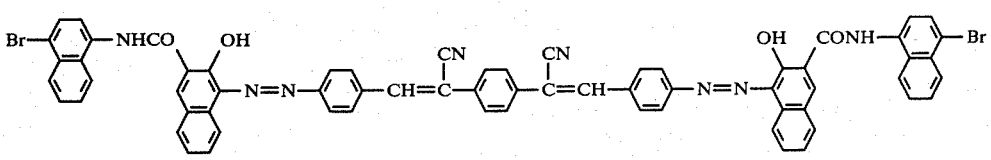
(I-258)
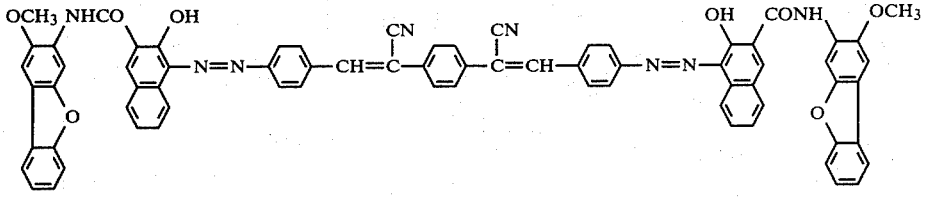
(I-259)
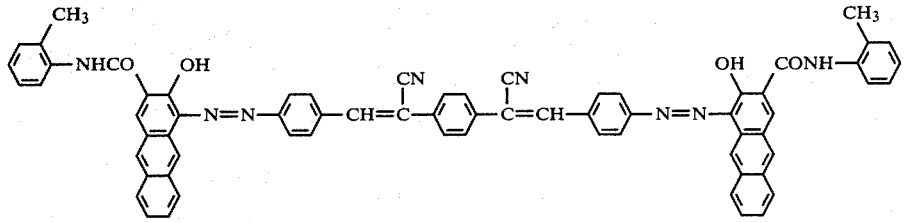
(I-260)

-continued
(I-261)
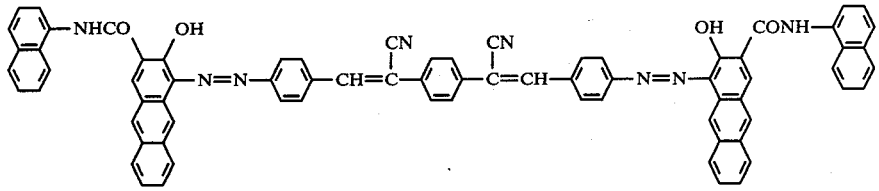
(I-262)
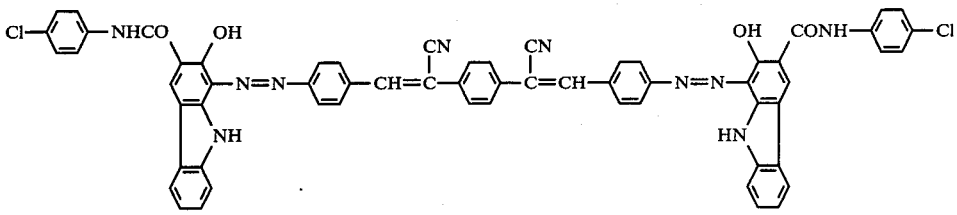
(I-263)
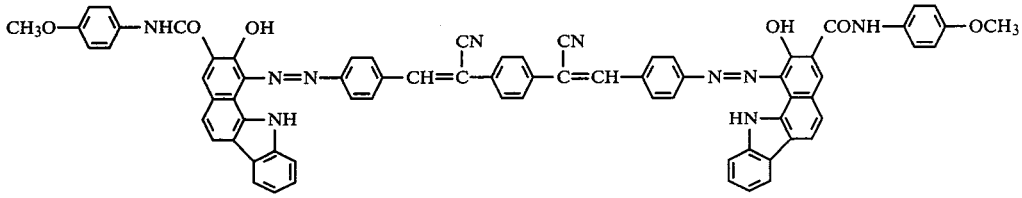
(I-264)
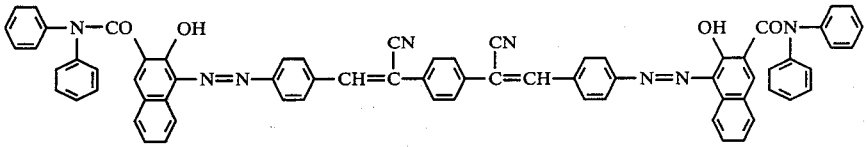
(I-265)
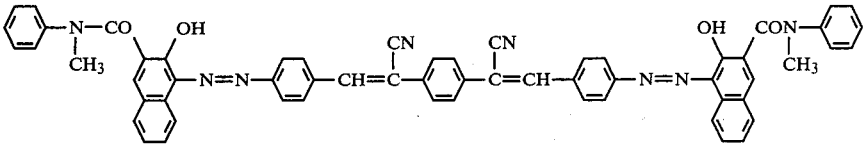
(I-266)
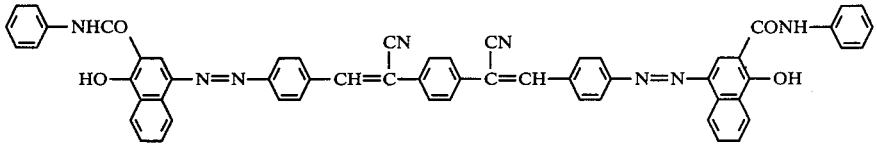
(I-267)
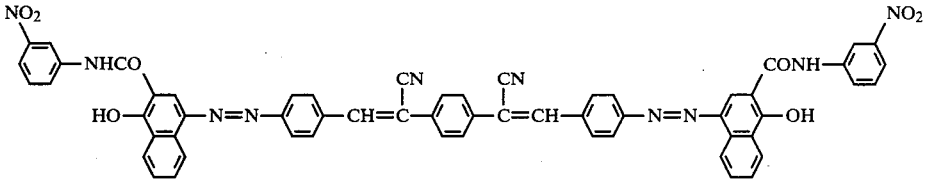
(I-268)
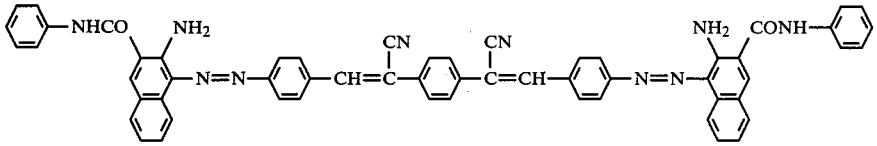

-continued
(I-269)
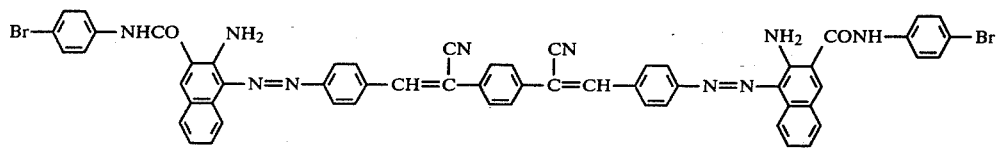
(I-270)
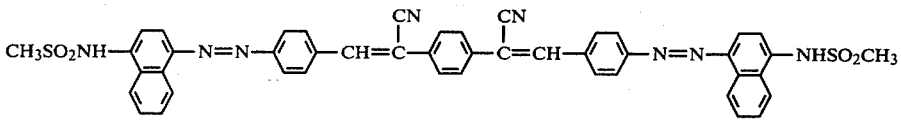
(I-271)
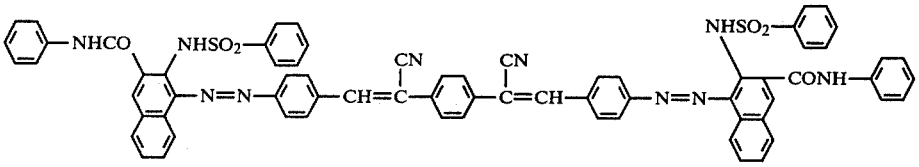
(I-272)
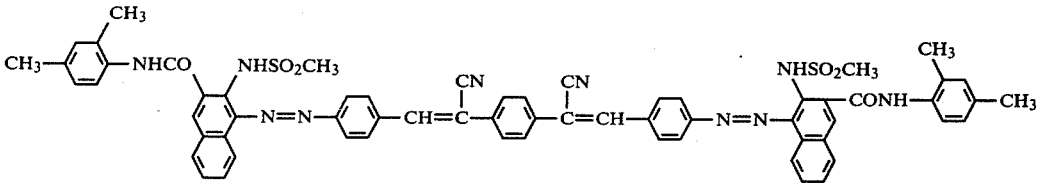
(I-273)
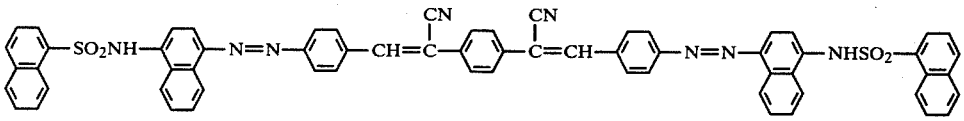
(I-274)
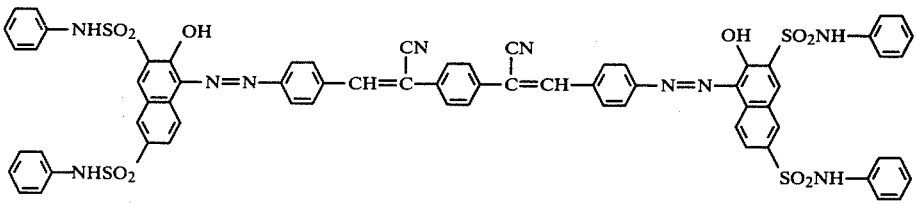
(I-275)
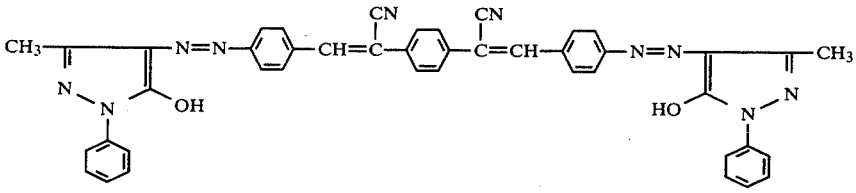
(I-276)
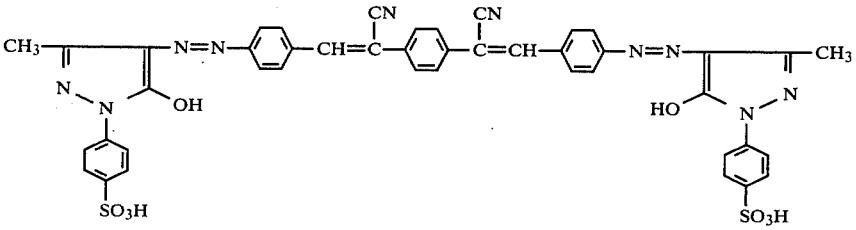

-continued
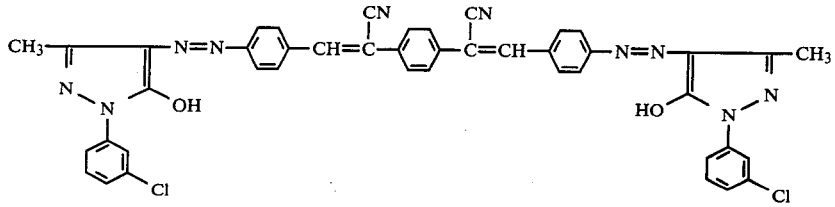
(I-277)
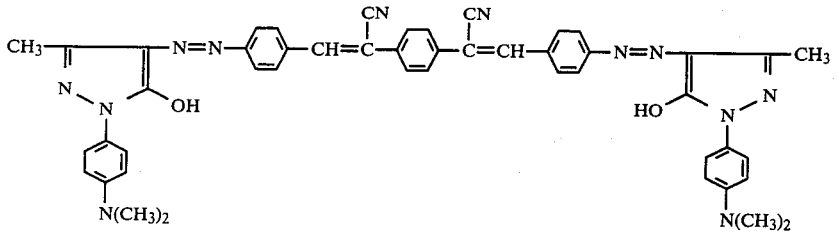
(I-278)
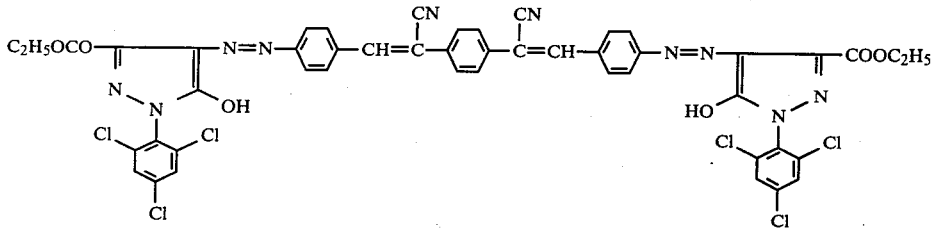
(I-279)
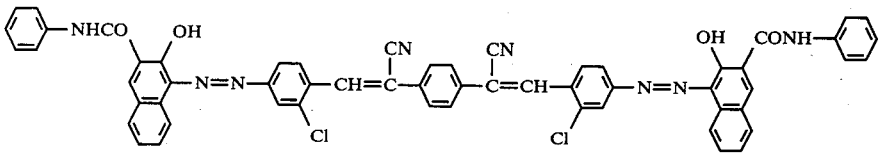
(I-280)
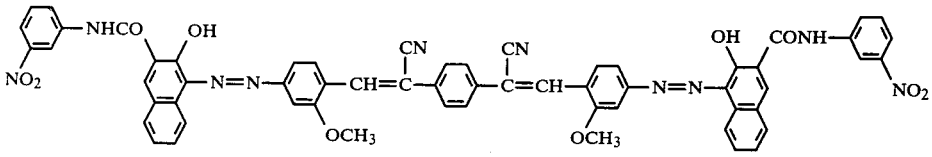
(I-281)
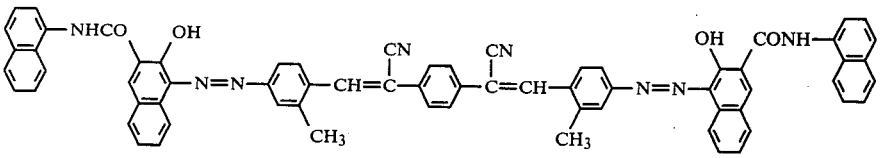
(I-282)
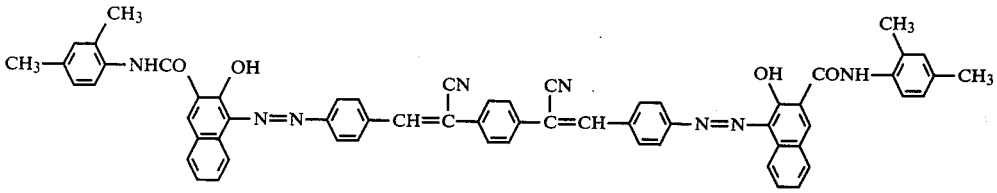
(I-283)
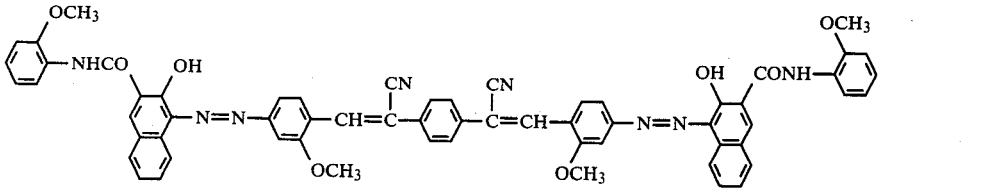
(I-284)

-continued
(I-285)
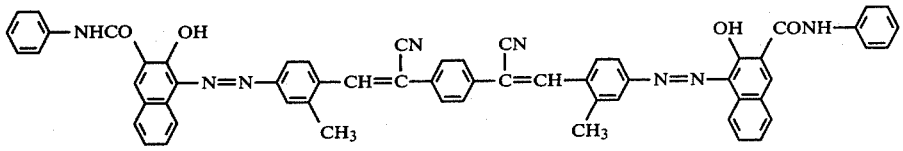
(I-286)
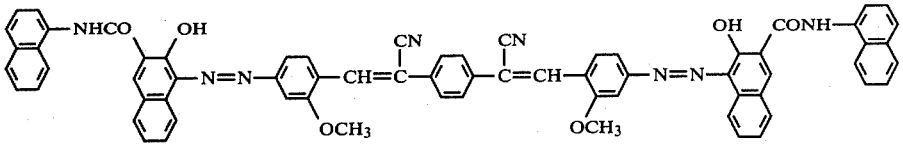
(I-287)
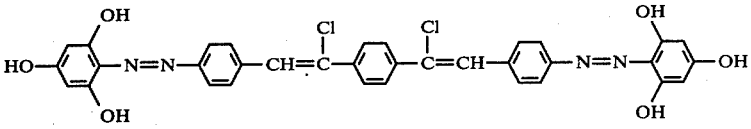
(I-288)
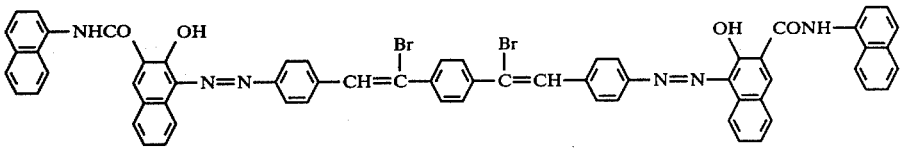
(I-289)
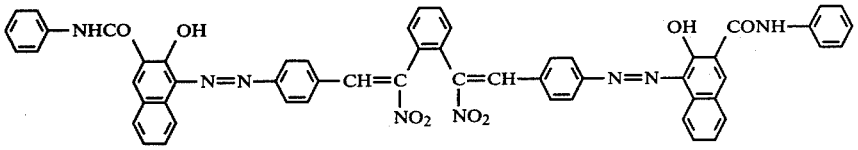
(I-290)
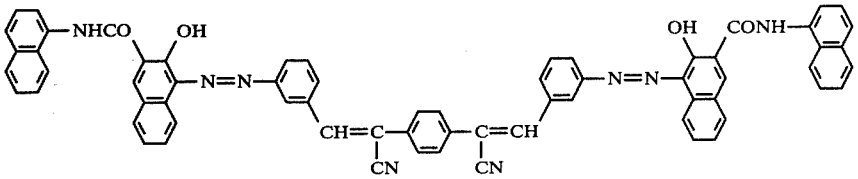
(I-291)
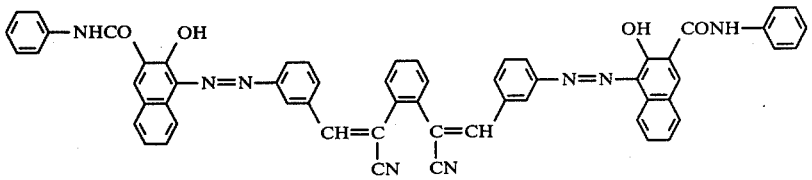
(I-292)
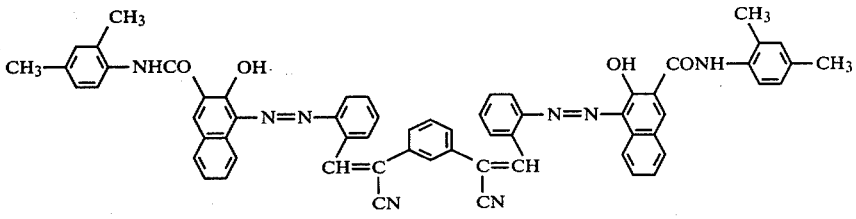
(I-293)
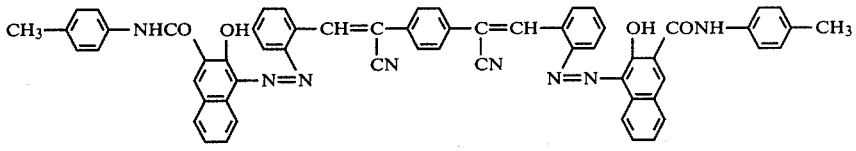

-continued
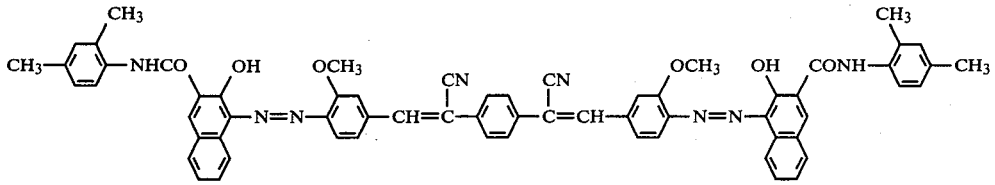
(I-294)
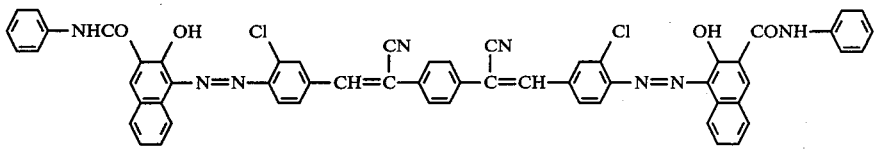
(I-295)
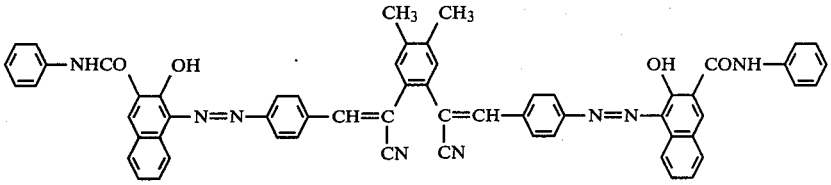
(I-296)
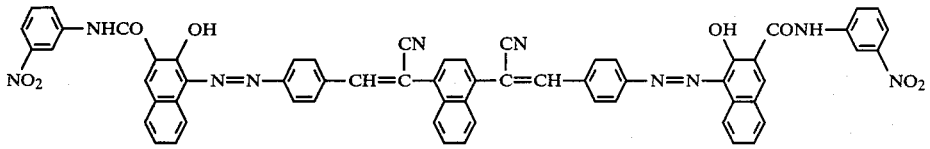
(I-297)
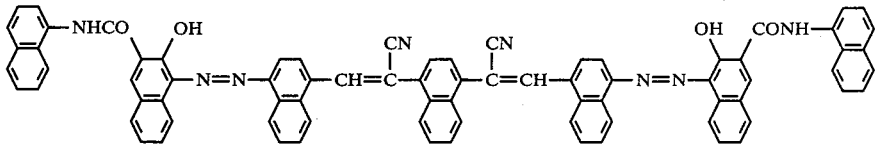
(I-298)
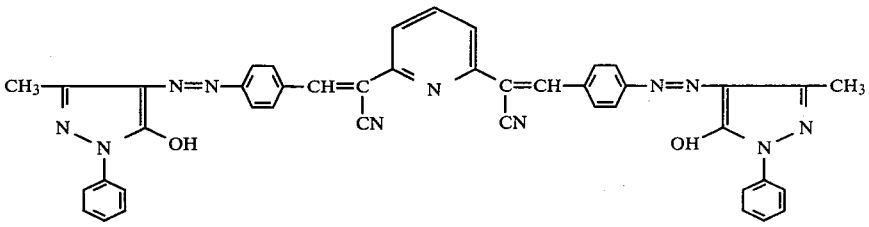
(I-299)
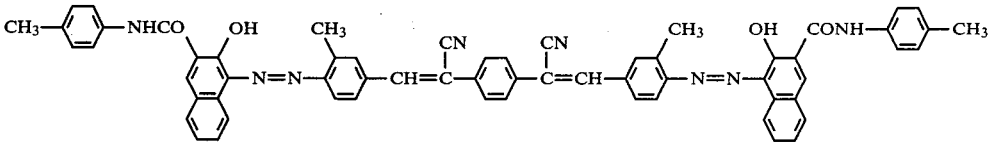
(I-300)
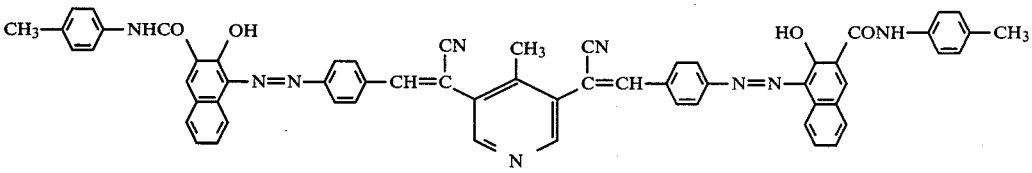
(I-301)
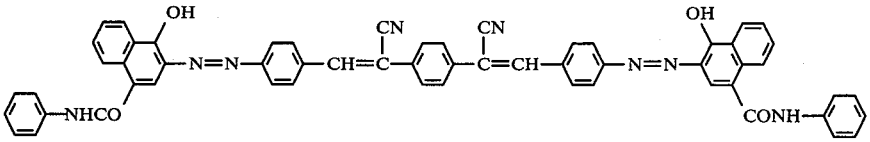
(I-302)

-continued
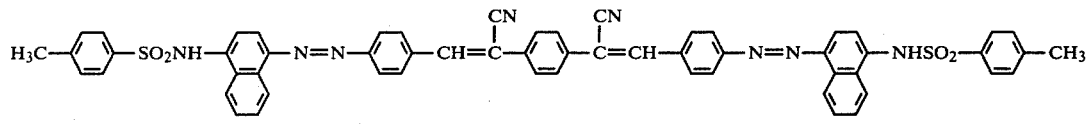
(I-303)
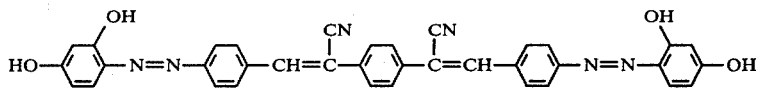
(I-304)
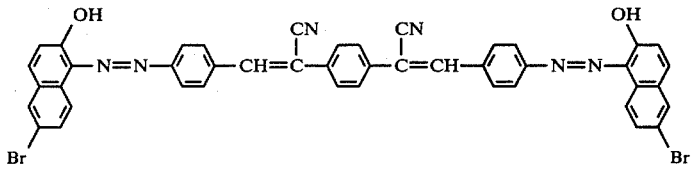
(I-305)
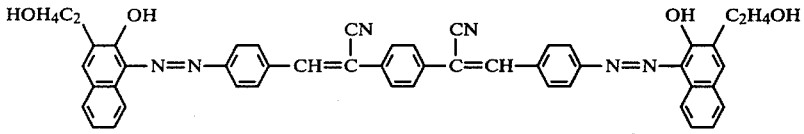
(I-306)
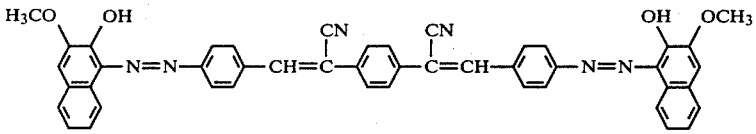
(I-307)
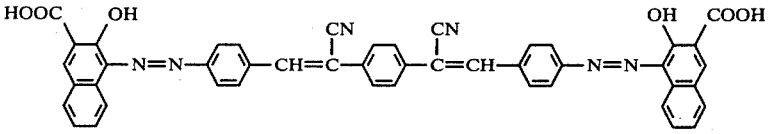
(I-308)
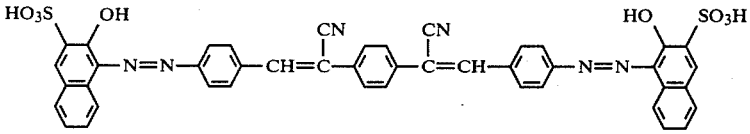
(I-309)
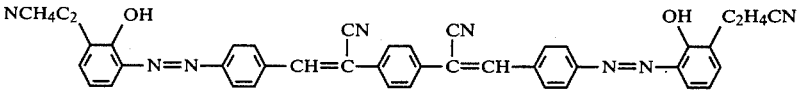
(I-310)
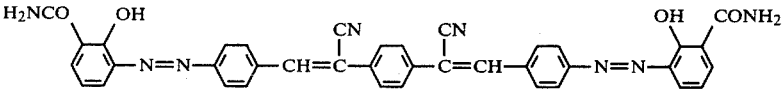
(I-311)
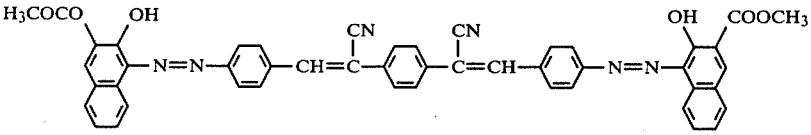
(I-312)
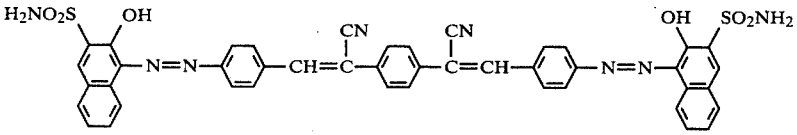
(I-313)

-continued

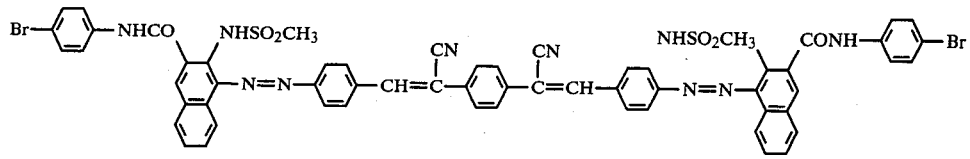
(I-314)

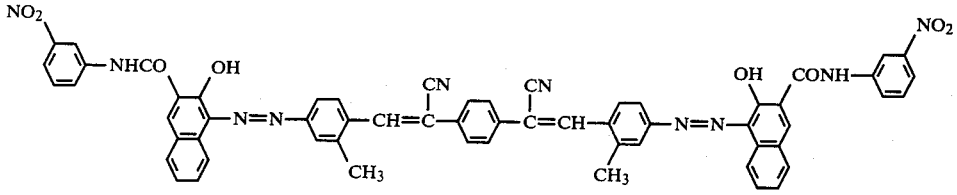
(I-315)

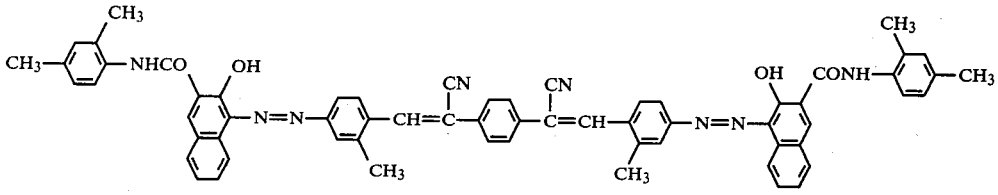
(I-316)

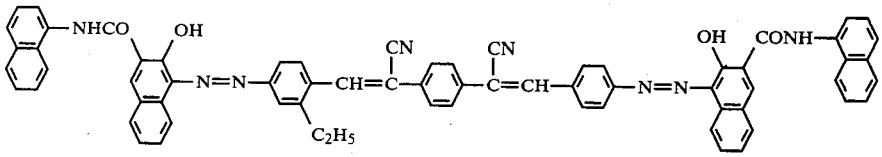
(I-317)

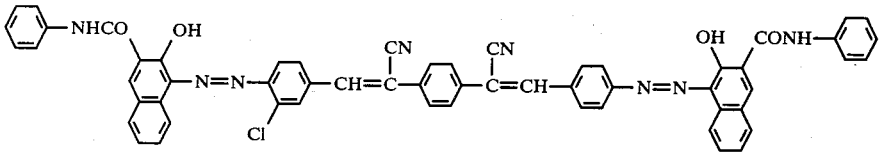
(I-318)

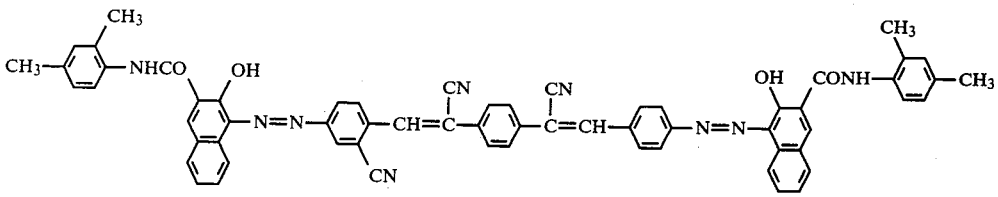
(I-319)

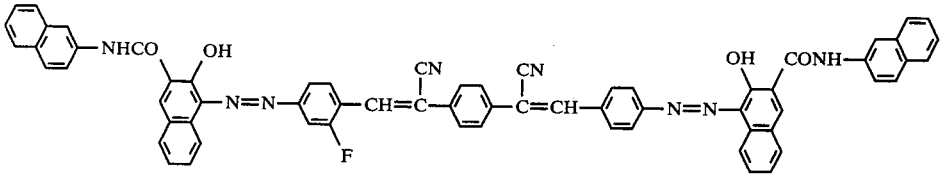
(I-320)

The above compounds can be synthesized according to the method described in Japanese Provisional Patent Publications No. 70232/1983, No. 140745/1983 and the like.

As specific examples of the styryl compounds represented by the above formula [II], those having, for example, the following formulae may be enumerated, but this invention is not limited thereto.

Exemplary compounds

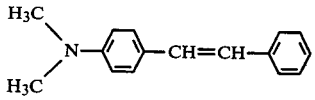
(II-1)

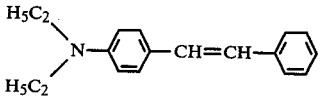
(II-2)

-continued
Exemplary compounds
(II-3)
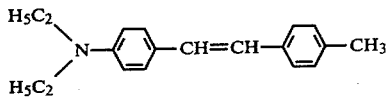
(II-4)
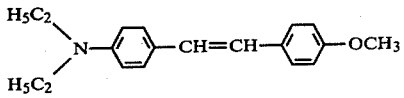
(II-5)
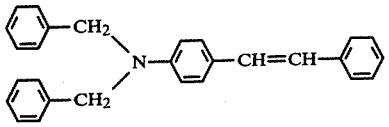
(II-6)
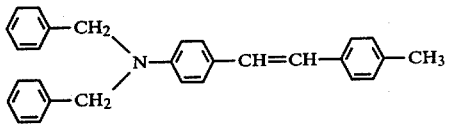
(II-7)
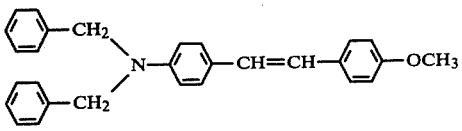
(II-8)
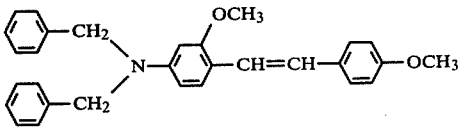
(II-9)
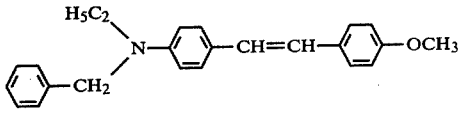
(II-10)
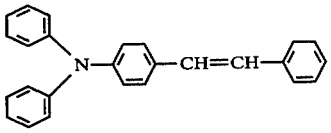
(II-11)
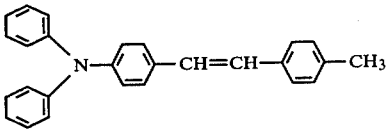
(II-12)
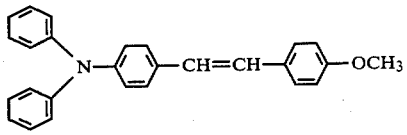
(II-13)
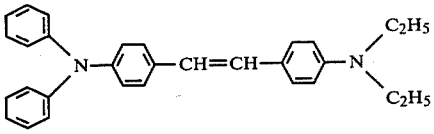
-continued
Exemplary compounds
(II-14)
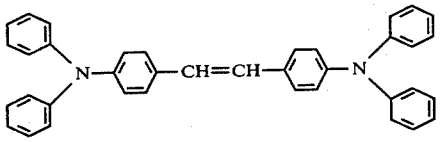
(II-15)
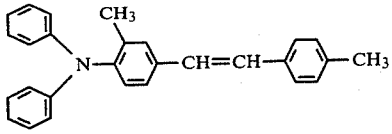
(II-16)
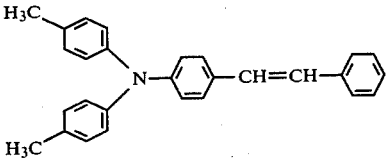
(II-17)
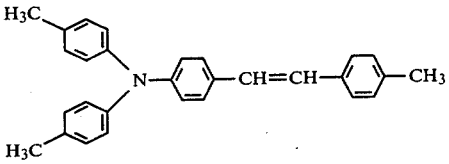
(II-18)
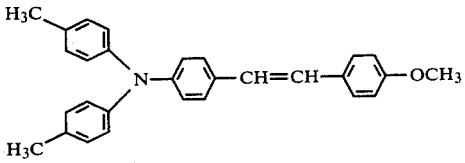
(II-19)
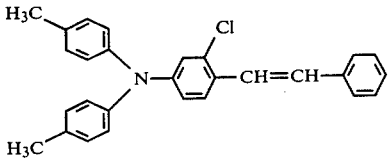
(II-20)
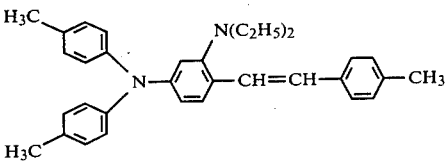
(II-21)
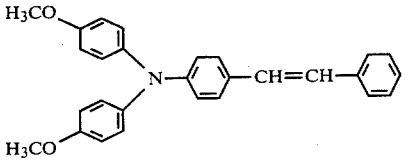
(II-22)
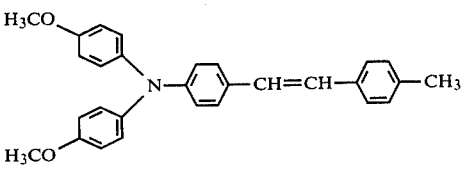

-continued

Exemplary compounds (II-23)

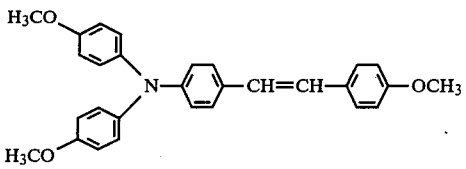

(II-24)

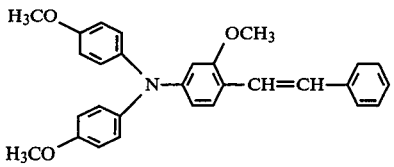

(II-25)

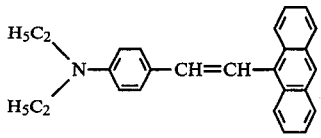

(II-26)

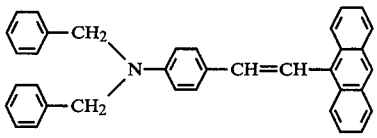

(II-27)

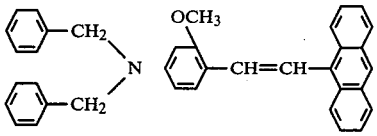

(II-28)

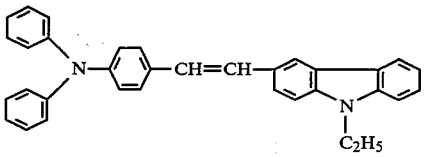

(II-29)

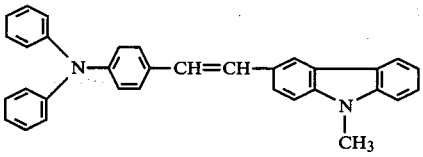

(II-30)

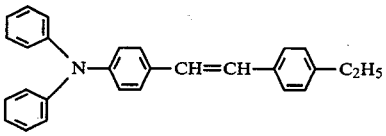

(II-31)

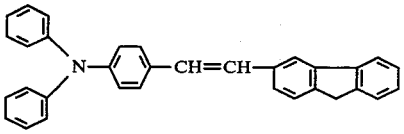

-continued

Exemplary compounds (II-32)

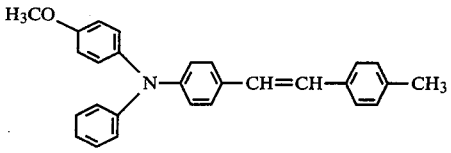

(II-33)

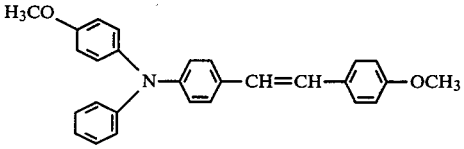

(II-34)

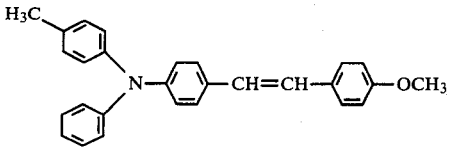

The above compounds can be synthesized according to the method described in Japanese Provisional Patent Publication No. 65440/1983 and the like.

As specific examples of the amine derivatives represented by the above formula [III], those having, for example, the following formulae may be enumerated, but this invention is not limited thereto.

Exemplary compounds (III-1)

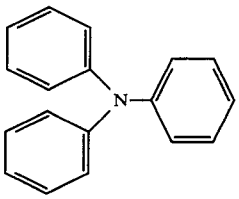

(III-2)

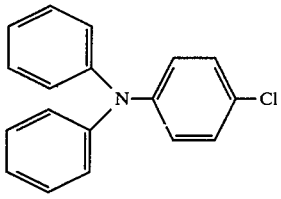

(III-3)

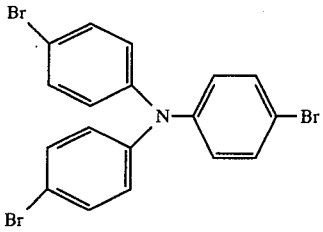

-continued
Exemplary compounds
(III-4)
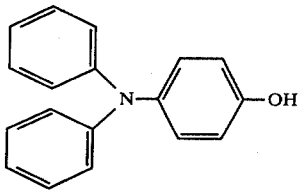
(III-5)
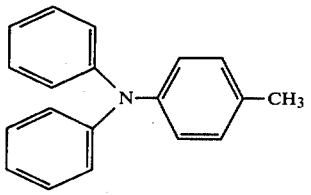
(III-6)
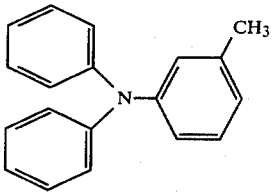
(III-7)
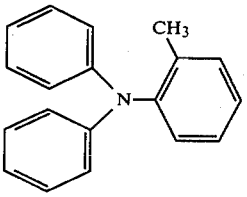
(III-8)
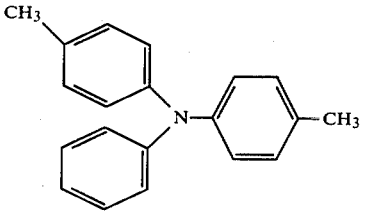
(III-9)
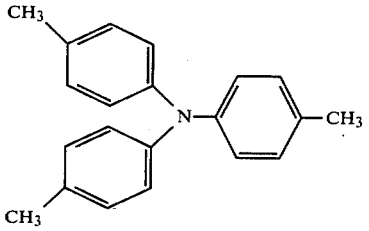
(III-10)
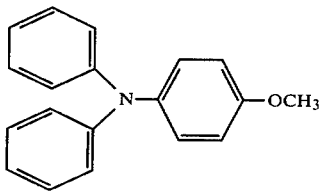
-continued
Exemplary compounds
(III-11)
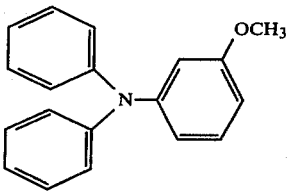
(III-12)
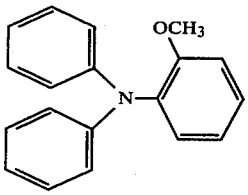
(III-13)
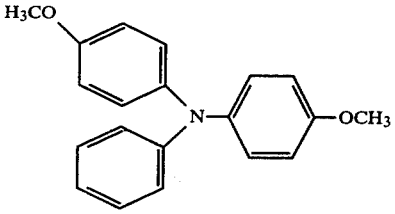
(III-14)
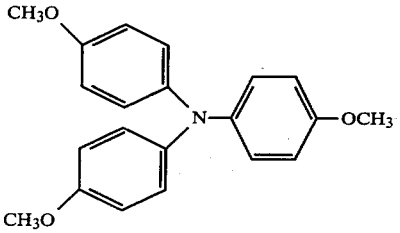
(III-15)
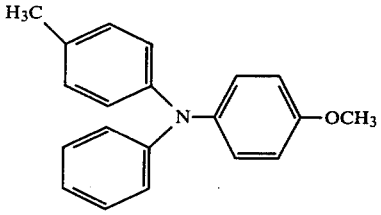
(III-16)
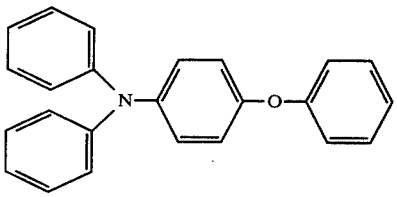
(III-17)
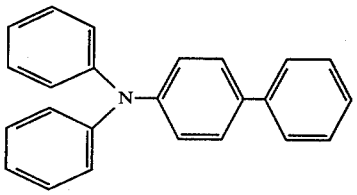

-continued
Exemplary compounds
(III-18)
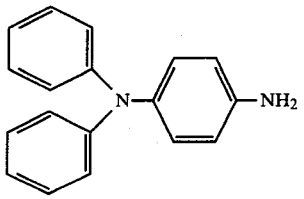
(III-19)
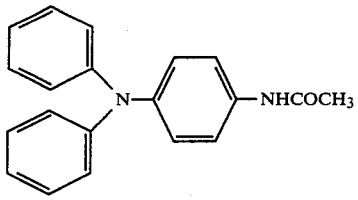
(III-20)
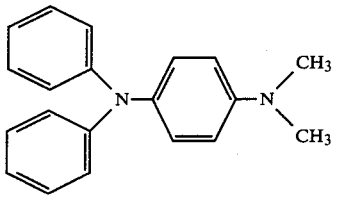
(III-21)
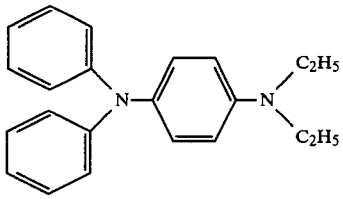
(III-22)
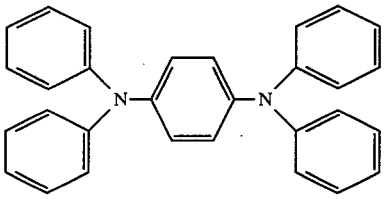
(III-23)
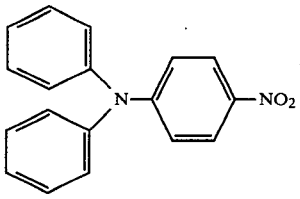
(III-24)
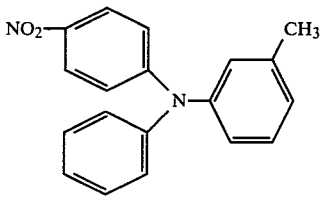
-continued
Exemplary compounds
(III-25)
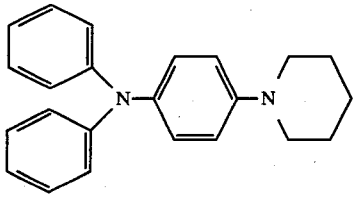
(III-26)
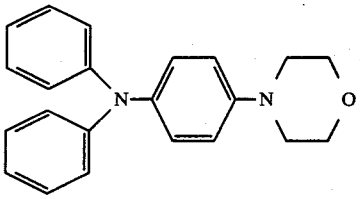
(III-27)
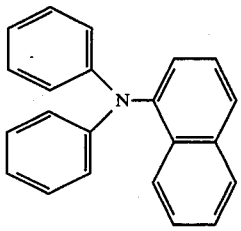
(III-28)
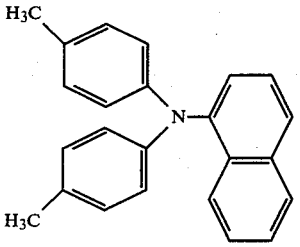
(III-29)
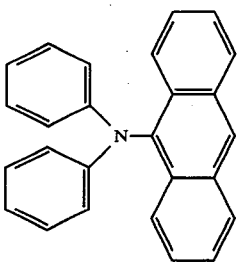
(III-30)
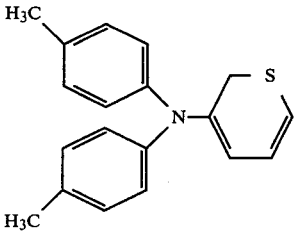

-continued

Exemplary compounds (III-31)

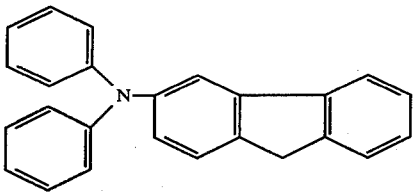

(III-32)

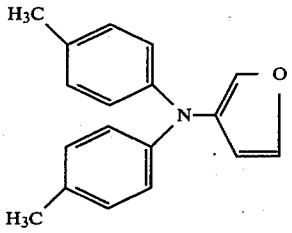

(III-33)

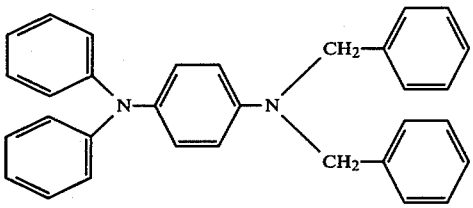

The above compounds can be synthesized according to the method described in Japanese Provisional Patent Publication No. 195254/1982 and the like.

As specific examples of the hydrazone compounds represented by the above formula [IV], those having, for example, the following formulae may be enumerated, but this invention is not limited thereto.

Exemplary compounds (IV-1)

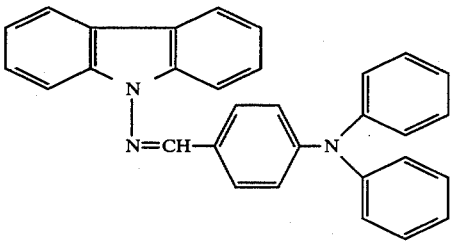

(IV-2)

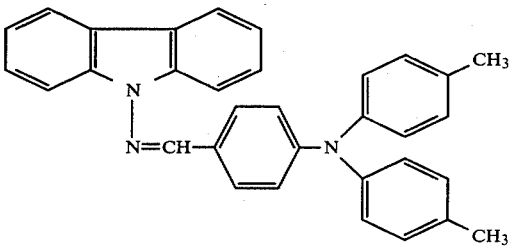

-continued

Exemplary compounds (IV-3)

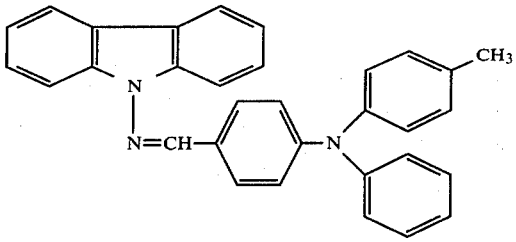

(IV-4)

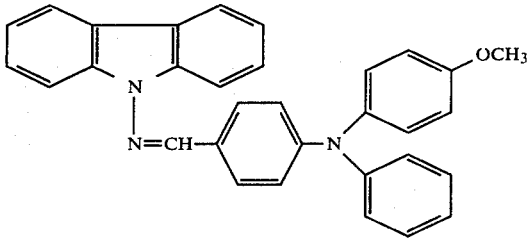

(IV-5)

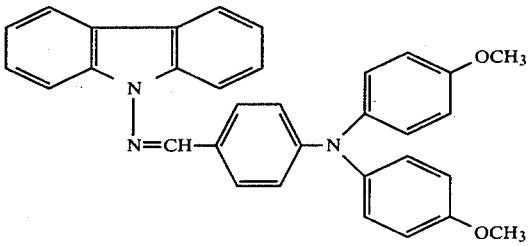

(IV-6)

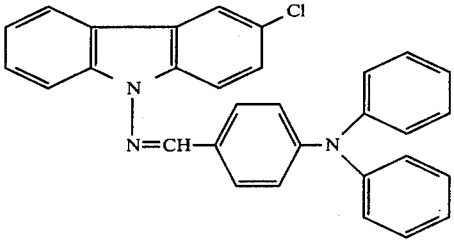

(IV-7)

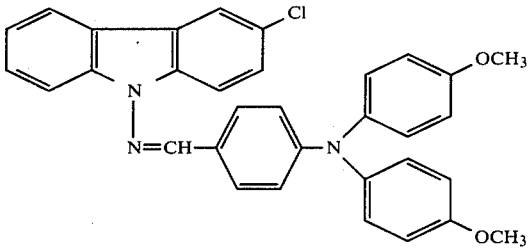

(IV-8)

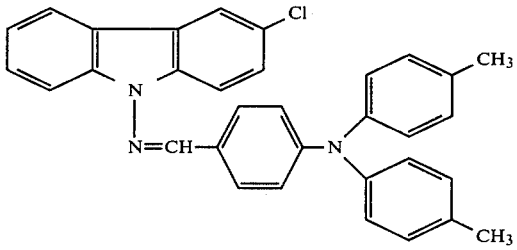

-continued

Exemplary compounds (IV-9)

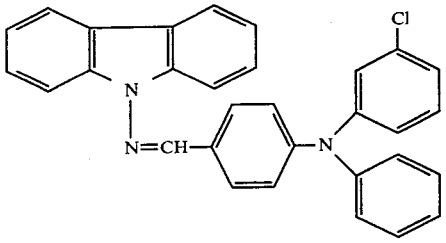

(IV-10)

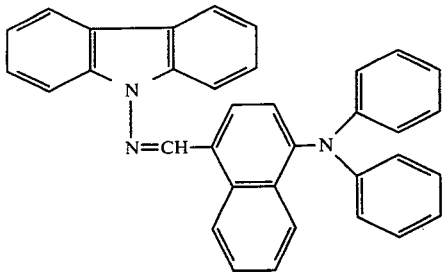

(IV-11)

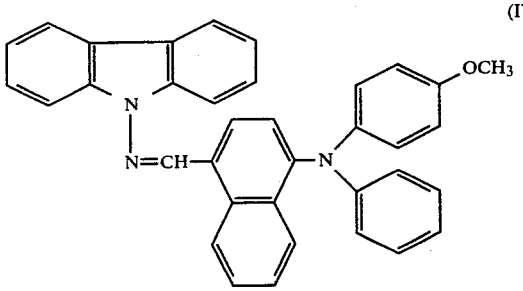

(IV-12)

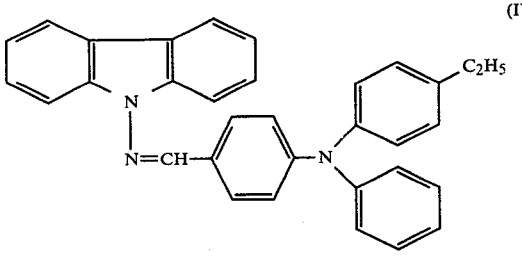

(IV-13)

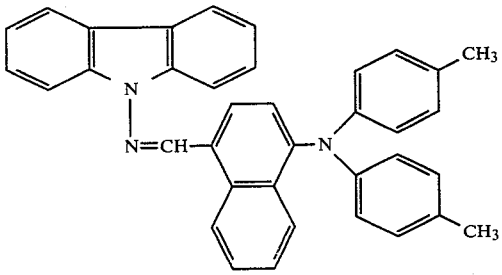

-continued

Exemplary compounds (IV-14)

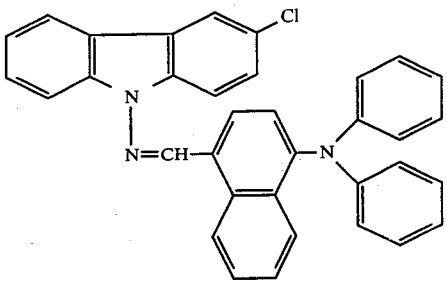

The above compounds can be synthesized according to the method described in Japanese Provisional Patent Publication No. 138644/1982 and the like.

As specific examples of the hydrazone compounds represented by the above formula [V], those having, for example, the following formulae may be enumerated, but this invention is not limited thereto.

Exemplary compounds (V-1)

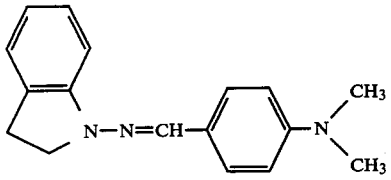

(V-2)

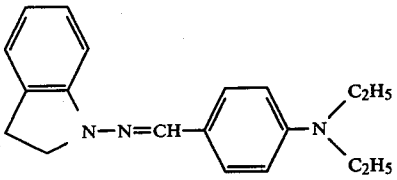

(V-3)

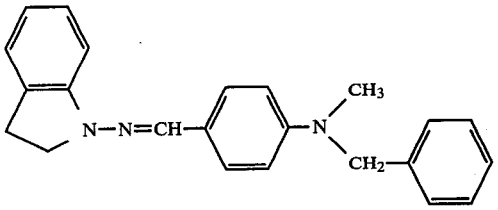

(V-4)

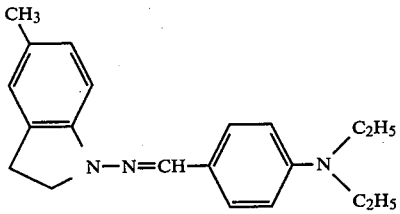

(V-5)

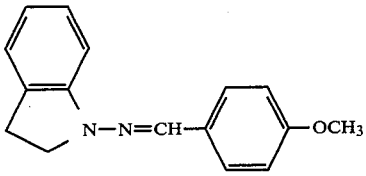

-continued
Exemplary compounds
(V-6)
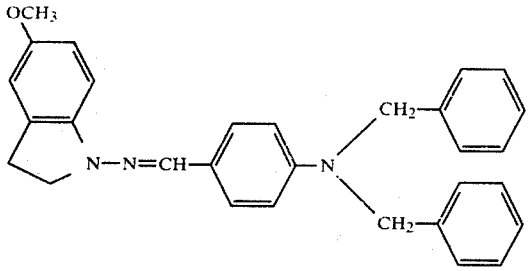
(V-7)
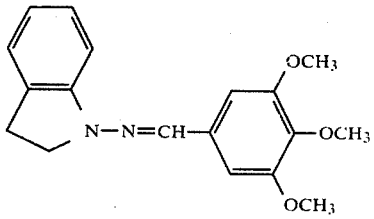
(V-8)
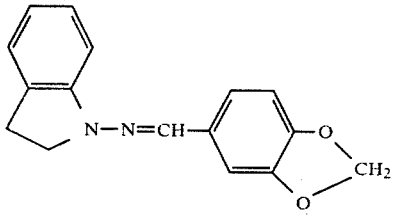
(V-9)
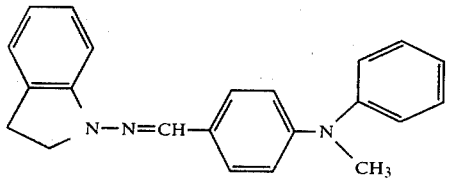
(V-10)
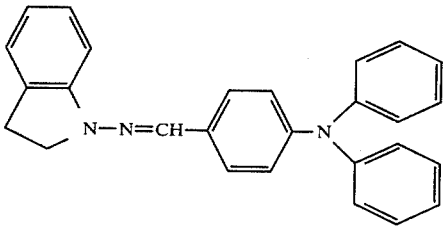
(V-11)
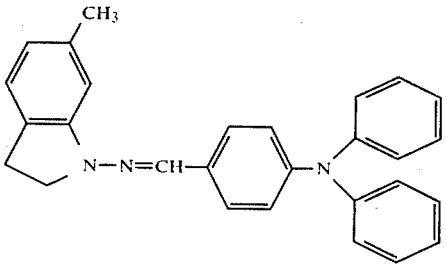
-continued
Exemplary compounds
(V-12)
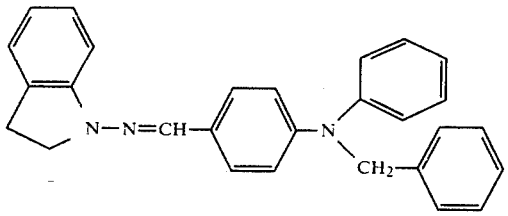
(V-13)
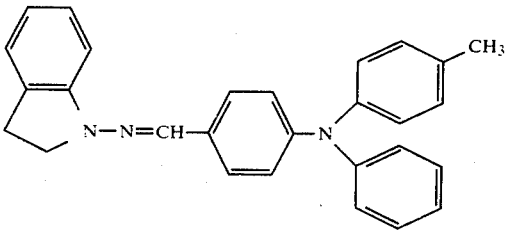
(V-14)
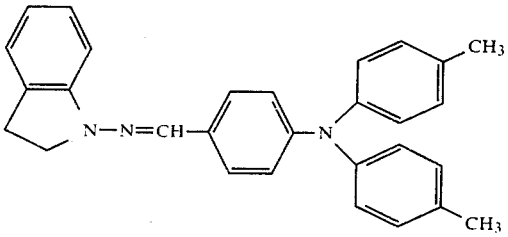
(V-15)
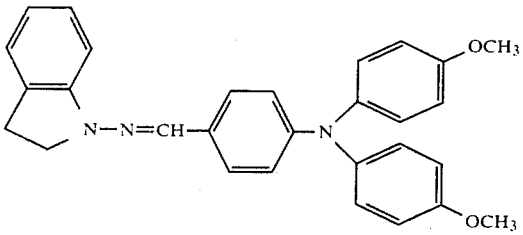
(V-16)
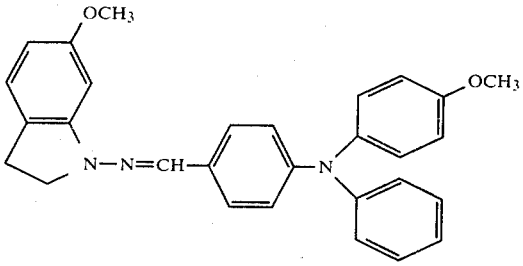
(V-17)
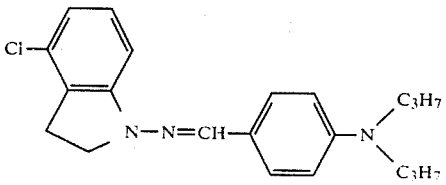

-continued
Exemplary compounds
(V-18)
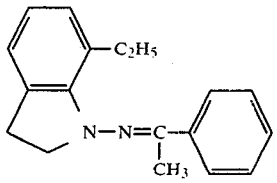
(V-19)
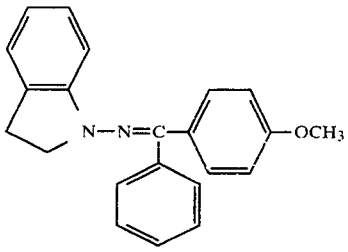
(V-20)
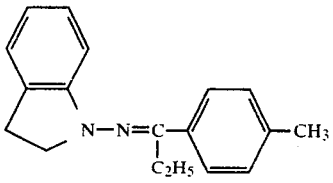
(V-21)
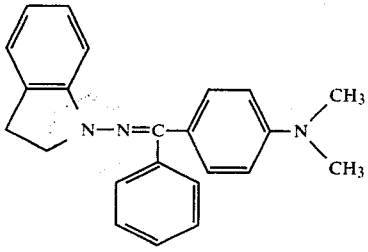
(V-22)
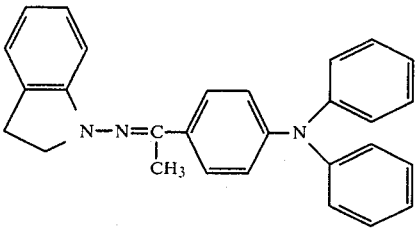
(V-23)
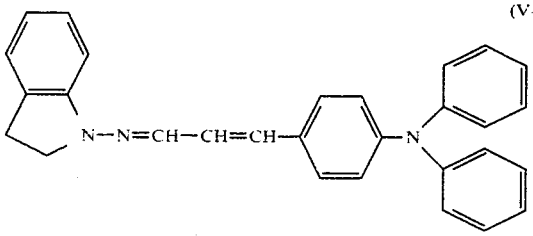
-continued
Exemplary compounds
(V-24)
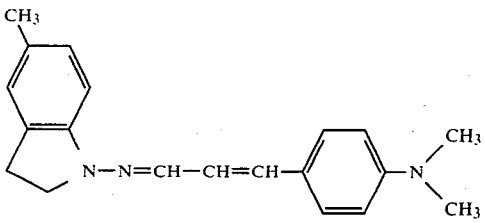
(V-25)
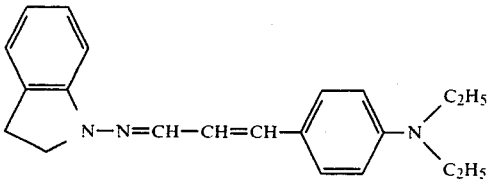
(V-26)
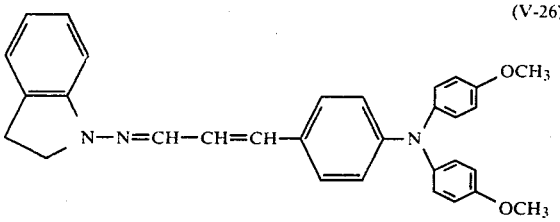
(V-27)
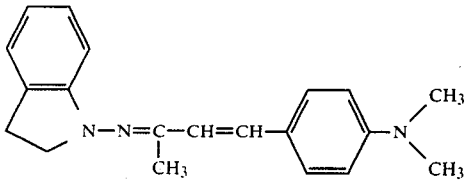
(V-28)
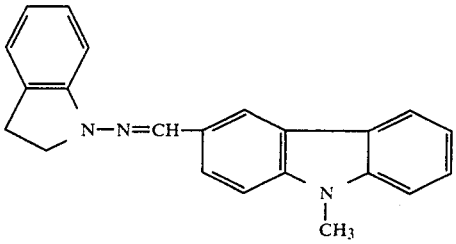
(V-29)
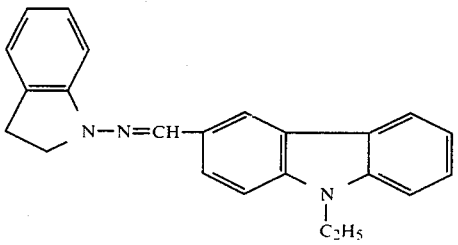

-continued
Exemplary compounds
(V-30)
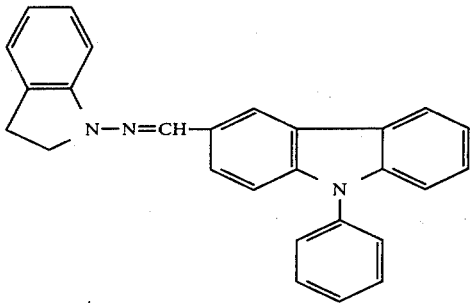
(V-31)
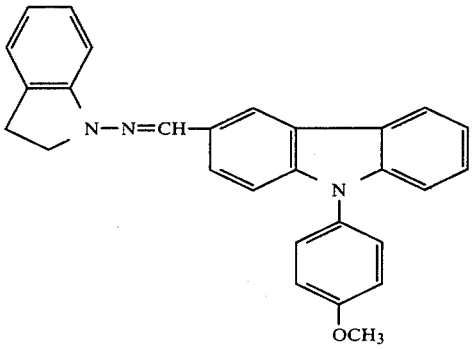
(V-32)
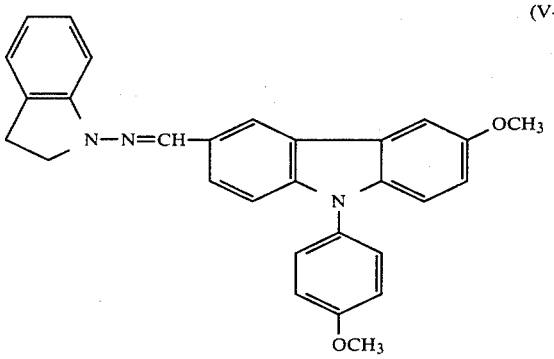
(V-33)
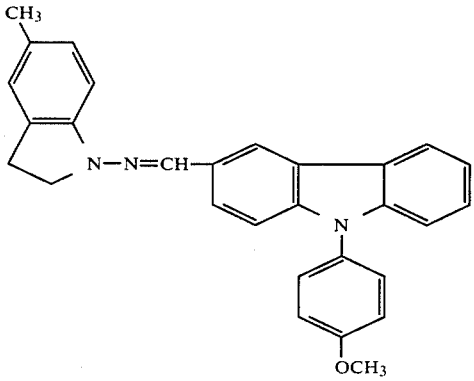
-continued
Exemplary compounds
(V-34)
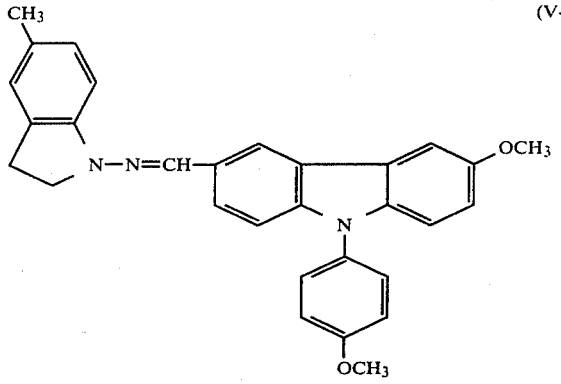
(V-35)
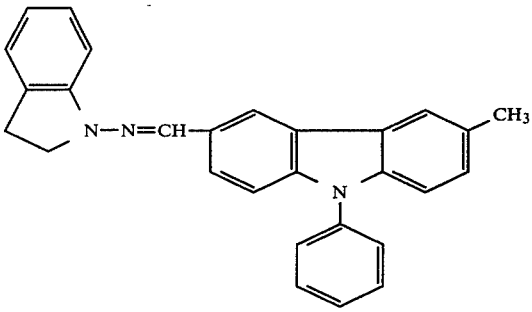
(V-36)
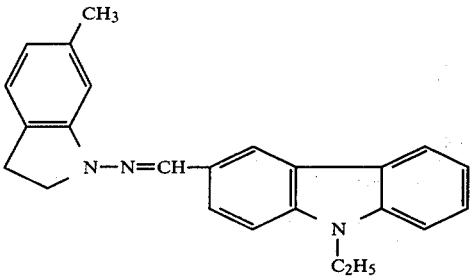
(V-37)
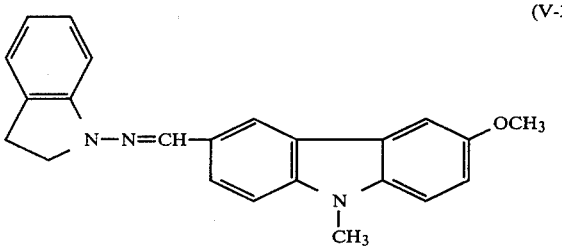
(V-38)
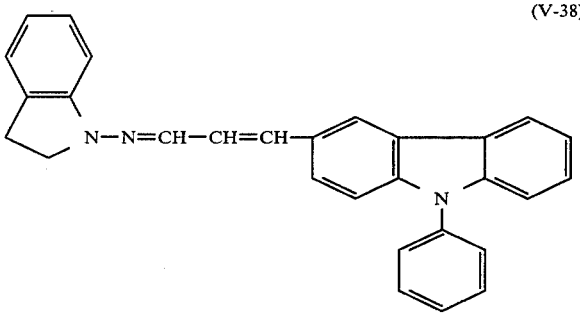

-continued

Exemplary compounds (V-39)

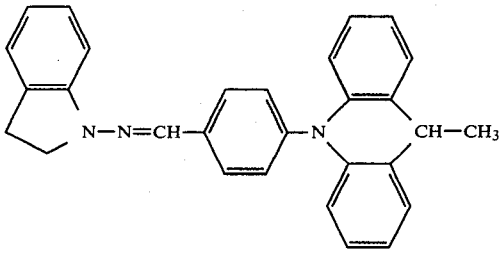

(V-40)

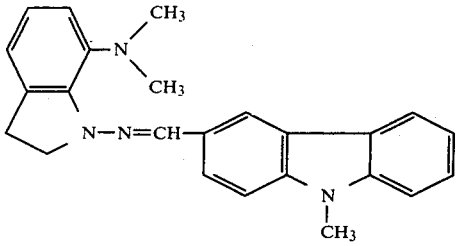

(V-41)

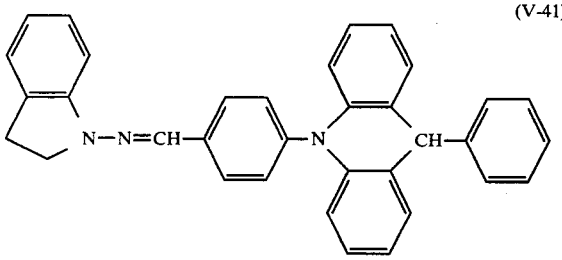

(V-42)

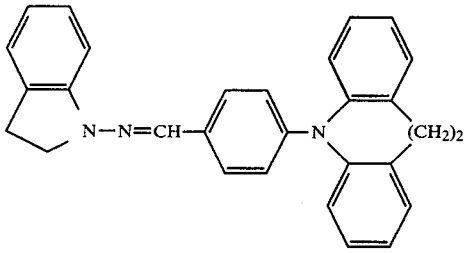

(V-43)

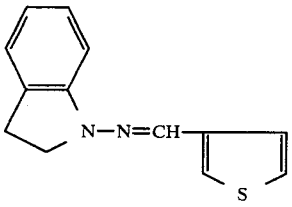

(V-44)

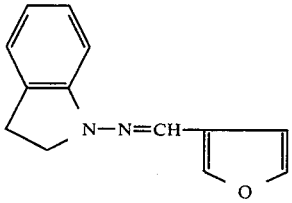

-continued

Exemplary compounds (V-45)

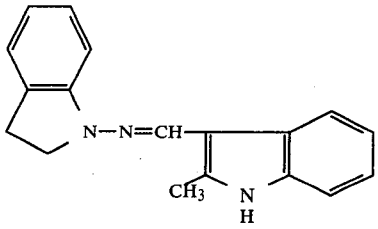

(V-46)

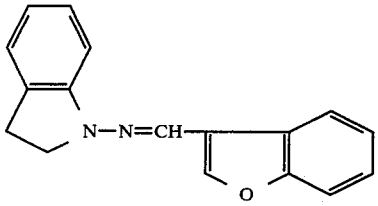

The above compounds can be synthesized according to the method described in Japanese Provisional Patent Publication No. 166354/1983 and the like.

As specific examples of the hydrazone compounds represented by the above formula [VI], those having, for example, the following formulae may be enumerated, but this invention is not limited thereto.

Exemplary compounds (VI-1)

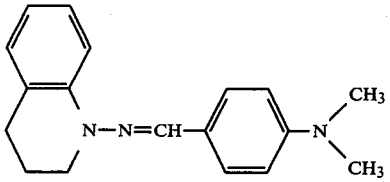

(VI-2)

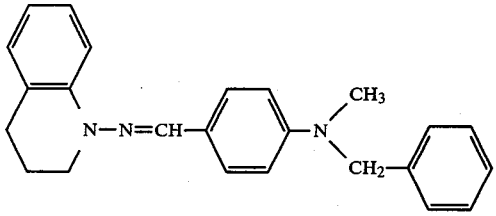

(VI-3)

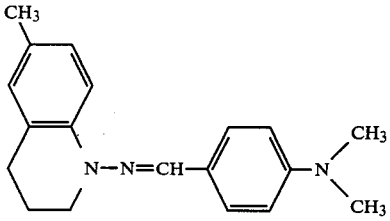

(VI-4)

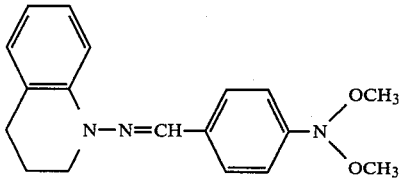

-continued
Exemplary compounds
(VI-5)
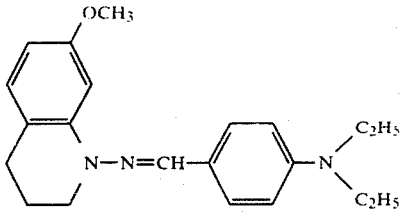
(VI-6)
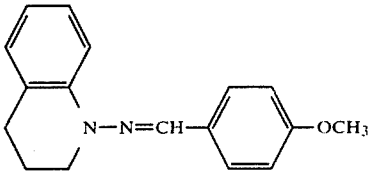
(VI-7)
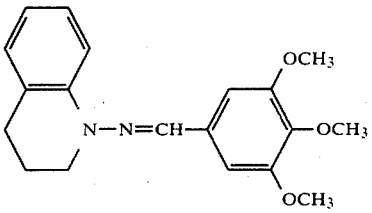
(VI-8)
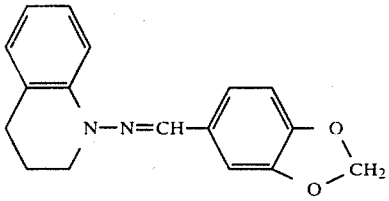
(VI-9)
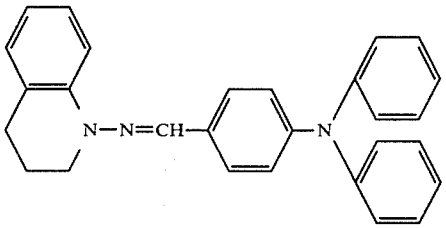
(VI-10)
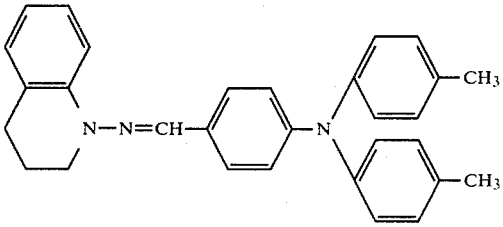
(VI-11)
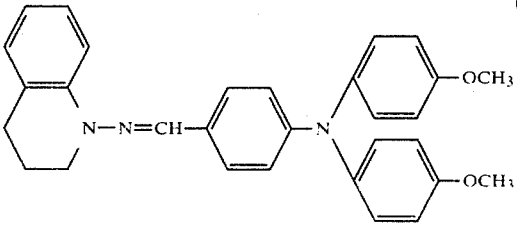
-continued
Exemplary compounds
(VI-12)
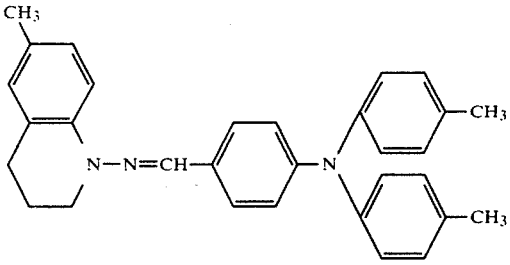
(VI-13)
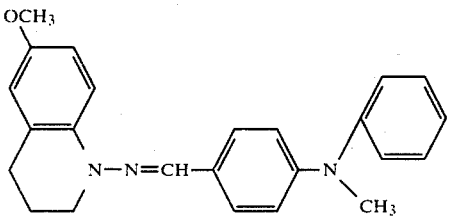
(VI-14)
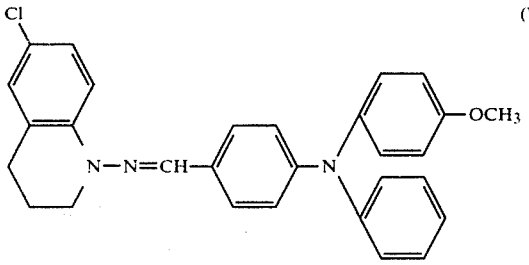
(VI-15)
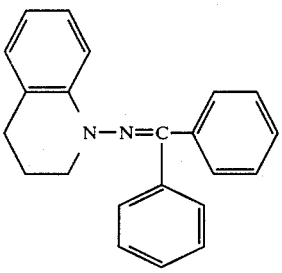
(VI-16)
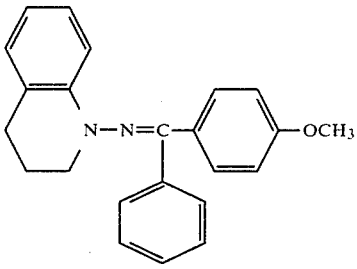
(VI-17)
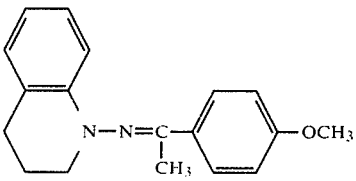

-continued
Exemplary compounds
(VI-18)
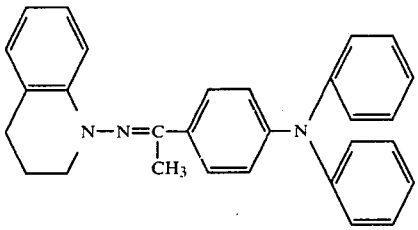
(VI-19)
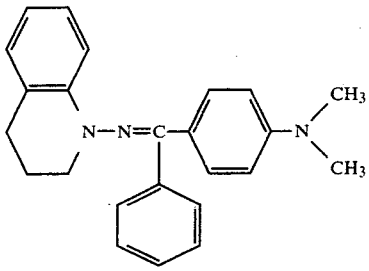
(VI-20)
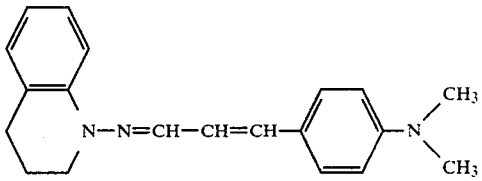
(VI-21)
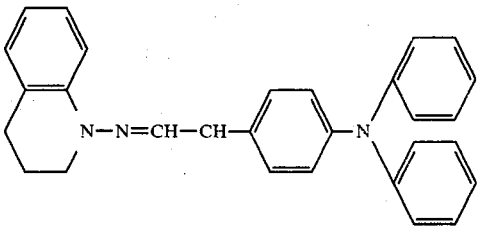
(VI-22)
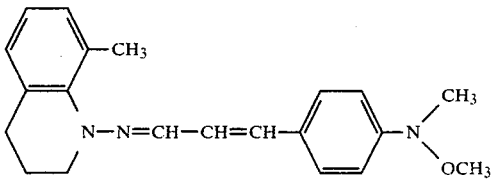
(VI-23)
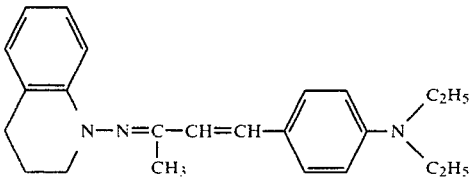
-continued
Exemplary compounds
(VI-24)
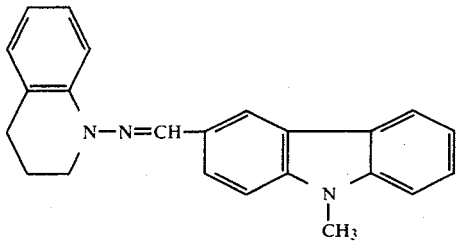
(VI-25)
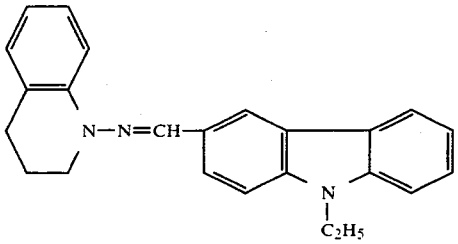
(VI-26)
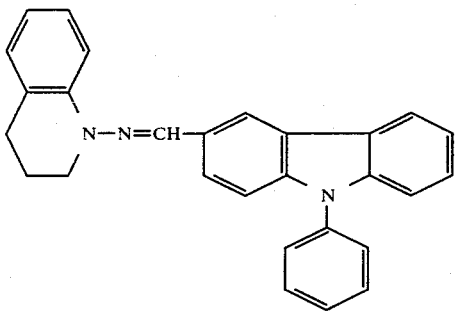
(VI-27)
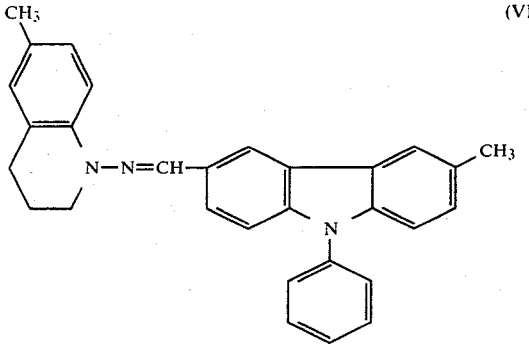
(VI-28)
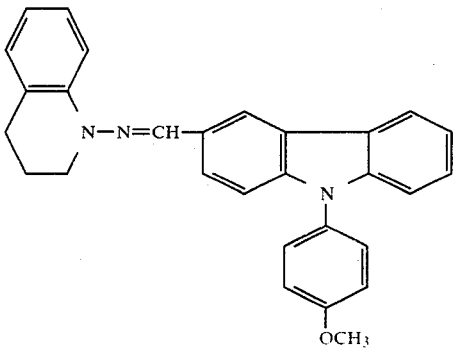

-continued
Exemplary compounds
(VI-29)
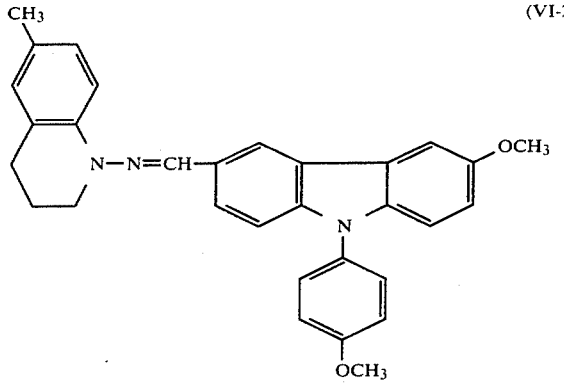
(VI-30)
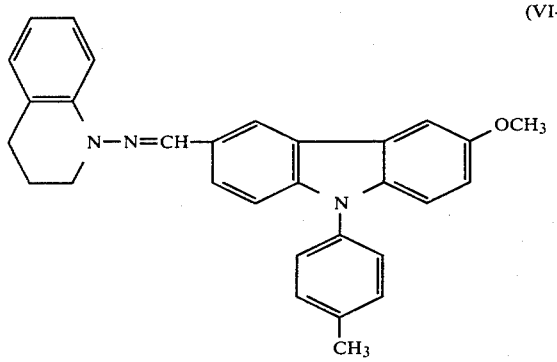
(VI-31)
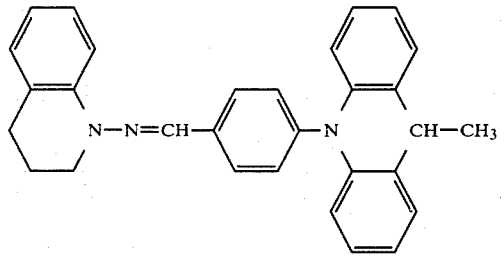
(VI-32)
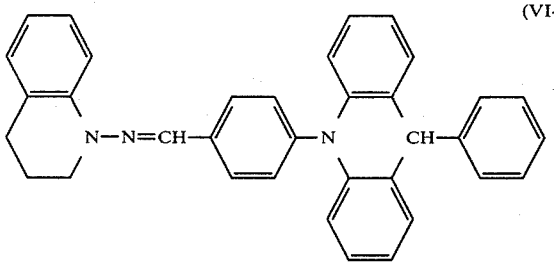
(VI-33)
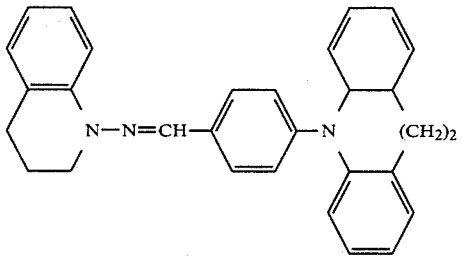
-continued
Exemplary compounds
(VI-34)
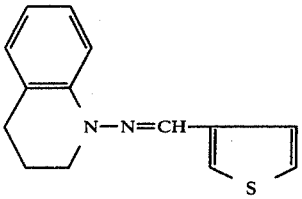
(VI-35)
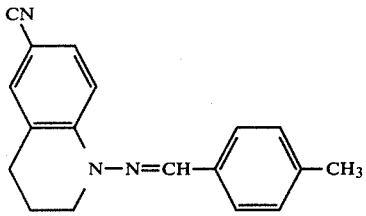
(VI-36)
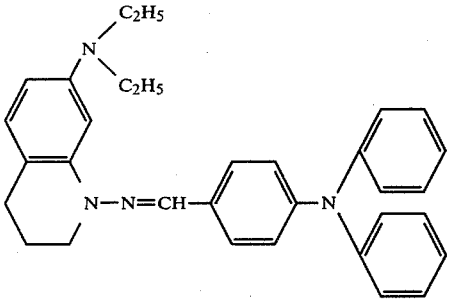
(VI-37)
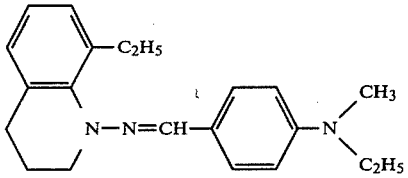
(VI-38)
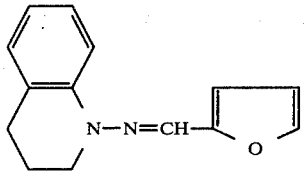
(VI-39)
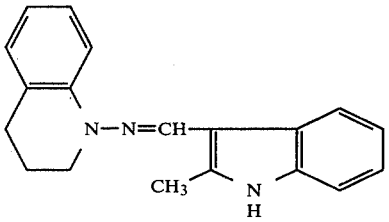
(VI-40)
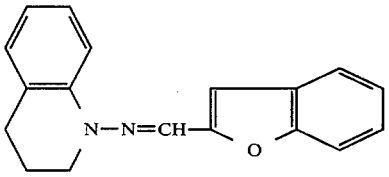

-continued

Exemplary compounds (VI-41)

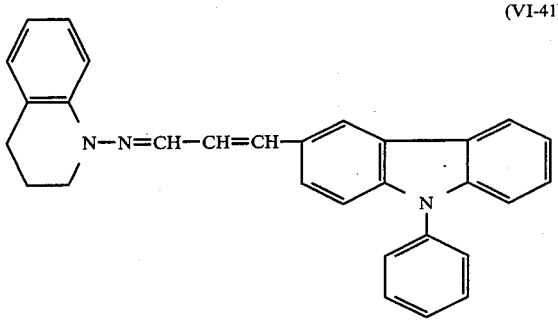

(VI-42)

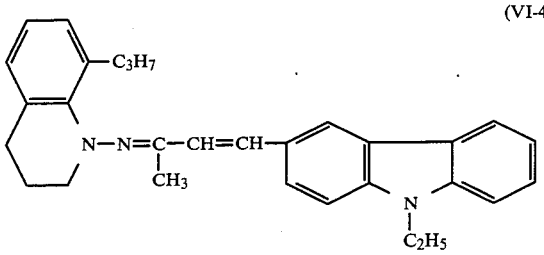

The above compounds can be synthesized according to the method described in Japanese Provisional Patent Publication No. 134642/1983 and the like.

As specific examples of the carbazole derivatives represented by the above formula [VII], those having, for example, the following formulae may be enumerated, but this invention is not limited thereto.

Exemplary compounds (VII-1)

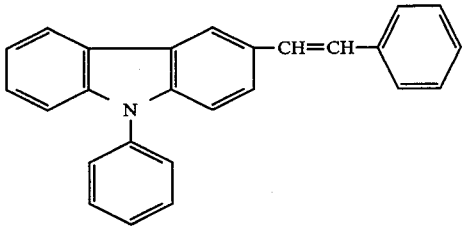

(VII-2)

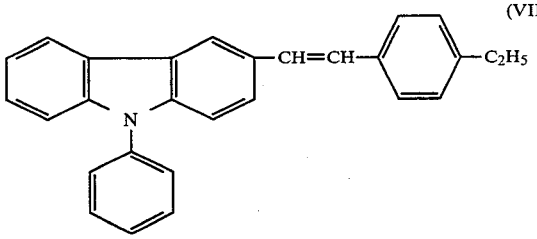

(VII-3)

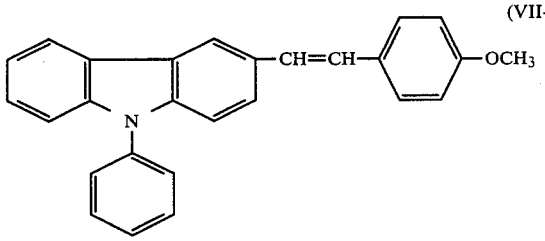

-continued

Exemplary compounds (VII-4)

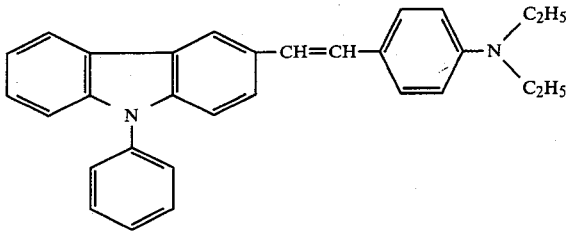

(VII-5)

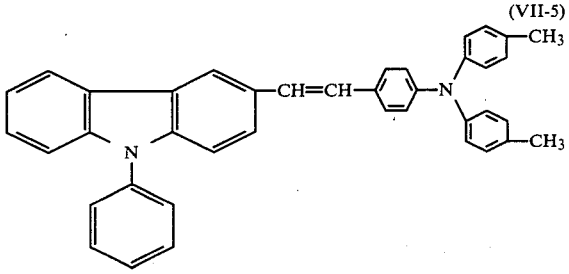

(VII-6)

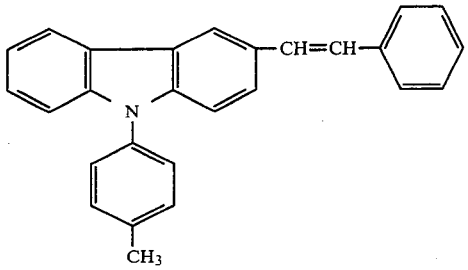

(VII-7)

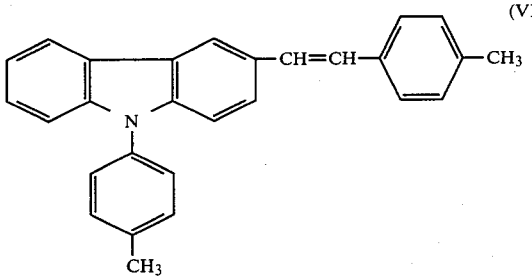

(VII-8)

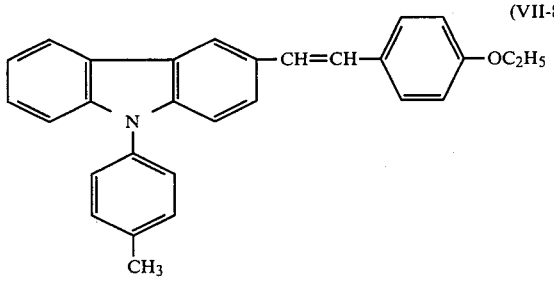

-continued
Exemplary compounds
(VII-9)
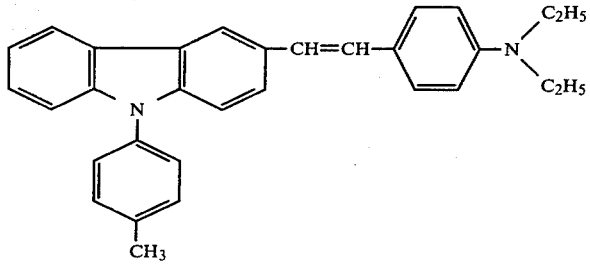
(VII-10)
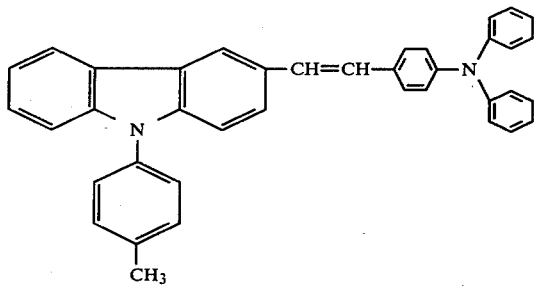
(VII-11)
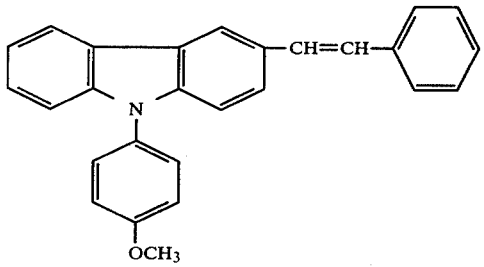
(VII-12)
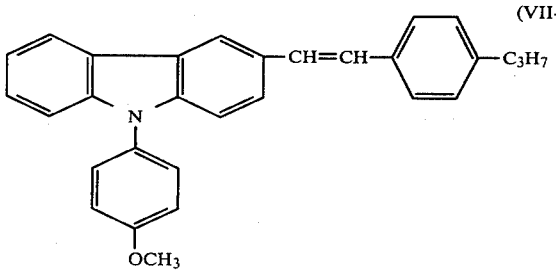
(VII-13)
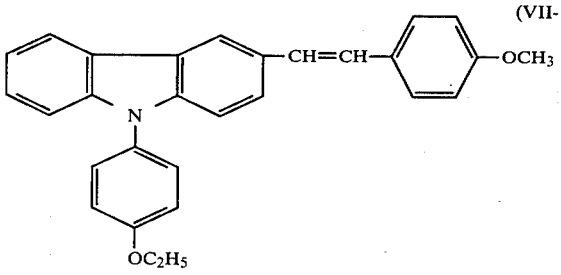
-continued
Exemplary compounds
(VII-14)
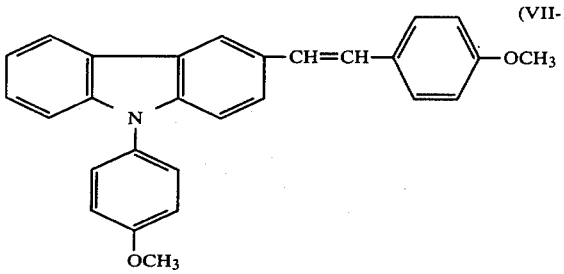
(VII-15)
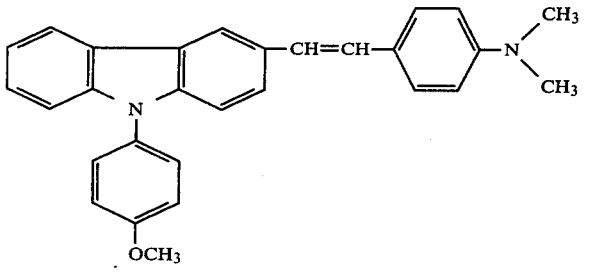
(VII-16)
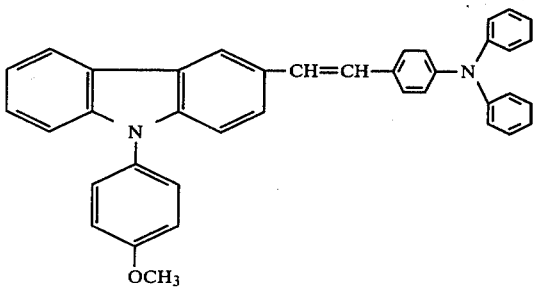
(VII-17)
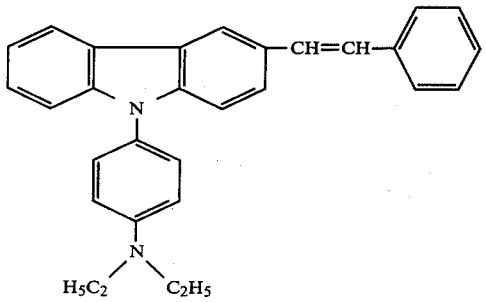
(VII-18)
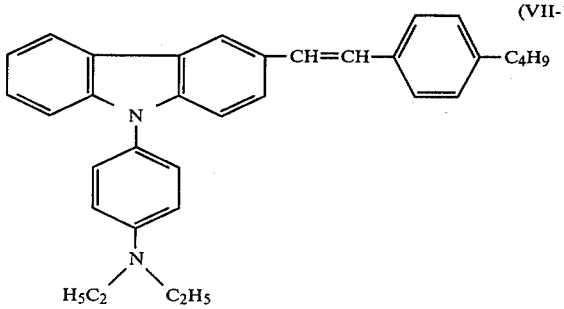

-continued
Exemplary compounds
(VII-19)
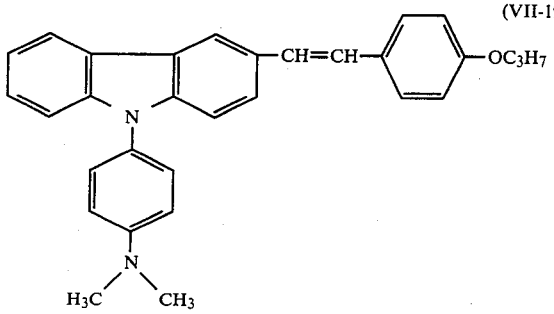
(VII-20)
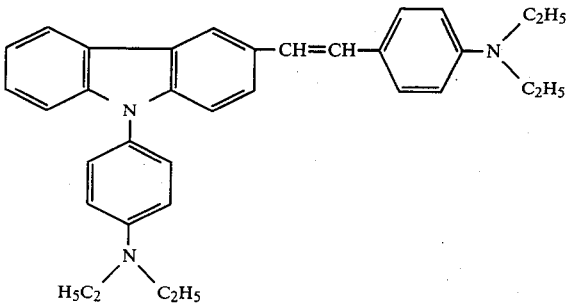
(VII-21)
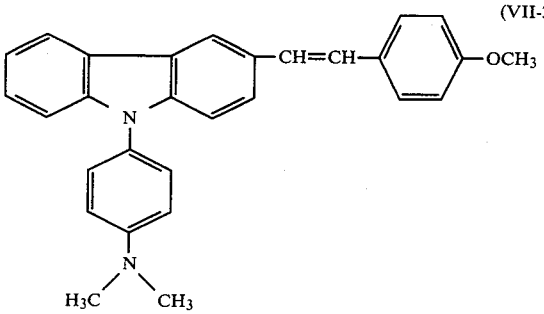
(VII-22)
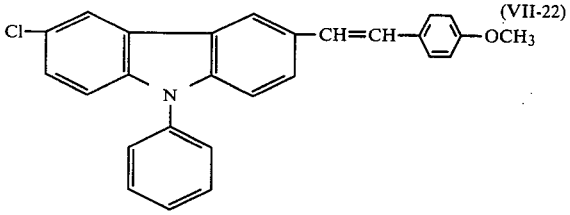
(VII-23)
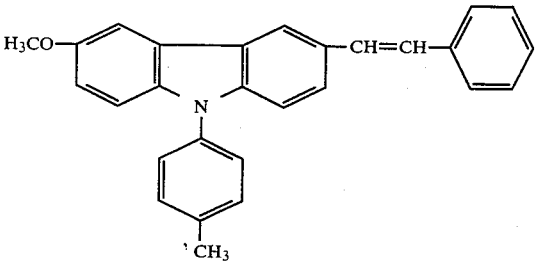
-continued
Exemplary compounds
(VII-24)
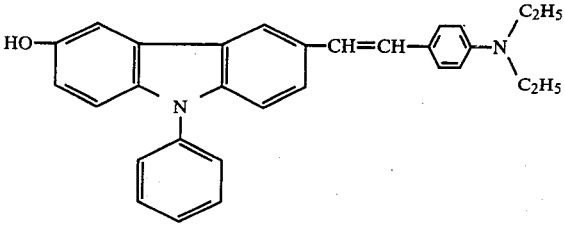
(VII-25)
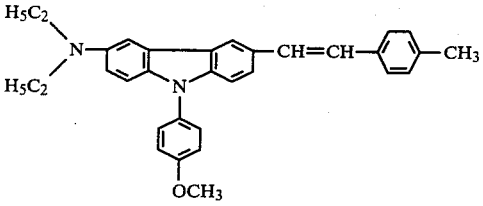
(VII-26)
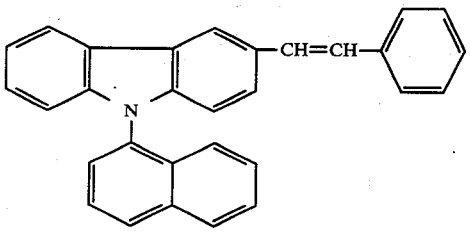
(VII-27)
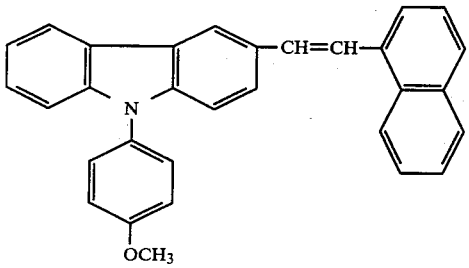
(VII-28)
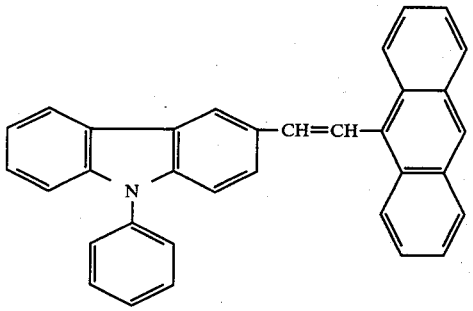
(VII-29)
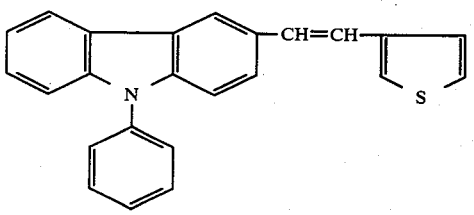

-continued

Exemplary compounds (VII-30)

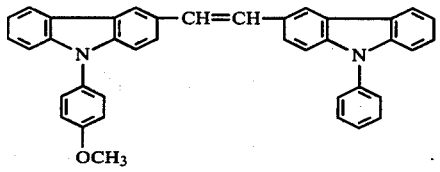

(VII-31)

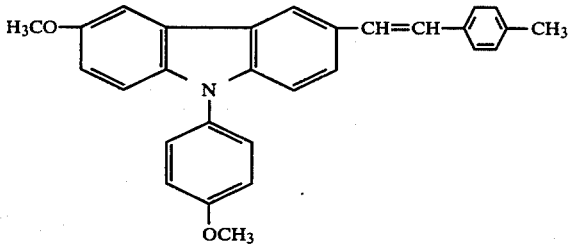

(VII-32)

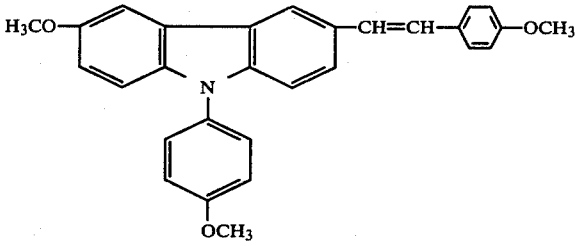

(VII-33)

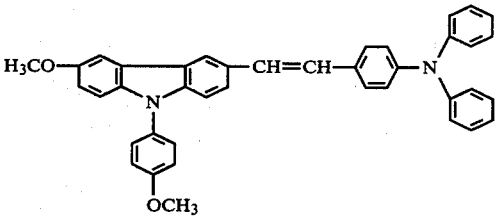

The above compounds can by synthesized according to the method described in Japanese Provisional Patent Publication No. 148750/1982 and the like.

Referring now to the mechanical constitution of the electrophotographic photosensitive member of this invention, according to an embodiment of this invention as shown in FIG. 1, a CGL 2 comprising a bisazo compound as already described as the main component is formed on an electroconductive support 1, and on the CGL 2 is formed by lamination a CTL 3 comprising styryl compounds and/or amine derivatives, respective hydrazone compounds and carbazole derivatives, and a photosensitive layer 4 is constituted of these CGL 2 and CTL 3.

Figure 2:
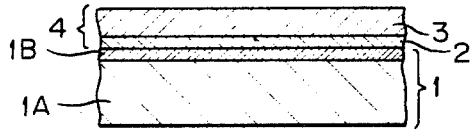
FIG. 2 shows a sectional view for illustration of another embodiment of the constitution of the electrophotographic photosensitive member of this invention.

Here, as the material for the above electroconductive support 1, there may be employed a sheet of a metal such as aluminum nickel, copper, zinc, palladium, silver, indium, tin, platinum, gold, stainless steel, brass, etc. However, the material is not limited to these, but an electroconductive support 1 can be constituted by providing an electroconductive layer 1B on an insulating substrate 1A as shown in FIG. 2. In this case, as the substrate 1A, it is suitable to use a material having flexibility and also sufficient strength to a stress such as bending or tensile stress, for example, papers, plastic sheets, etc. On the other hand, the electroconductive layer 1B can be provided by lamination of a metal sheet or vacuum vapor deposition of a metal, or according to other methods.

The above-mentioned CGL 2 can be formed of the bisazo compound as already described alone, a mixture of the compound added to an appropriate binder or a mixture in which a material with great mobility relative to carriers of definite or indefinite polarity, namely CTM, is further added.

As a specific method, there may be conveniently utilized the method in which a solution or a dispersion having the aforesaid bisazo compound alone or together with a binder resin dissolved or dispersed in an appropriate solvent is applied on the above support and dried.

In this method, there may be employed as the solvent or dispersant, for example, n-butylamine, diethylamine, ethylenediamine, isopropanolamine, monoethanolamine, triethanolamine, triethylenediamine, N,N-dimethyl-formamide, acetone, methyl ethyl ketone, cyclohexanone, benzene, toluene, xylene, chloroform, 1,2-dichloroethane, dichloromethane, tetrahydrofuran, dioxane, methanol, ethanol, isopropanol, ethyl acetate, butyl acetate, dimethyl sulfoxide and others.

As the binder resin, there may be included, for example, an addition polymerization type resin, a polyaddition type resin, a polycondensation type resin such as a polyethylene, a polypropylene, an acrylic resin, a methacrylic resin, a vinyl chloride resin, a vinyl acetate resin, an epoxy resin, a polyurethane resin, a phenol resin, a polyester resin, a polycarbonate resin, a silicone resin, a melamine resin, etc. as well as copolymer resin containing two or more of the recurring units of these resins, for example, insulating resins such as a vinyl chloride-vinyl acetate copolymer resin, a vinyl chloride-vinyl acetate-maleic anhydride copolymer resin, and also polymeric organic semiconductors such as a poly-N-vinyl carbazole, etc. and, the proportion of the binder resin based on the bisazo compound may be within the range from 0 to 100% by weight, particularly from 0 to 10% by weight.

In the CGL 2 as described above, there may also be added a suitable CTM, if desired.

The above CGL thus formed may have a thickness preferably of 0.005 to 5 microns, particularly preferably 0.05 to 5 microns from the view of photosensitivity and charge retentivity.

On the other hand, the above CTL 3 can be formed from styryl compounds and/or amine derivatives, respective hydrazone compounds or carbazole compounds as already described similarly as in formation of the CGL 2 as described above, namely alone or together with a binder resin. And, other CTM may also be incorporated in CTL 3. The CTL 3 may have a thickness of 2 to 100 microns, preferably 5 to 30 microns.

Figure 3:
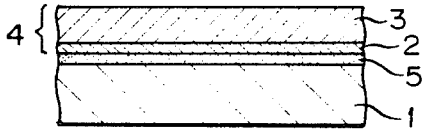
FIG. 3, FIG. 5 each show a sectional view for illustration of still other embodiments of the constitution of the electrophotographic photosensitive member of this invention.

The electrophotographic photosensitive member can be made to have other mechanical constitutions. For example, as shown in FIG. 3, a suitable intermediate layer 5 may be provided on the electroconductive support 1, and CGL 2 formed with this layer interposed, followed by formation of CTL 3 on CGL 2. The intermediate layer may be endowed with a function to impede injection of free carriers from the electroconductive support 1 to the photosensitive layer 4 during charging of the photosensitive layer 4 or a function as an adhesive layer which adheres the photosensitive layer 4 integrally to the electroconductive support. As the material for such an intermediate layer 5, there may be employed metal oxides such as aluminum oxide, indium oxide, etc. and polymeric materials such as an acrylic resin, a methacrylic resin, a vinyl chloride resin, a vinyl acetate resin, an epoxy resin, a polyurethane resin, a phenol resin, a polyester resin, an alkyd resin, a polycarbonate resin, a silicone resin, a melamine resin, a vinyl chloride-vinyl acetate copolymer resin, a vinyl chloride-vinyl acetate-maleic anhydride copolymer resin and so on.

Figure 4:
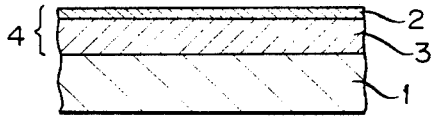

Alternatively, as shown in FIG. 4, CTL 3 may be formed with or without the intermediate layer 5 on the electroconductive support 1, and CGL 2 formed on the CTL 3 to form a photosensitive layer 4.

Figure 5:
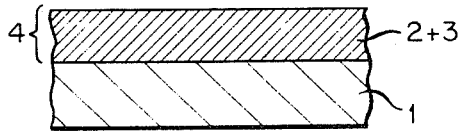

Further, as shown in FIG. 5, it is also possible to form a carrier generating phase 2 by dispersing the bisazo compound as described above into a carrier transporting phase 3 to be incorporated therein, thus forming a single layer photsensitive layer on the electroconductive support 1.

The "phase" used in the Claims means both of a photosensitive member which contains both of a carrier generating material and a carrier transporting material in a single photosensitive layer and a photosensitive member having a multi-layer constitution of two layers or more in which a carrier generating material and a carrier transporting material are permitted to exist separately in different layers.

In the layers constituting the photosensitive layer in this invention, various additives may be added, if necessary.

The present invention is now described by referring to the following Examples, by which the present invention is not limited.

EXAMPLE 1

On an electroconductive support of a polyethylene terephthalate with a thickness of 100 microns having aluminum vapor deposited thereon, an intermediate layer comprising a vinyl chloride-vinyl acetate-maleic anhydride copolymer "Ethlec MF-10" (produced by Sekisui Kagaku Kogyo Co.) with a thickness of about 0.05 micron was provided. The bisazo compound (1.5 g) as shown by the example compound (I-9) together with 100 ml of 1,2-dichloroethane was dispersed in a ball mill and the resultant dispersion was applied by means of a doctor blade on the above intermediate layer, followed by thorough drying, to form a CGL with a thickness of about 0.5 micron.

On the other hand, 11.25 g of the styryl compound as shown by the example compound (II-32) and 15 g of a polycarbonate resin "Panlite L 1250" (produced by Teijin Kasei Co.) were dissolved in 100 ml of 1,2-dichloroethane and the resultant solution was applied by means of a doctor blade on the above CGL, followed by thorough drying, to form a CTL with a thickness of 12 microns. Thus, an electrophotographic photosensitive member of this invention was prepared. This is called as "Sample 1".

EXAMPLES 2 TO 4

Example 1 was repeated except that, as the bisazo compounds, those shown by the example compounds (I-16), (I-43) and (I-5) were employed respectively in formation of CGL to prepare three kinds of electrophotographic photosensitive members of this invention. These are called as "Sample 2", "Sample 3" and "Sample 4", respectively.

EXAMPLE 5

Example 1 was repeated except that the styryl compound shown by the example compound (II-21) was employed as CTM in formation of CTL to prepare an electrophotographic photosensitive member according to this invention. This is called as "Sample 5".

EXAMPLES 6–7

Example 1 was repeated except that the amine derivatives shown by the example compounds (III-8) and (III-9) were employed respectively as CTM in formation of CTL to prepare electrophotographic photosensitive members according to this invention. These are called as "Sample 6" and "Sample 7", respectively.

EXAMPLE 8

Example 1 was repeated except that 7.5 g of the styryl compound shown by the example compound (II-18) and 7.5 g of the amine derivative shown by the example compound (III-8) were employed in formation of CTL to prepare an electrophotographic photosensitive member of this invention. This is called as "Sample 8".

EXAMPLE 9

Example 1 was repeated except that 6 g of the styryl compound shown by the example compound (II-22) and 9 g of the amine derivative shown by the example compound (III-9) were employed in formation of CTL to prepare an electrophotographic photosensitive member of this invention. This is called as "Sample 9".

EXAMPLE 10

In the same manner as described in Example 1, the intermediate layer was provided on the electroconductive support. The bisazo compound (1.5 g) shown by the example compound (I-9) and 1.5 g of a polycarbonate resin "Panlite L-1250" were added to 100 ml of 1,2-dichloroethane and dispersed therein in a ball mill for 12 hours and the resultant dispersion was applied by means of a doctor blade on the above intermediate layer, followed by thorough drying, to form a CGL with a thickness of about 1 micron.

On this CGL, CTL was formed according to the same procedure for formation of the CTL in Example 1, whereby an electrophotographic photosensitive member was prepared. This is called as "Sample 10".

COMPARATIVE EXAMPLE 1

In formation of CTL in Example 1, a pyrazoline derivative having the following structural formula [VIII] was employed, following otherwise the same procedure as in Example 1 to prepare an electrophotographic photosensitive member for comparative purpose. This is called as "Comparative sample 1".

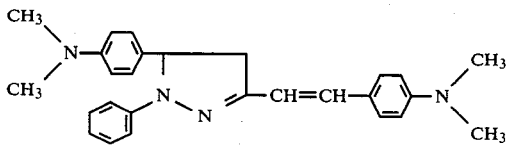

[VIII]

COMPARATIVE EXAMPLE 2

In formation of CTL in Example 1, an oxadiazole derivative having the following structural formula [IX] was employed, following otherwise the same procedure as in Example 1 to prepare an electrophotographic photosensitive member for comparative purpose. This is called as "Comparative sample 2".

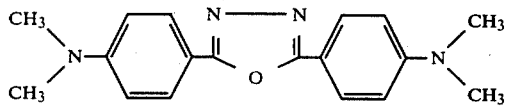

[IX]

For each of the thus prepared electrophotographic photosensitive members, Samples 1 to 10 and Comparative samples 1 and 2, its electrophotographic characteristics were examined by use of "Electrometer SP-428 Model" (produced by Kawaguchi Denki Seisakusho). That is, the receiving potential $V_A$ (V) when the surface of the photosensitive member was charged at a charging voltage of −6 KV for 5 seconds, the dosage of exposure $E_{\frac{1}{2}}$ (lux.sec.) necessary for decaying the potential $V_I$ (initial potential) after dark decay for 5 seconds to $\frac{1}{2}$, and further the dark decay percentage $(V_A-V_I)/V_A \times 100$ (%) were examined. The results are as shown in Table 1.

TABLE 1

| Electrophotographic photosensitive member | $V_A$ (V) | $E_{\frac{1}{2}}$ (lux · sec) | Dark decay percentage (%) |
|---|---|---|---|
| Sample 1 | −710 | 1.9 | 21 |
| Sample 2 | −850 | 2.7 | 14 |
| Sample 3 | −690 | 1.8 | 25 |
| Sample 4 | −725 | 2.1 | 18 |
| Sample 5 | −650 | 1.7 | 27 |
| Sample 6 | −810 | 2.4 | 13 |
| Sample 7 | −785 | 2.1 | 14 |
| Sample 8 | −755 | 2.0 | 17 |
| Sample 9 | −680 | 1.8 | 25 |
| Sample 10 | −730 | 2.1 | 19 |
| Comparative sample 1 | −620 | 2.8 | 45 |
| Comparative sample 2 | −870 | 4.9 | 13 |

It can clearly be seen from the results in Table 1 that the electrophotographic photosensitive members of this invention have great sensitivities.

Each of Samples 1 to 10 and Comparative sample 1 and 2 was mounted on a dry system electrophotographic copying machine "U-Bix 2000 R" (produced by Konishiroku Photo Industry Co.) to perform successive copying, and black paper potential Vb (V) and white paper potential Vw (V) at an exposure iris value of 1.0 were measured immediately before developing by means of "Electrostatic voltometer 144 D-1D Model" (produced by Monrow Electronics Incorporated). The results are as shown in Table 2.

The black paper potential herein mentioned represents the surface potential of a photosensitive member when the above copying cycle is practiced with the use of a black paper having a reflective density of 1.3 as the original, and the white paper potential represents that with the use of a white paper as the original.

TABLE 2

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 1 | −595 | −15 | −550 | −15 | −45 | 0 |
| Sample 2 | −650 | −85 | −615 | −70 | −35 | −15 |
| Sample 3 | −580 | −10 | −530 | −10 | −50 | 0 |
| Sample 4 | −610 | −55 | −570 | −35 | −40 | −20 |

TABLE 2-continued

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 5 | −560 | −5 | −495 | −5 | −65 | 0 |
| Sample 6 | −635 | −70 | −660 | −105 | +25 | +35 |
| Sample 7 | −630 | −60 | −645 | −80 | +15 | +20 |
| Sample 8 | −610 | −15 | −600 | −15 | −10 | 0 |
| Sample 9 | −575 | −10 | −525 | −5 | −50 | −5 |
| Sample 10 | −600 | −20 | −560 | −20 | −40 | 0 |
| Comparative sample 1 | −480 | −55 | −215 | −25 | −265 | −30 |
| Comparative sample 2 | −720 | −120 | −780 | −245 | +60 | +125 |

In the Table, ΔVb (V) and ΔVw (V) indicate the changes in the black paper potential Vb (V) and the white paper potential Vw (V), respectively, + in the change meaning increase and − decrease.

As apparently seen from the Table 2, in the electrophotographic photosensitive member of this invention, even when provided for use in repeated electrophotographic process, the history of the potential can be stably maintained to form stably a large number of visualized images of good image quality.

EXAMPLE 11

In the same manner as in Example 1, the intermediate layer was provided on the electroconductive support, and CGL with a thickness of about 0.5 micron was formed according to entirely the same procedure as in Example 1 except for using the bisazo compound shown by the example compound (I-89). On the other hand, on the above CGL was formed CTL with a thickness of 12 microns following entirely the same procedure as in Example 1 except for using the styryl compound shown by the example compound (II-18) to prepare an electrophotographic photosensitive member of this invention. This is called as "Sample 11".

EXAMPLES 12 TO 14

Example 11 was repeated except that, as the bisazo compounds, those shown by the example compounds (I-85), (I-96) and (I-123) were employed respectively in formation of CGL to prepare three kinds of electrophotographic photosensitive members of this invention. These are called as "Sample 12" to "Sample 14", respectively.

EXAMPLES 15 TO 19

Example 11 was repeated except that, as CTM, 6 g of the example compound (III-8) was used in combination with each 15 g of (II-22), (III-9) and (III-13) and 9 g of (II-18), respectively, and 7.5 g of (II-22) in combination with 7.5 g of (III-9), to prepare 5 kinds of electrophotographic photosensitive members of this invention. These are called as "Sample 15" to "Sample 19", respectively.

EXAMPLE 20

In the same manner as in Example 1, the intermediate layer was provided on the electroconductive support, and CGL with a thickness of about 0.5 micron was formed according to entirely the same procedure as in Example 1 except for using the bisazo compound shown by the example compound (I-89). On the above CGL was formed CTL following the same procedure as in Example 11 to prepare an electrophotographic photosensitive member of this invention. This is called as "Sample 20".

COMPARATIVE EXAMPLE 3

In formation of CTL in Example 11, a pyrazoline derivative having the above structural formula [VIII] was employed, following otherwise the same procedure as in Example 11 to prepare an electrophotographic photosensitive member for comparative purpose. This is called as "Comparative sample 3".

COMPARATIVE EXAMPLE 4

In formation of CTL in Example 11, an oxadiazole derivative having the above structural formula [IX] was employed, following otherwise the same procedure as in Example 11 to prepare an electrophotographic photosensitive member for comparative purpose. This is called as "Comparative sample 4".

For each of the thus prepared electrophotographic photosensitive members, Samples 11 to 20 and Comparative samples 3 and 4, its electrophotographic characteristics were examined by use of "Electrometer SP-428 Model" (produced by Kawaguchi Denki Seisakusho) according to the same method as used for Samples 1 to 10. The results are as shown in Table 3.

TABLE 3

| Electrophotographic photosensitive member | $V_A$ (V) | $E_{\frac{1}{2}}$ (lux · sec) | Dark decay percentage (%) |
|---|---|---|---|
| Sample 11 | −780 | 2.2 | 18 |
| Sample 12 | −760 | 2.4 | 23 |
| Sample 13 | −715 | 2.1 | 28 |
| Sample 14 | −845 | 2.0 | 16 |
| Sample 15 | −745 | 2.0 | 22 |
| Sample 16 | −890 | 2.8 | 14 |
| Sample 17 | −865 | 2.7 | 15 |
| Sample 18 | −815 | 2.4 | 17 |
| Sample 19 | −790 | 2.2 | 19 |
| Sample 20 | −790 | 2.3 | 17 |
| Comparative sample 3 | −650 | 2.7 | 40 |
| Comparative sample 4 | −890 | 5.3 | 12 |

It can clearly be seen from the results in Table 3 that the electrophotographic photosensitive members of this invention have great sensitivities.

Each of Samples 11 to 20 and Comparative samples 3 and 4 was mounted on a dry system electrophotographic copying machine "U-Bix 2000 R" (produced by Konishiroku Photo Industry Co.) to perform successive copying, and black paper potential Vb (V) and white paper potential Vw (V) at an exposure iris value of 1.0 were measured similarly as in case of Samples 1 to 10 immediately before developing. The results are as shown in Table 4.

TABLE 4

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 11 | −575 | −40 | −530 | −40 | −40 | 0 |
| Sample 12 | −560 | −45 | −515 | −40 | −45 | −5 |
| Sample 13 | −520 | −35 | −460 | −35 | −60 | 0 |
| Sample 14 | −630 | −30 | −600 | −30 | −30 | 0 |
| Sample 15 | −535 | −30 | −500 | −30 | −35 | 0 |
| Sample 16 | −655 | −55 | −690 | −80 | +35 | +25 |
| Sample 17 | −640 | −50 | −660 | −70 | +20 | +20 |
| Sample 18 | −615 | −40 | −580 | −35 | −35 | −5 |

TABLE 4-continued

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 19 | −600 | −35 | −560 | −30 | −40 | −5 |
| Sample 20 | −585 | −50 | −555 | −45 | −30 | −5 |
| Comparative sample 3 | −505 | −55 | −275 | −30 | −230 | −25 |
| Comparative sample 4 | −740 | −135 | −835 | −255 | +95 | +120 |

In the Table, ΔVb (V) and ΔVw (V) indicate the changes in the black paper potential Vb (V) and the white paper potential Vw (V), respectively, + in the change meaning increase and − decrease.

As apparently seen from Table 4, in the electrophotographic photosensitive member of this invention, even when provided for use in repeated electrophotographic process, the history of the potential can be stably maintained to form stably a large number of visualized images of good image quality.

EXAMPLE 21

In the same manner as in Example 1, the intermediate layer was provided on the electroconductive support, and CGL with a thickness of about 0.5 micron was formed according to entirely the same procedure as in Example 1 except for using the bisazo compound shown by the example compound (I-169). On the other hand, on the above CGL was formed CTL with a thickness of 12 microns following entirely the same procedure as in Example 1 except for using the styryl compound shown by the example compound (II-22) to prepare an electrophotographic photosensitive member of this invention. This is called as "Sample 21".

EXAMPLES 22 TO 28

Example 21 was repeated except that, in formation of CGL and information of CTL, the exemplarly compounds according to the combinations as indicated in Table 5 were employed to prepare 7 kinds of electrophotographic photosensitive members of this invention. These are called as "Sample 22" to "Sample 28", respectively.

TABLE 5

| | example compound for CGL | example compound for CTL |
|---|---|---|
| Example 22 | (I-283) | (II-33) |
| Example 23 | (I-165) | (II-22) |
| Example 24 | (I-249) | (II-33) |
| Example 25 | (I-169) | (III-9) |
| Example 26 | (I-283) | (III-8) |
| Example 27 | (I-169) | (II-22) (7.5 g)<br>(III-9) (7.5 g) |
| Example 28 | (I-283) | (II-18) (9 g)<br>(III-8) (6 g) |

EXAMPLE 29

In the same manner as in Example 1, the intermediate layer was provided on the electroconductive support, and CGL with a thickness of about 1 micron was formed according to entirely the same procedure as in Example 1 except for using the bisazo compound shown by the example compound (I-169). On the above CGL was formed CTL following the same procedure as in Example 21 to prepare an electrophotographic photosensitive member of this invention. This is called as "Sample 29".

EXAMPLE 30

Example 29 was repeated except that the example compound (I-283) was employed as the bisazo compound in formation of CGL and the example compound (II-33) as the styryl compound in formation of CTL to prepare an electrophotographic photosensitive member of this invention. This is called as "Sample 30".

COMPARATIVE EXAMPLE 5

In formation of CTL in Example 21, a pyrazoline derivative having the above structural formula [VIII] was employed, following otherwise the same procedure as in Example 21 to prepare an electrophotographic photosensitive member for comparative purpose. This is called as "Comparative sample 5".

COMPARATIVE EXAMPLE 6

In formation of CTL in Example 21, an oxadiazole derivative having the above structural formula [IX] was employed, following otherwise the same procedure as in Example 21 to prepare an electrophotographic photosensitive member for comparative purpose. This is called as "Comparative sample 6".

For each of the thus prepared electrophotographic photosensitive members, Samples 21 to 30 and Comparative samples 5 and 6, its electrophotographic characteristics were examined by use of "Electrometer SP-428 Model" (produced by Kawaguchi Denki Seisakusho). The results are as shown in Table 6.

TABLE 6

| Electrophotographic photosensitive member | $V_A$ (V) | $E_{\frac{1}{2}}$ (lux · sec) | Dark decay percentage (%) |
|---|---|---|---|
| Sample 21 | −740 | 2.4 | 21 |
| Sample 22 | −785 | 2.6 | 18 |
| Sample 23 | −700 | 2.5 | 25 |
| Sample 24 | −730 | 2.4 | 21 |
| Sample 25 | −845 | 3.0 | 16 |
| Sample 26 | −875 | 3.1 | 14 |
| Sample 27 | −795 | 2.7 | 18 |
| Sample 28 | −800 | 2.8 | 16 |
| Sample 29 | −755 | 2.5 | 19 |
| Sample 30 | −795 | 2.7 | 17 |
| Comparative sample 5 | −660 | 2.8 | 37 |
| Comparative sample 6 | −875 | 4.8 | 13 |

It can clearly be seen from the results in Table 6 that the electrophotographic photosensitive members of this invention have great sensitivities.

Each of Samples 21 to 30 and Comparative samples 5 and 6 was mounted on a dry system electrophotographic copying machine "U-Bix 2000 R" (produced by Konishiroku Photo Industry Co.) to perform successive copying, and black paper potential Vb (V) and white paper potential Vw (V) at an exposure iris value of 1.0 were measured similarly as in case of Samples 1 to 10 immediately before developing. The results are as shown in Table 7.

TABLE 7

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 21 | −545 | −55 | −505 | −50 | −40 | −5 |

TABLE 7-continued

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 22 | −580 | −65 | −545 | −60 | −35 | −5 |
| Sample 23 | −515 | −60 | −470 | −50 | −45 | −10 |
| Sample 24 | −520 | −50 | −485 | −50 | −35 | 0 |
| Sample 25 | −615 | −70 | −635 | −85 | +20 | +15 |
| Sample 26 | −635 | −80 | −650 | −90 | +15 | +10 |
| Sample 27 | −585 | −65 | −540 | −65 | −45 | 0 |
| Sample 28 | −590 | −70 | −540 | −65 | −50 | −5 |
| Sample 29 | −560 | −60 | −520 | −60 | −40 | 0 |
| Sample 30 | −585 | −70 | −560 | −70 | −25 | 0 |
| Comparative sample 5 | −565 | −70 | −325 | −30 | −240 | −40 |
| Comparative sample 6 | −710 | −115 | −785 | −240 | +75 | +125 |

In the Table, ΔVb (V) and ΔVw (V) indicate the changes in the black paper potential Vb (V) and the white paper potential Vw (V), respectively, + in the change meaning increase and − decrease.

As apparently seen from Table 7, in the electrophotographic photosensitive member of this invention, even when provided for use in repeated electrophotographic process, the history of the potential can be stably maintained to form stably a large number of visualized images of good image quality.

EXAMPLE 31

In the same manner as in Example 1, the intermediate layer was provided on the electroconductive support, and CGL with a thickness of about 0.5 micron was formed by use of the same compound as in Example 1. On the other hand, on the above CGL was formed CTL with a thickness of 12 microns following entirely the same procedure as in Example 1 except for using the hydrazone compound shown by the example compound (IV-2) in place of the styryl compound to prepare an electrophotographic photosensitive member of this invention. This is called as "Sample 31".

EXAMPLES 32 TO 35

Example 31 was repeated except that, as the bisazo compounds, those shown by the example compounds (I-5), (I-45), (I-76) and (I-77) were employed respectively in information of CGL to prepare four kinds of electrophotographic photosensitive members of this invention. These are called as "Sample 32" to "Sample 35", respectively.

EXAMPLES 36 TO 39

Example 31 was repeated except that, as the hydrazone compounds, those shown by the example compounds (IV-1), (IV-5), (IV-7) and (IV-13) were employed respectively in formation of CTL to prepare four kinds of electrophotographic photosensitive members of this invention. These are called as "Sample 36" to "Sample 39", respectively.

EXAMPLE 40

In the same manner as in Example 1, the intermediate layer was provided on the electroconductive support, and CGL with a thickness of about 0.5 micron was formed according to entirely the same procedure as in Example 1 except for using the bisazo compound shown by the example compound (I-9). On the above CGL was formed CTL following the same procedure as in Example 31 to prepare an electrophotographic photosensitive member of this invention. This is called as "Sample 40".

COMPARATIVE EXAMPLE 7

In formation of CTL in Example 31, a pyrazoline derivative having the above structural formula [VIII] was employed, following otherwise the same procedure as in Example 31 to prepare an electrophotographic photosensitive member for comparative purpose. This is called as "Comparative sample 7".

COMPARATIVE EXAMPLE 8

In formation of CTL in Example 31, an oxadiazole derivative having the above structural formula [IX] was employed, following otherwise the same procedure as in Example 31 to prepare an electrophotographic photosensitive member for comparative purpose. This is called as "Comparative sample 8".

For each of the thus prepared electrophotographic photosensitive members, Samples 31 to 40 and Comparative samples 7 and 8, its electrophotographic characteristics were examined by use of "Electrometer SP-428 Model" (produced by Kawaguchi Denki Seisakusho) according to the same method as used for Samples 1 to 10. The results are as shown in Table 8.

TABLE 8

| Electrophotographic photosensitive member | $V_A$ (V) | $E_{\frac{1}{2}}$ (lux · sec) | Dark decay percentage (%) |
|---|---|---|---|
| Sample 31 | −680 | 1.8 | 20 |
| Sample 32 | −660 | 1.7 | 22 |
| Sample 33 | −690 | 1.8 | 19 |
| Sample 34 | −705 | 1.9 | 18 |
| Sample 35 | −650 | 1.7 | 24 |
| Sample 36 | −700 | 1.9 | 18 |
| Sample 37 | −655 | 1.6 | 25 |
| Sample 38 | −685 | 1.8 | 20 |
| Sample 39 | −650 | 1.7 | 26 |
| Sample 40 | −695 | 2.0 | 17 |
| Comparative sample 7 | −670 | 2.6 | 39 |
| Comparative sample 8 | −860 | 4.9 | 14 |

It can clearly be seen from the results in Table 8 that the electrophotographic photosensitive members of this invention have great sensitivities.

Each of Samples 31 to 40 and Comparative samples 7 and 8 was mounted on a dry system electrophotographic copying machine "U-Bix 2000 R" (produced by Konishiroku Photo Industry Co.) to perform successive copying, and black paper potential Vb (V) and white paper potential Vw (V) at an exposure iris value of 1.0 were measured similarly as in case of Samples 1 to 10 immediately before developing. The results are as shown in Table 9.

TABLE 9

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 31 | −545 | −30 | −520 | −25 | −25 | −5 |
| Sample 32 | −530 | −25 | −505 | −25 | −25 | 0 |
| Sample 33 | −550 | −30 | −530 | −30 | −20 | 0 |
| Sample 34 | −560 | −35 | −535 | −35 | −25 | 0 |
| Sample 35 | −530 | −25 | −490 | −20 | −40 | −5 |
| Sample 36 | −560 | −35 | −545 | −35 | −15 | 0 |
| Sample 37 | −525 | −20 | −480 | −15 | −45 | −5 |
| Sample 38 | −550 | −35 | −525 | −35 | −25 | 0 |
| Sample 39 | −520 | −20 | −480 | −15 | −40 | −5 |

TABLE 9-continued

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 40 | −560 | −40 | −525 | −40 | −35 | 0 |
| Comparative sample 7 | −540 | −60 | −280 | −35 | −260 | −25 |
| Comparative sample 8 | −700 | −115 | −770 | −220 | +70 | +105 |

In the Table, ΔVb (V) and ΔVw (V) indicate the changes in the black paper potential Vb (V) and the white paper potential Vw (V), respectively, + in the change meaning increase and − decrease.

As apparently seen from Table 9, in the electrophotographic photosensitive member of this invention, even when provided for use in repeated electrophotographic process, the history of the potential can be stably maintained to form stably a large number of visualized images of good image quality.

EXAMPLE 41

In the same manner as in Example 1, the intermediate layer was provided on the electroconductive support, and CGL with a thickness of about 0.5 micron was formed according to entirely the same procedure as in Example 1 except for using the bisazo compound shown by the example compound (I-96). On the other hand, on the above CGL was formed CTL with a thickness of 12 microns following entirely the same procedure as in Example 31 except for using the hydrazone compound shown by the example compound (IV-5) to prepare an electrophotographic photosensitive member of this invention. This is called as "Sample 41".

EXAMPLES 42 TO 45

Example 41 was repeated except that, as the bisazo compounds, those shown by the example compounds (I-5), (I-7), (I-9) and (I-40) were employed respectively in formation of CGL to prepare four kinds of electrophotographic photosensitive members of this invention. These are called as "Sample 42" to "Sample 45", respectively.

EXAMPLES 46 TO 49

Example 41 was repeated except that, as the hydrazone compounds, those shown by the example compounds (IV-1), (IV-2), (IV-4) and (IV-7) were employed respectively in formation of CTL to prepare four kinds of electrophotographic photosensitive members of this invention. These are called as "Sample 46" to "Sample 49", respectively.

EXAMPLE 50

In the same manner as in Example 1, the intermediate layer was provided on the electroconductive support, and CGL with a thickness of about 0.5 micron was formed according to entirely the same procedure as in Example 1 except for using the bisazo compound shown by the example compound (I-96). On the above CGL was formed CTL following the same procedure as in Example 41 to prepare an electrophotographic photosensitive member of this invention. This is called as "Sample 50".

COMPARATIVE EXAMPLE 9

In formation of CTL in Example 41, a pyrazoline derivative having the above structural formula [VIII] was employed, following otherwise the same procedure as in Example 41 to prepare an electrophotographic photosensitive member for comparative purpose. This is called as "Comparative sample 9".

COMPARATIVE EXAMPLE 10

In formation of CTL in Example 41, an oxadiazole derivative having the above structural formula [IX] was employed, following otherwise the same procedure as in Example 41 to prepare an electrophotographic photosensitive member for comparative purpose. This is called as "Comparative sample 10".

For each of the thus prepared electrophotographic photosensitive members, Samples 41 to 50 and Comparative samples 9 and 10, its electrophotographic characteristics were examined by use of "Electrometer SP-428 Model" (produced by Kawaguchi Denki Seisakusho) according to the same method as used for Samples 1 to 10. The results are as shown in Table 10.

TABLE 10

| Electrophotographic photosensitive member | $V_A$ (V) | $E_{\frac{1}{2}}$ (lux · sec) | Dark decay percentage (%) |
|---|---|---|---|
| Sample 41 | −695 | 2.1 | 23 |
| Sample 42 | −720 | 2.3 | 21 |
| Sample 43 | −735 | 2.4 | 20 |
| Sample 44 | −755 | 2.6 | 17 |
| Sample 45 | −790 | 2.8 | 11 |
| Sample 46 | −725 | 2.2 | 19 |
| Sample 47 | −710 | 2.2 | 20 |
| Sample 48 | −700 | 2.1 | 21 |
| Sample 49 | −675 | 2.0 | 24 |
| Sample 50 | −710 | 2.2 | 22 |
| Comparative sample 9 | −665 | 2.8 | 39 |
| Comparative sample 10 | −895 | 4.9 | 11 |

It can clearly be seen from the results in Table 10 that the electrophotographic photosensitive members of this invention have great sensitivities.

Each of Samples 41 to 50 and Comparative samples 9 and 10 was mounted on a dry system electrophotographic copying machine "U-Bix 2000 R" (produced by Konishiroku Photo Industry Co.) to perform successive copying, and black paper potential Vb (V) and white paper potential Vw (V) at an exposure iris value of 1.0 were measured similarly as in case of Samples 1 to 10 immediately before developing. The results are as shown in Table 11.

TABLE 11

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 41 | −560 | −45 | −520 | −40 | −40 | −5 |
| Sample 42 | −580 | −60 | −545 | −55 | −35 | −5 |
| Sample 43 | −585 | −65 | −555 | −65 | −30 | 0 |
| Sample 44 | −600 | −75 | −580 | −75 | −20 | 0 |
| Sample 45 | −615 | −90 | −600 | −90 | −15 | 0 |
| Sample 46 | −585 | −65 | −560 | −65 | −25 | 0 |
| Sample 47 | −575 | −65 | −555 | −65 | −20 | 0 |
| Sample 48 | −560 | −60 | −525 | −60 | −35 | 0 |
| Sample 49 | −545 | −50 | −505 | −40 | −40 | −10 |
| Sample 50 | −570 | −55 | −525 | −50 | −45 | −5 |
| Comparative sample 9 | −545 | −60 | −280 | −25 | −265 | −35 |

TABLE 11-continued

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Comparative sample 10 | −740 | −135 | −805 | −250 | +65 | +115 |

In the Table, ΔVb (V) and ΔVw (V) indicate the changes in the black paper potential Vb (V) and the white paper potential Vw (V), respectively, + in the change meaning increase and − decrease.

As apparently seen from Table 11, in the electrophotographic photosensitive member of this invention, even when provided for use in repeated electrophotographic process, the history of the potential can be stably maintained to form stably a large number of visualized images of good image quality.

EXAMPLE 51

In the same manner as in Example 1, the intermediate layer was provided on the electroconductive support, and CGL with a thickness of about 0.5 micron was formed according to entirely the same procedure as in Example 1 except for using the bisazo compound shown by the example compound (I-169). On the other hand, on the above CGL was formed CTL with a thickness of 12 microns following entirely the same procedure as in Example 31 except for using the hydrazone compound shown by the example compound (IV-10) to prepare an electrophotographic photosensitive member of this invention. This is called as "Sample 51".

EXAMPLES 52 TO 58

Example 51 was repeated except that, in formation of CGL and information of CTL, the exemplarly compounds according to the combinations as indicated in Table 12 were employed to prepared 7 kinds of electrophotographic photosensitive members of this invention. These are called as "Sample 52" to "Sample 58", respectively.

TABLE 12

| | example compound for CGL | example compound for CTL |
|---|---|---|
| Example 52 | (I-205) | (IV-10) |
| Example 53 | (I-283) | (IV-4) |
| Example 54 | (I-236) | (IV-4) |
| Example 55 | (I-169) | (IV-7) |
| Example 56 | (I-169) | (IV-13) |
| Example 57 | (I-283) | (IV-2) |
| Example 58 | (I-283) | (IV-5) |

EXAMPLE 59

In the same manner as in Example 1, the intermediate layer was provided on the electroconductive support, and CGL with a thickness of about 1 micron was formed according to entirely the same procedure as in Example 10 except for using the bisazo compound shown by the example compound (I-169). On the above CGL was formed CTL following the same procedure as in Example 51 to prepare an electrophotographic photosensitive member of this invention. This is called as "Sample 59".

EXAMPLE 60

Example 59 was repeated except that the example compound (I-283) was employed as the bisazo compound in formation of CGL and the example compound (IV-4) as the hydrazone compound in formation of CTL to prepare an electrophotographic photosensitive member of this invention. This is called as "Sample 60".

COMPARATIVE EXAMPLE 11

In formation of CTL in Example 53, a pyrazoline derivative having the above structural formula [VIII] was employed, following otherwise the same procedure as in Example 53 to prepare an electrophotographic photosensitive member for comparative purpose. This is called as "Comparative sample 11".

COMPARATIVE EXAMPLE 12

In formation of CTL in Example 53, an oxadiazole derivative having the above structural formula [IX] was employed, following otherwise the same procedure as in Example 53 to prepare an electrophotographic photosensitive member for comparative purpose. This is called as "Comparative sample 12".

For each of the thus prepared electrophotographic photosensitive members, Samples 51 to 60 and Comparative samples 11 and 12, its electrophotographic characteristics were examined by use of "Electrometer SP-428 Model" (produced by Kawaguchi Denki Seisakusho). The results are as shown in Table 13.

TABLE 13

| Electrophotographic photosensitive member | $V_A$ (V) | $E_{\frac{1}{2}}$ (lux · sec) | Dark decay percentage (%) |
|---|---|---|---|
| Sample 51 | −760 | 2.8 | 14 |
| Sample 52 | −805 | 3.0 | 12 |
| Sample 53 | −685 | 2.4 | 18 |
| Sample 54 | −695 | 2.5 | 17 |
| Sample 55 | −770 | 2.9 | 13 |
| Sample 56 | −740 | 2.7 | 15 |
| Sample 57 | −700 | 2.5 | 16 |
| Sample 58 | −660 | 2.3 | 20 |
| Sample 59 | −775 | 2.9 | 13 |
| Sample 60 | −825 | 3.2 | 10 |
| Comparative sample 11 | −610 | 3.1 | 41 |
| Comparative sample 12 | −890 | 5.3 | 12 |

It can clearly be seen from the results in Table 13 that the electrophotographic photosensitive members of this invention have great sensitivities.

Each of Samples 51 to 60 and Comparative samples 11 and 12 was mounted on a dry system electrophotographic copying machine "U-Bix 2000 R" (produced by Konishiroku Photo Industry Co.) to perform successive copying, and black paper potential Vb (V) and white paper potential Vw (V) at an exposure iris value of 1.0 were measured similarly as in case of Samples 1 to 10 immediately before developing. The results are as shown in Table 14.

TABLE 14

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 51 | −570 | −65 | −550 | −65 | −20 | 0 |
| Sample 52 | −590 | −80 | −575 | −80 | −15 | 0 |
| Sample 53 | −525 | −50 | −490 | −45 | −35 | −5 |

TABLE 14-continued

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 54 | −530 | −55 | −500 | −55 | −30 | 0 |
| Sample 55 | −575 | −70 | −560 | −70 | −15 | 0 |
| Sample 56 | −555 | −65 | −525 | −65 | −30 | 0 |
| Sample 57 | −535 | −60 | −505 | −60 | −30 | 0 |
| Sample 58 | −510 | −45 | −475 | −40 | −35 | −5 |
| Sample 59 | −580 | −75 | −555 | −70 | −25 | −5 |
| Sample 60 | −605 | −85 | −580 | −85 | −25 | 0 |
| Comparative sample 11 | −510 | −70 | −260 | −45 | −250 | −25 |
| Comparative sample 12 | −720 | −115 | −785 | −250 | +65 | +135 |

In the Table, ΔVb (V) and ΔVw (V) indicate the changes in the black paper potential Vb (V) and the white paper potential Vw (V), respectively, + in the change meaning increase and − decrease.

As apparently seen from Table 14, in the electrophotographic photosensitive member of this invention, even when provided for use in repeated electrophotographic process, the history of the potential can be stably maintained to form stably a large number of visualized images of good image quality.

EXAMPLE 61

In the same manner as in Example 1, the intermediate layer was provided on the electroconductive support, and CGL with a thickness of about 0.5 micron was formed according to entirely the same procedure as in Example 1 except for using the bisazo compound shown by the example compound (I-43). On the other hand, on the above CGL was formed CTL with a thickness of 12 microns following entirely the same procedure as in Example 1 except for using 11.25 g of the hydrazone compound shown by the example compound (V-2) to prepare an electrophotographic photosensitive member of this invention. This is called as "Sample 61".

EXAMPLES 62 TO 64

Example 61 was repeated except that, as the bisazo compounds, those shown by the example compounds (I-9), (I-5), and (I-76) were employed respectively in formation of CGL to prepare three kinds of electrophotographic photosensitive members of this invention. These are called as "Sample 62" to "Sample 64", respectively.

EXAMPLE 65 TO 67

Example 61 was repeated except that, as the hydrazone derivatives, those shown by the example compounds (V-29), (VI-10), and (VI-28) were employed respectively in formation of CTL to prepare three kinds of electrophotographic photosensitive members of this invention. These are called as "Sample 65" to "Sample 67", respectively.

EXAMPLE 68

In the same manner as in Example 1, the intermediate layer was provided on the electroconductive support, and CGL with a thickness of about 0.5 micron was formed according to entirely the same procedure as in Example 1 except for using the bisazo compound shown by the example compound (I-43). On the above CGL was formed CTL following the same procedure as in Example 61 to prepare an electrophotographic photosensitive member of this invention. This is called as "Sample 68".

COMPARATIVE EXAMPLE 13

In formation of CTL in Example 61, a pyrazoline derivative having the above structural formula [VIII] was employed, following otherwise the same procedure as in Example 61 to prepare an electrophotographic photosensitive member for comparative purpose. This is called as "Comparative sample 13".

COMPARATIVE EXAMPLE 14

In formation of CTL in Example 61, an oxadiazole derivative having the above structural formula [IX] was employed, following otherwise the same procedure as in Example 61 to prepare an electrophotographic photosensitive member for comparative purpose. This is called as "Comparative sample 14".

For each of the thus prepared electrophotographic photosensitive members, Samples 61 to 68 and Comparative samples 13 and 14, its electrophotographic characteristics were examined by use of "Electrometer SP-428 Model" (produced by Kawaguchi Denki Seisakusho) according to the same method as used for Samples 1 to 10. The results are as shown in Table 15.

TABLE 15

| Electrophotographic photosensitive member | $V_A$ (V) | $E_{\frac{1}{2}}$ (lux · sec) | Dark decay percentage (%) |
|---|---|---|---|
| Sample 61 | −650 | 1.7 | 24 |
| Sample 62 | −665 | 1.7 | 26 |
| Sample 63 | −700 | 1.8 | 23 |
| Sample 64 | −640 | 1.6 | 29 |
| Sample 65 | −715 | 1.9 | 20 |
| Sample 66 | −695 | 1.8 | 21 |
| Sample 67 | −725 | 2.0 | 18 |
| Sample 68 | −690 | 1.8 | 22 |
| Comparative sample 13 | −640 | 2.7 | 40 |
| Comparative sample 14 | −890 | 5.0 | 12 |

It can clearly be seen from the results in Table 15 that the electrophotographic photosensitive members of this invention have great sensitivities.

Each of Samples 61 to 68 and Comparative samples 13 and 14 was mounted on a dry system electrophotographic copying machine "U-Bix 2000 R" (produced by Konishiroku Photo Industry Co.) to perform successive copying, and black paper potential Vb (V) and white paper potential Vw (V) at an exposure iris value of 1.0 were measured similarly as in case of Samples 1 to 10 immediately before developing. The results are as shown in Table 16.

TABLE 16

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 61 | −555 | −10 | −520 | −10 | −35 | 0 |
| Sample 62 | −565 | −10 | −530 | −10 | −35 | 0 |
| Sample 63 | −590 | −35 | −560 | −30 | −30 | −5 |
| Sample 64 | −550 | −5 | −510 | −5 | −40 | 0 |
| Sample 65 | −600 | −25 | −565 | −25 | −35 | 0 |
| Sample 66 | −590 | −30 | −545 | −25 | −45 | −5 |
| Sample 67 | −615 | −45 | −590 | −45 | −25 | 0 |
| Sample 68 | −585 | −15 | −530 | −15 | −55 | 0 |
| Comparative sample 13 | −510 | −60 | −245 | −30 | −265 | −30 |
| Comparative | −730 | −125 | −805 | −255 | +65 | +130 |

TABLE 16-continued

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| sample 14 | | | | | | |

In the Table, ΔVb(V) and ΔVw (V) indicate the changes in the black paper potential Vb (V) and the white paper potential Vw (V), respectively, + in the change meaning increase and − decrease.

As apparently seen from Table 16, in the electrophotographic photosensitive member of this invention, even when provided for use in repeated electrophotographic process, the history of the potential can be stably maintained to form stably a large number of visualized images of good image quality.

EXAMPLE 69

In the same manner as in Example 1, the intermediate layer was provided on the electroconductive support, and CGL with a thickness of about 0.5 micron was formed according to entirely the same procedure as in Example 1 except for using the bisazo compound shown by the example compound (I-123). On the other hand, on the above CGL was formed CTL with a thickness of 12 microns following entirely the same procedure as in Example 31 except for using the hydrazone compound shown by the example compound (V-1) to prepare an elctrophotographic photosensitive member of this invention. This is called as "Sample 69".

EXAMPLES 70 TO 72

Example 69 was repeated except that, as the bisazo compounds, those shown by the example compounds (I-85), (I-89), and (I-56) were employed respectively in formation of CGL to prepare three kinds of electrophotographic photosensitive members of this invention. These are called as "Sample 70" to "Sample 72", respectively.

EXAMPLES 73 TO 77

Example 69 was repeated except that, as the hydrazone compounds, those shown by the example compounds (V-29), (V-33), (VI-9), (VI-25) and (VI-28) employed respectively in formation of CTL to prepare five kinds of electrophotographic photosensitive members of this invention. These are called as "Sample 73" to "Sample 77", respectively.

EXAMPLE 78

In the same manner as in Example 1, the intermediate layer was provided on the electroconductive support, and CGL with a thickness of about 1 micron was formed according to entirely the same procedure as in Example 10 except for using the bisazo compound shown by the example compound (I-123). On the above CGL was formed CTL following the same procedure as in Example 69 to prepare an electrophotographic photosensitive member of this invention. This is called as "Sample 78".

COMPARATIVE EXAMPLE 15

In formation of CTL in Example 69, a pyrazoline derivative having the above structural formula [VIII] was employed, following otherwise the same procedure as in Example 69 to prepare an electrophotographic photosensitive member for comparative purpose. This is called as "Comparative sample 15".

COMPARATIVE EXAMPLE 16

In formation of CTL in Example 69, an oxadiazole derivative having the above structural formula [IX] was employed, following otherwise the same procedure as in Example 69 to prepare an electrophotographic photosensitive member for comparative purpose. This is called as "Comparative sample 16".

For each of the thus prepared electrophotographic photosensitive members, Samples 69 to 78 and Comparative samples 15 and 16, its electrophotographic characteristics were examined by use of "Electrometer SP-428 Model" (produced by Kawaguchi Denki Seisakuso) according to the same method as used for Samples 1 to 10. The results are as shown in Table 17.

TABLE 17

| Electrophotographic photosensitive member | $V_A$ (V) | $E_{\frac{1}{2}}$ (lux · sec) | Dark decay percentage (%) |
|---|---|---|---|
| Sample 69 | −680 | 1.5 | 23 |
| Sample 70 | −620 | 1.6 | 27 |
| Sample 71 | −655 | 1.6 | 26 |
| Sample 72 | −700 | 1.7 | 21 |
| Sample 73 | −715 | 1.9 | 20 |
| Sample 74 | −705 | 1.8 | 21 |
| Sample 75 | −690 | 1.7 | 22 |
| Sample 76 | −730 | 2.0 | 18 |
| Sample 77 | −710 | 1.9 | 19 |
| Sample 78 | −700 | 1.7 | 21 |
| Comparative sample 15 | −655 | 2.4 | 35 |
| Comparative sample 16 | −950 | 4.8 | 11 |

It can clearly be seen from the results in Table 17 that the electrophotographic photosensitive members of this invention have great sensitivities.

Each of Samples 69 to 78 Comparative samples 15 and 16 was mounted on a dry system electrophotographic copying machine "U-Bix 2000 R" (produced by Konishiroku Photo Industry Co.) to perform successive copying, and black paper potential Vb (V) and white paper potential Vw (V) at an exposure iris value of 1.0 were measured similarly as in case of Samples 1 to 10 immediately before developing. The results are as shown in Table 18.

TABLE 18

| Electrophotographic photo sensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 69 | −560 | −10 | −530 | −10 | −30 | 0 |
| Sample 70 | −530 | −5 | −450 | −5 | −80 | 0 |
| Sample 71 | −545 | −10 | −485 | −10 | −60 | 0 |
| Sample 72 | −575 | −15 | −550 | −15 | −25 | 0 |
| Sample 73 | −585 | −20 | −560 | −20 | −25 | 0 |
| Sample 74 | −580 | −20 | −555 | −20 | −25 | 0 |
| Sample 75 | −570 | −15 | −540 | −15 | −30 | 0 |
| Sample 76 | −605 | −30 | −580 | −30 | −25 | 0 |
| Sample 77 | −590 | −20 | −560 | −20 | −30 | 0 |
| Sample 78 | −580 | −20 | −550 | −20 | −30 | 0 |
| Comparative sample 15 | −530 | −45 | −305 | −25 | −225 | −20 |
| Comparative sample 16 | −750 | −120 | −820 | −240 | +70 | +120 |

In the Table, ΔVb(V) and ΔVw (V) indicate the changes in the black paper potential Vb (V) and the white paper potential Vw (V), respectively, + in the change meaning increase and − decrease.

As apparently seen from Table 18, in the electrophotographic photosensitive member of this invention, even when provided for use in repeated electrophotographic process, the history of the potential can be stably maintained to form stably a large number of visualized images of good image quality.

EXAMPLE 79

In the same manner as in Example 1, the intermediate layer was provided on the electroconductive support, and CGL with a thickness of about 0.5 micron was formed according to entirely the same procedure as in Example 1 except for using the bisazo compound shown by the exemplary compound (I-169). On the other hand, on the above CGL was formed CTL with a thickness of 12 microns following entirely the same procedure as in Example 31 except for using the hydrazone compound shown by the example compound (V-29) to prepare an electrophotographic photosensitive member of this invention. This is called as "Sample 79".

EXAMPLES 80 TO 86

Example 79 was repeated except that, in formation of CGL and information of CTL, the exemplary compounds according to the combinations as indicated in Table 19 were employed to prepared 7 kinds of electrophotographic photosensitive members of this invention. These are called as "Sample 80" to "Sample 86", respectively.

TABLE 19

| | example compound for CGL | example compound for CTL |
|---|---|---|
| Example 80 | (I-283) | (V-10) |
| Example 81 | (I-203) | (V-29) |
| Example 82 | (I-316) | (V-10) |
| Example 83 | (I-169) | (V-4) |
| Example 84 | (I-169) | (VI-29) |
| Example 85 | (I-203) | (V-2) |
| Example 86 | (I-203) | (VI-30) |

EXAMPLE 87

In the same manner as in Example 1, the intermediate layer was provided on the electroconductive support, and CGL with a thickness of about 1 micron was formed according to entirely the same procedure as in Example 10 except for using the bisazo compound shown by the example compound (I-169). On the above CGL was formed CTL following the same procedure as in Example 79 to prepare an electrophotographic photosensitive member of this invention. This is called as "Sample 87".

EXAMPLE 88

Example 87 was repeated except that the example compound (I-283) was employed as the bisazo compound in formation of CGL and the example compound (V-10) as the hydrazone compound in formation of CTL to prepare an electrophotographic photosensitive member of this invention. This is called as "Sample 88".

COMPARATIVE EXAMPLE 17

In formation of CTL in Example 79, a pyrazoline derivative having the above structural formula [VIII] was employed, following otherwise the same procedure as in Example 79 to prepare an electrophotographic photosensitive member for comparative purpose. This is called as "Comparative sample 17".

COMPARATIVE EXAMPLE 18

In formation of CTL in Example 79, an oxadiazole derivative having the above structural formula [IX] was employed, following otherwise the same procedure as in Example 79 to prepare an electrophotographic photosensitive member for comparative purpose. This is called as "Comparative sample 18".

For each of the thus prepared electrophotographic photosensitive members, Samples 79 to 88 and Comparative samples 17 and 18, its electrophotographic characteristics were examined by use of "Electrometer SP-428 Model" (produced by Kawaguchi Denki Seisakusho). The results are as shown in Table 20.

TABLE 20

| Electrophotographic photosensitive member | $V_A$ (V) | $E_{\frac{1}{2}}$ (lux · sec) | Dark decay percentage (%) |
|---|---|---|---|
| Sample 79 | −645 | 2.0 | 26 |
| Sample 80 | −610 | 1.8 | 28 |
| Sample 81 | −670 | 2.2 | 21 |
| Sample 82 | −635 | 1.9 | 24 |
| Sample 83 | −615 | 1.9 | 30 |
| Sample 84 | −630 | 1.9 | 27 |
| Sample 85 | −635 | 1.9 | 26 |
| Sample 86 | −655 | 2.1 | 22 |
| Sample 87 | −660 | 2.1 | 24 |
| Sample 88 | −630 | 1.9 | 27 |
| Comparative sample 17 | −630 | 2.7 | 41 |
| Comparative sample 18 | −835 | 4.6 | 16 |

It can clearly be seen from the results in Table 20 that the electrophotographic photosensitive members of this invention have great sensitivities.

Each of Samples 79 to 88 and Comparative samples 17 and 18 was mounted on a dry system electrophotographic copying machine "U-Bix 2000 R" (produced by Konishiroku Photo Industry Co.) to perform successive copying, and black paper potential Vb (V) and white paper potential Vw (V) at an exposure iris value of 1.0 were measured similarly as in case of Samples 1 to 10 immediately before developing. The results are as shown in Table 21.

TABLE 21

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 79 | −540 | −35 | −480 | −30 | −60 | −5 |
| Sample 80 | −510 | −15 | −435 | −15 | −75 | 0 |
| Sample 81 | −565 | −50 | −525 | −45 | −40 | −5 |
| Sample 82 | −530 | −30 | −495 | −30 | −35 | 0 |
| Sample 83 | −520 | −25 | −430 | −20 | −90 | −5 |
| Sample 84 | −525 | −20 | −480 | −20 | −45 | 0 |
| Sample 85 | −530 | −25 | −490 | −25 | −40 | 0 |
| Sample 86 | −550 | −45 | −500 | −50 | −40 | −5 |
| Sample 87 | −560 | −45 | −490 | −40 | −70 | −5 |
| Sample 88 | −525 | −20 | −440 | −20 | −85 | 0 |
| Comparative sample 17 | −515 | −65 | −235 | −30 | −280 | −35 |
| Comparative sample 18 | −690 | −105 | −785 | −210 | +95 | +105 |

In the Table, ΔVb(V) and ΔVw (V) indicate the changes in the black paper potential Vb (V) and the white paper potential Vw (V), respectively, + in the change meaning increase and − decrease.

As apparently seen from Table 21, in the electrophotographic photosensitive member of this invention, even when provided for use in repeated electrophotographic process, the history of the potential can be stably maintained to form stably a large number of visualized images of good image quality.

EXAMPLE 89

In the same manner as in Example 1, the intermediate layer was provided on the electroconductive support, and CGL with a thickness of about 0.5 micron was formed according to entirely the same procedure as in Example 1 except for using the bisazo compound shown by the examplary compound (I-5). On the other hand, on the above CGL was formed CTL with a thickness of 12 microns following entirely the same procedure as in Example 1 except for using 11.25 g of the carbazole derivative shown by the example compound (VII-31) in place of the styryl compound to prepare an electrophotographic photosensitive member of this invention. This is called as "Sample 89".

EXAMPLES 90 TO 93

Example 89 was repeated except that, as the bisazo compounds, those shown by the example compounds (I-9), (I-16), (I-43) and (I-46) were employed respectively in formation of CGL to prepare four kinds of electrophotographic photosensitive members of this invention. These are called as "Sample 90" to "Sample 93", respectively.

EXAMPLES 94 TO 97

Example 89 was repeated except that, as the carbazole derivatives, those shown by the example compounds (VII-3), (VII-14), (VII-16) and (VII-32) were employed respectively in formation of CTL to prepare four kinds of electrophotographic photosensitive members of this invention. These are called as "Sample 94" to "Sample 97", respectively.

EXAMPLE 98

In the same manner as in Example 1, the intermediate layer was provided on the electroconductive support, and CGL with a thickness of about 1 micron was formed according to entirely the same procedure as in Example 10 except for using the bisazo compound shown by the example compound (I-96). On the above CGL was formed CTL following the same procedure as in Example 89 to prepare an electrophotographic photosensitive member of this invention. This is called as "Sample 98".

COMPARATIVE EXAMPLE 19

In formation of CTL in Example 89, a pyrazoline derivative having the above structural formula [VIII] was employed, following otherwise the same procedure as in Example 89 to prepare an electrophotographic photosensitive member for comparative purpose. This is called as "Comparative sample 19".

COMPARATIVE EXAMPLE 20

In formation of CTL in Example 89, an oxadiazole derivative having the above structural formula [IX] was employed, following otherwise the same procedure as in Example 89 to prepare an electrophotographic photosensitive member for comparative purpose. This is called as "Comparative sample 20".

For each of the thus prepared electrophotographic photosensitive members, Samples 89 to 98 and Comparative samples 19 and 20, its electrophotographic characteristics were examined by use of "Electrometer SP-428 Model" (produced by Kawaguchi Denki Seisakusho) according to the same method as used for Samples 1 to 10. The results are as shown in Table 22.

TABLE 22

| Electrophotographic photosensitive member | $V_A$ (V) | $E_{\frac{1}{2}}$ (lux · sec) | Dark decay percentage (%) |
|---|---|---|---|
| Sample 89 | −780 | 2.2 | 11 |
| Sample 90 | −795 | 2.3 | 10 |
| Sample 91 | −755 | 2.8 | 16 |
| Sample 92 | −820 | 2.4 | 9 |
| Sample 93 | −775 | 2.6 | 14 |
| Sample 94 | −830 | 3.0 | 8 |
| Sample 95 | −815 | 2.8 | 10 |
| Sample 96 | −735 | 2.0 | 20 |
| Sample 97 | −760 | 2.1 | 16 |
| Sample 98 | −795 | 2.3 | 13 |
| Comparative sample 19 | −590 | 2.5 | 38 |
| Comparative sample 20 | −870 | 3.8 | 16 |

It can clearly be seen from the results in Table 22 that the electrophotographic photosensitive members of this invention have great sensitivities.

Each of Samples 89 to 98 and Comparative samples 19 and 20 was mounted on a dry system electrophotographic copying machine "U-Bix 2000 R" (produced by Konishiroku Photo Industry Co.) to perform successive copying, and black paper potential Vb (V) and white paper potential Vw (V) at an exposure iris value of 1.0 were measured similarly as in case of Samples 1 to 10 immediately before developing. The results are as shown in Table 23.

TABLE 23

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 89 | −560 | −55 | −545 | −60 | −15 | +5 |
| Sample 90 | −570 | −60 | −550 | −65 | −20 | +5 |
| Sample 91 | −535 | −75 | −515 | −85 | −20 | +10 |
| Sample 92 | −580 | −65 | −570 | −65 | −10 | 0 |
| Sample 93 | −570 | −70 | −550 | −75 | −20 | −5 |
| Sample 94 | −605 | −80 | −600 | −90 | −5 | +10 |
| Sample 95 | −585 | −75 | −570 | −85 | −15 | +10 |
| Sample 96 | −515 | −40 | −485 | −40 | −30 | 0 |
| Sample 97 | −560 | −45 | −530 | −45 | −30 | 0 |
| Sample 98 | −575 | −60 | −560 | −65 | −15 | +5 |
| Comparative sample 19 | −490 | −50 | −300 | −25 | −190 | −25 |
| Comparative sample 20 | −700 | −95 | −750 | −180 | +50 | +85 |

In the Table, ΔVb(V) and ΔVw (V) indicate the changes in the black paper potential Vb (V) and the white paper potential Vw (V), respectively, + in the change meaning increase and − decrease.

As apparently seen from Table 23, in the electrophotographic photosensitive member of this invention, even when provided for use in repeated electrophotographic process, the history of the potential can be stably maintained to form stably a large number of visualized images of good image quality.

EXAMPLE 99

In the same manner as in Example 1, the intermediate layer was provided on the electroconductive support, and CGL with a thickness of about 0.5 micron was formed according to entirely the same procedure as in Example 1 except for using the bisazo compound shown by the examplary compound (I-96). On the other hand, on the above CGL was formed CTL with a thickness of 12 microns following entirely the same procedure as in Example 89 except for using 11.25 g of the carbazole derivative shown by the example compound (VII-16) to prepare an electrophotographic photosensitive member of this invention. This is called as "Sample 99".

EXAMPLES 100–103

Example 99 was repeated except that, as the bisazo compounds, those shown by the example compounds (I-85), (I-89), (I-123) and (I-126) were employed respectively in formation of CGL to prepare four kinds of electrophotographic photosensitive members of this invention. These are called as "Sample 100" to "Sample 103", respectively.

EXAMPLES 104 TO 107

Example 99 was repeated except that, as the carbazole derivatives, those shown by the example compounds (VII-5), (VII-10), (VII-32) and (VII-33) were employed respectively in formation of CTL to prepare four kinds of electrophotographic photosensitive members of this invention. These arc called as "Sample 104" to "Sample 107", respectively.

EXAMPLE 108

In the same manner as in Exaple 1, the intermediate layer was provided on the electroconductive support, and CGL with a thickness of about 1 micron was formed according to entirely the same procedure as in Example 10 except for using the bisazo compound shown by the example compound (I-96). On the above CGL was formed CTL following the same procedure as in Example 99 to prepare an electrophotographic photosensitive member of this invention. This is called as "Sample 108".

COMPARATIVE EXAMPLE 21

In formation of CTL in Example 99, a pyrazoline derivative having the above structural formula [VIII] was employed, following otherwise the same procedure as in Example 99 to prepare an electrophotographic photosensitive member for comparative purpose. This is called as "Comparative sample 21".

COMPARATIVE EXAMPLE 22

In formation of CTL in Example 99, an oxadiazole derivative having the above structural formula [IX] was employed, following otherwise the same procedure as in Example 99 to prepare an electrophotographic photosensitive member for comparative purpose. This is called as "Comparative sample 22".

For each of the thus prepared electrophotographic photosensitive members, Samples 99 to 108 and Comparative samples 21 and 22, its electrophotographic characteristics were examined by use of "Electrometer SP-428 Model" (produced by Kawaguchi Denki Seisakusho) according to the same method as used for Samples 1 to 10. The results are as shown in Table 24.

TABLE 24

| Electrophotographic photosensitive member | $V_A$ (V) | $E_{\frac{1}{2}}$ (lux · sec) | Dark decay percentage (%) |
|---|---|---|---|
| Sample 99 | −720 | 2.4 | 14 |
| Sample 100 | −735 | 2.2 | 12 |
| Sample 101 | −745 | 2.2 | 11 |
| Sample 102 | −760 | 2.3 | 9 |
| Sample 103 | −785 | 2.5 | 8 |
| Sample 104 | −700 | 2.3 | 16 |
| Sample 105 | −740 | 2.4 | 13 |
| Sample 106 | −780 | 2.7 | 9 |
| Sample 107 | −705 | 2.3 | 16 |
| Sample 108 | −735 | 2.5 | 12 |
| Comparative sample 21 | −685 | 3.0 | 39 |
| Comparative sample 22 | −860 | 4.9 | 14 |

It can clearly be seen from the results in Table 22 that the electrophotographic photosensitive members of this invention have great sensitivities.

Each of Samples 89 to 98 and Comparative samples 19 and 20 was mounted on a dry system electrophotographic copying machine "U-Bix 2000 R" (produced by Konishiroku Photo Industry Co.) to perform successive copying, and black paper potential Vb (V) and white paper potential Vw (V) at an exposure iris value of 1.0 were measured similarly as in case of Samples 1 to 10 immediately before developing. The results are as shown in Table 25.

TABLE 25

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 99 | −525 | −50 | −500 | −50 | −25 | 0 |
| Sample 100 | −530 | −45 | −515 | −45 | −15 | 0 |
| Sample 101 | −540 | −45 | −520 | −45 | −20 | 0 |
| Sample 102 | −555 | −55 | −540 | −55 | −15 | 0 |
| Sample 103 | −570 | −60 | −550 | −65 | −20 | +5 |
| Sample 104 | −505 | −50 | −470 | −50 | −35 | 0 |
| Sample 105 | −530 | −55 | −505 | −55 | −25 | 0 |
| Sample 106 | −550 | −70 | −555 | −80 | +5 | +10 |
| Sample 107 | −510 | −50 | −485 | −50 | −25 | 0 |
| Sample 108 | −530 | −55 | −515 | −55 | −15 | 0 |
| Comparative sample 21 | −515 | −65 | −290 | −25 | −225 | −40 |
| Comparative sample 22 | −695 | −105 | −755 | −215 | +60 | +110 |

In the Table, ΔVb (V) and ΔVw (V) indicate the changes in the black paper potential Vb (V) and the white paper potential Vw (V), respectively, + in the change meaning increase and − decrease.

As apparently seen from Table 25, in the electrophotographic photosensitive member of this invention, even when provided for use in repeated electrophotographic process, the history of the potential can be stably maintained to form stably a large number of visualized images of good image quality.

EXAMPLE 109

In the same manner as in Example 1, the intermediate layer was provided on the electroconductive support, and CGL with a thickness of about 0.5 micron was formed according to entirely the same procedure as in Example 1 except for using the bisazo compound shown by the example compound (I-176). On the other hand, on the above CGL was formed CTL with a thickness of 12 microns following entirely the same procedure as in Example 31 except for using the carbazole derivative shown by the example compound (VII-16) to prepare an electrophotographic photosensitive member of this invention. This is called as "Sample 109".

EXAMPLES 110 TO 116

Example 109 was repeated except that, in formation of CGL and information of CTL, the exemplary compounds according to the combinations as indicated in Table 26 were employed to prepared 7 kinds of electrophotographic photosensitive members of this invention. These are called as "Sample 110" to "Sample 116", respectively.

TABLE 26

| | example compound for CGL | example compound for CTL |
|---|---|---|
| Example 110 | (I-245) | (VII-31) |
| Example 111 | (I-165) | (VII-16) |
| Example 112 | (I-283) | (VII-31) |
| Example 113 | (I-176) | (VII-5) |
| Example 114 | (I-176) | (VII-10) |
| Example 115 | (I-245) | (VII-14) |
| Example 116 | (I-245) | (VII-32) |

EXAMPLE 117

In the same manner as in Example 1, the intermediate layer was provided on the electroconductive support, and CGL with a thickness of about 1 micron was formed according to entirely the same procedure as in Example 1 except for using the bisazo compound shown by the example compound (I-176). On the above CGL was formed CTL following the same procedure as in Example 109 to prepare an electrophotographic photosensitive member of this invention. This is called as "Sample 117".

EXAMPLE 118

Example 59 was repeated except that the example compound (I-245) was employed as the bisazo compound in formation of CGL and the example compound (VII-31) as the carbazole derivative in formation of CTL to prepare an electrophotographic photosensitive member of this invention. This is called as "Sample 118".

COMPARATIVE EXAMPLE 23

In formation of CTL in Example 109, a pyrazoline derivative having the above structural formula [VIII] was employed, following otherwise the same procedure as in Example 109 to prepare an electrophotographic photosensitive member for comparative purpose. This is called as "Comparative sample 23".

COMPARATIVE EXAMPLE 24

In formation of CTL in Example 109, an oxadiazole derivative having the above structural formula [IX] was employed, following otherwise the same procedure as in Example 109 to prepare an electrophotographic photosensitive member for comparative purpose. This is called as "Comparative sample 24".

For each of the thus prepared electrophotographic photosensitive members, Samples 109 to 118 and Comparative samples 23 and 24, its electrophotographic characteristics were examined by use of "Electrometer SP-428 Model" (produced by Kawaguchi Denki Seisakusho). The results are as shown in Table 27.

TABLE 27

| Electrophotographic photosensitive member | $V_A$ (V) | $E_{\frac{1}{2}}$ (lux · sec) | Dark decay percentage (%) |
|---|---|---|---|
| Sample 109 | −760 | 2.7 | 12 |
| Sample 110 | −780 | 2.8 | 11 |
| Sample 111 | −775 | 2.8 | 10 |
| Sample 112 | −800 | 2.9 | 10 |
| Sample 113 | −745 | 2.6 | 13 |
| Sample 114 | −760 | 2.7 | 14 |
| Sample 115 | −800 | 2.9 | 10 |
| Sample 116 | −765 | 2.7 | 12 |
| Sample 117 | −770 | 2.8 | 11 |
| Sample 118 | −785 | 2.9 | 10 |
| Comparative sample 23 | −615 | 3.1 | 47 |
| Comparative sample 24 | −875 | 5.3 | 14 |

It can clearly be seen from the results in Table 27 that the electrophotographic photosensitive members of this invention have great sensitivities.

Each of Samples 109 to 118 and Comparative samples 23 and 24 was mounted on a dry system electrophotographic copying machine "U-Bix 2000 R" (produced by Konishiroku Photo Industry Co.) to perform successive copying, and black paper potential Vb (V) and white paper potential Vw (V) at an exposure iris value of 1.0 were measured similarly as in case of Samples 1 to 10 immediately before developing. The results are as shown in Table 28.

TABLE 28

| Electrophotographic photosensitive member | Image potential (V) | | | | | |
|---|---|---|---|---|---|---|
| | Initial | | After 5000 copies | | Changes | |
| | Vb | Vw | Vb | Vw | ΔVb | ΔVw |
| Sample 109 | −540 | −75 | −525 | −75 | −15 | 0 |
| Sample 110 | −550 | −80 | −540 | −85 | −10 | +5 |
| Sample 111 | −545 | −80 | −540 | −80 | −5 | 0 |
| Sample 112 | −560 | −90 | −555 | −100 | −5 | +10 |
| Sample 113 | −530 | −70 | −500 | −70 | −30 | 0 |
| Sample 114 | −535 | −70 | −500 | −70 | −35 | 0 |
| Sample 115 | −575 | −95 | −580 | −105 | +5 | +10 |
| Sample 116 | −550 | −85 | −540 | −90 | −10 | +5 |
| Sample 117 | −550 | −80 | −530 | −80 | −20 | 0 |
| Sample 118 | −565 | −85 | −540 | −90 | −25 | +5 |
| Comparative sample 23 | −500 | −75 | −245 | −25 | −225 | −50 |
| Comparative sample 24 | −725 | −125 | −805 | −255 | +80 | +130 |

In the Table, ΔVb (V) and ΔVw (V) indicate the changes in the black paper potential Vb (V) and the white paper potential Vw (V), respectively, + in the change meaning increase and − decrease.

As apparently seen from Table 28, in the electrophotographic photosensitive member of this invention, even when provided for use in repeated electrophotographic process, the history of the potential can be stably maintained to form stably a large number of visualized images of good image quality.

We claim:

1. An electrophotographic photosensitive member comprising a photosensitive layer comprising a combination of a carrier generating phase and a carrier transporting phase provided on an electroconductive support, said carrier generating phase containing a bisazo compound represented by the formula [I] shown below and said carrier transporting phase containing a carrier transporting material selected from the group consisting of at least one of styryl compounds represented by the formula [II] shown below, amine derivatives represented by the formula [III], hydrazone compounds represented by the formula [IV], [V] and [VI] and carbazole derivatives represented by the formula [VII]:

Formula [I]

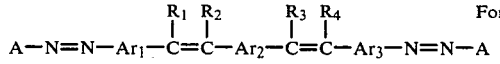

wherein each of $Ar_1$, $Ar_2$ and $Ar_3$ represents a divalent carbocyclic aromatic residue or a divalent heterocyclic aromatic residue; each of $R_1$, $R_2$, $R_3$ and $R_4$ represents an electron attracting group or a hydrogen atom, provided that 1 or 2 of $R_1$ to $R_4$ are electron attracting groups and the case where $R_1$ and $R_2$ or $R_3$ and $R_4$ are electron attracting groups at the same time is excluded; A is a group represented by the following formula:

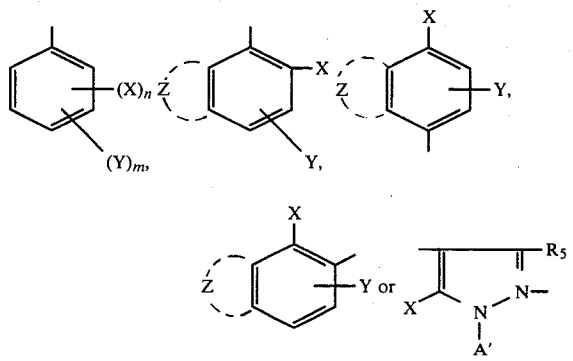

wherein X is a hydroxyl group,

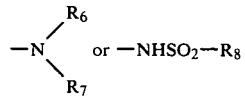

where each of $R_6$ and $R_7$ is a hydrogen atom, an alkyl group and $R_8$ is an alkyl group or an aryl group; Y is a hydrogen atom, a halogen atom, an alkyl group, an alkoxy group, a carboxyl group, a sulfo group, a carbamoyl group or a sulfamoyl group; Z is a group of atoms necessary for forming a carbocyclic aromatic ring or a heterocyclic aromatic ring; $R_5$ is a hydrogen atom, an amino group, a carbamoyl group, a carboxyl group or its ester group; A' is an aryl group; n is an integer of 1 to 3; and m is an integer of 0 to 4, Formula [II]

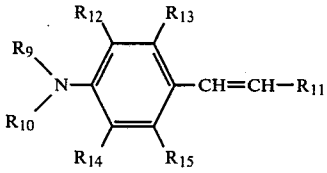

wherein each of $R_9$ and $R_{10}$ represents an alkyl group or phenyl group; $R_{11}$ represents a phenyl group, naphthyl group, anthryl group, fluorenyl group or heterocyclic group; each of $R_{12}$ to $R_{15}$ represents a hydrogen atom, a halogen atom, an alkyl group, an alkoxy group or an amino group,

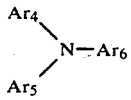

Formula [III]

wherein each of $Ar_4$ and $Ar_5$ represents a phenyl group; and $Ar_6$ represents a phenyl group, naphthyl group, anthryl group, fluorenyl group or heterocyclic group,

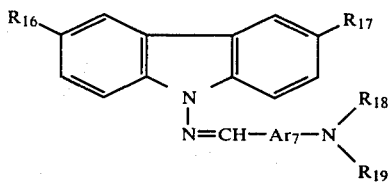

Formula [IV]

wherein each of $R_{16}$ to $R_{17}$ represents a hydrogen atom or a halogen atom; each of $R_{18}$ and $R_{19}$ represents an aryl group; and $Ar_7$ represents an arylene group,

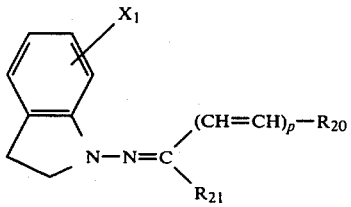

Formula [V]

wherein $R_{20}$ represents an aryl group or a heterocyclic group; $R_{21}$ represents a hydrogen atom, an alkyl group or an aryl group; $X_1$ represents a hydrogen atom, a halogen atom, an alkyl group, an amino group or an alkoxyl group; and p represents an integer of 0 or 1,

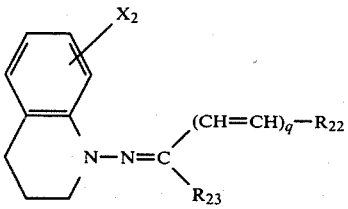

Formula [VI]

wherein $R_{22}$ represents an aryl group or a heterocyclic group; $R_{23}$ represents a hydrogen atom or an alkyl group; $X_2$ represents a hydrogen atom, a halogen atom, an alkyl group, an amino group, an alkoxy group or a cyano group; and q represents an integer of 0 or 1,

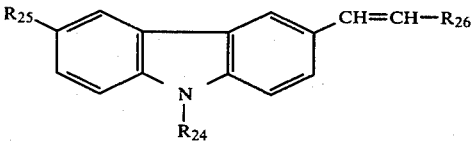

Formula [VII]

wherein $R_{24}$ represents an aryl group; $R_{25}$ represents a hydrogen atom, a halogen atom, an alkyl group, an alkoxy group, an amino group or a hydroxyl group; and $R_{26}$ represents an aryl group or a heterocyclic group.

2. The electrophotographic photosensitive member of claim 1, wherein said photosensitive layer comprises a carrier generating phase as a layer containing said bisazo compound and a carrier transporting phase as a separate layer containing said carrier transporting material.

3. The electrophotographic photosensitive member of claim 2, wherein the bisazo compound is selected from the compounds of the formulae [Ia-1] to [Ia-4] shown below:

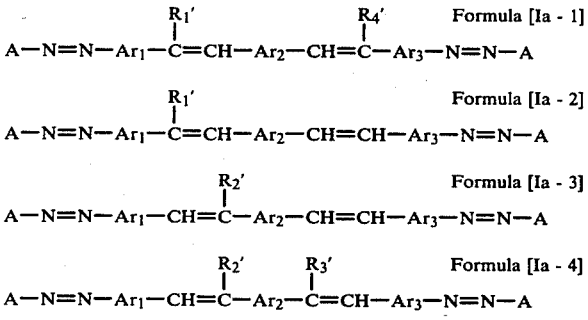

Formula [Ia - 1]

Formula [Ia - 2]

Formula [Ia - 3]

Formula [Ia - 4]

wherein $Ar_1$, $Ar_2$, $Ar_3$ and A are the same as defined in Formula [I], and $R_1'$, $R_2'$, $R_3'$ and $R_4'$ each represents an electron attracting group.

4. The electrophotographic photosensitive member of claim 3, wherein $R_1'$, $R_2'$, $R_3'$ and $R_4'$ are a cyano group.

5. The electrophotographic photosensitive member of claim 4, wherein the bisazo compound is selected from the compounds of the formulae [Ib-1] to [Ib-4] shown below:

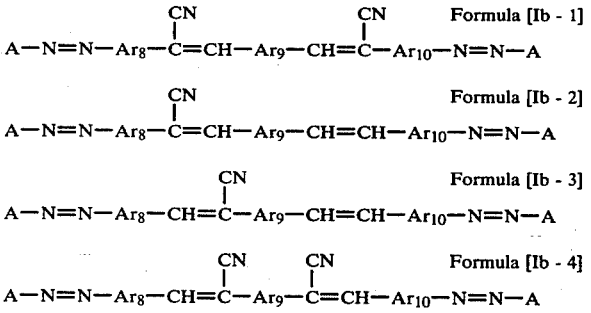

Formula [Ib - 1]

Formula [Ib - 2]

Formula [Ib - 3]

Formula [Ib - 4]

wherein A is the same as defined in Formula [I], each of $Ar_8$, $Ar_9$ and $Ar_{10}$ represents a phenyl group.

6. The electrophotographic photosensitive member of claim 5, wherein each of $Ar_8$, $Ar_9$ and $Ar_{10}$ represents a phenyl group, an alkyl substituted phenyl group, an alkoxy group, a halogen atom, a hydroxyl group or a cyano group.

7. The electrophotographic photosensitive member of claim 2, wherein the carrier generating layer further comprises a binder resin.

8. The electrophotographic photosensitive member of claim 2, wherein the carrier generating layer has a thickness of 0.005 to 20 microns.

9. The electrophotographic photosensitive member of claim 7, wherein the carrier transporting layer further comprises a binder resin.

10. The electrophotographic photosensitive member of claim 8, wherein the carrier transporting layer has a thickness of 2 to 100 microns.

11. The electrophotographic photosensitive member of claim 2, wherein further comprising an intermediate layer between the photosensitive layer and the electroconductive support.

12. The electrophotographic photosensitive member of claim 2, wherein the photosensitive layer is provided in the order of the carrier generating layer and the carrier transporting layer on the electroconductive support.

13. The electrophotographic photosensitive member of claim 2, wherein the photosensitive layer is provided in the order of the carrier transporting layer and the carrier generating layer on the electroconductive support.

14. The electrophotographic photosensitive member of claim 2, wherein said carrier generating layer contains bisazo compounds represented by the formula [Ia-1] and said carrier transporting layer contains at least one of styryl compounds represented by the formula [II] and amine derivatives represented by the formula [III].

15. The electrophotographic photosensitive member of claim 2, wherein said carrier generating layer contains bisazo compounds represented by the formula [Ia-1] and said carrier transporting layer contains hydrazone compounds represented by the formula [IV].

16. The electrophotographic photosensitive member of claim 2, wherein said carrier generating layer contains bisazo compounds represented by the formula [Ia-1] and said carrier transporting layer contains hydrazone compounds represented by the formula [V] or [VI].

17. The electrophotographic photosensitive member of claim 2, wherein said carrier generating layer contains bisazo compounds represented by the formula [Ia-1] and said carrier transporting layer contains carbazol derivatives represented by the formula [VII].

[Ia-2] and said carrier transporting layer contains hydrazone compounds represented by the formula [V] or [VI].

21. The electrophotographic photosensitive member of claim 2, wherein said carrier generating layer contains bisazo compounds represented by the formula [Ia-2] and said carrier transporting layer contains carbazol derivatives represented by the formula [VII].

22. The electrophotographic photosensitive member of claim 2, wherein said carrier generating layer contains bisazo compounds represented by the formula [Ia-3] or [Ia-4] and said carrier transporting layer contains at least one of styryl compounds represented by the formula [II] and amine derivatives represented by the formula [III].

23. The electrophotographic photosensitive member of claim 2, wherein said carrier generating layer contains bisazo compounds represented by the formula [Ia-3] or [Ia-4] and said carrier transporting layer contains hydrazone compounds represented by the formula [IV].

24. The electrophotographic photosensitive member of claim 2, wherein said carrier generating layer contains bisazo compounds represented by the formula [Ia-3] or [Ia-4] and said carrier transporting layer contains hydrazone compounds represented by the formula [V] or [VI].

25. The electrophotographic photosensitve member of claim 2, wherein said carrier generating layer contains bisazo compounds represented by the formula [Ia-3] or [Ia-4] and said carrier transporting layer contains carbazol derivatives represented by the formula [VII].

26. The electrophotographic photosensitive member of claim 2, wherein said bisazo compound is

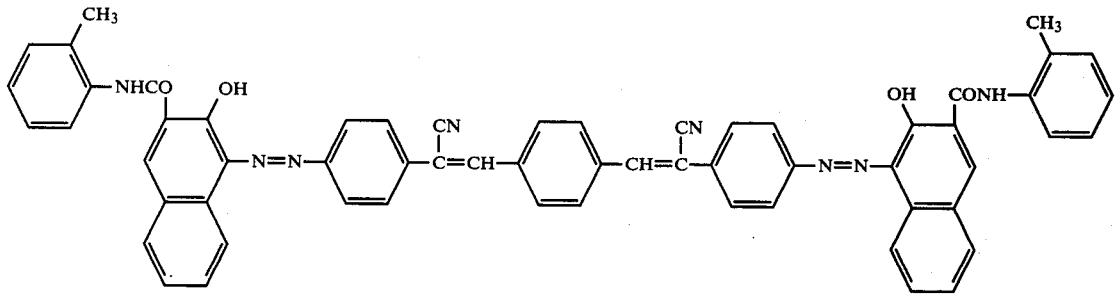

18. The electrophotographic photosensitive member of claim 2, wherein said carrier generating layer contains bisazo compounds represented by the formula [Ia-2] and said carrier transporting layer contains styryl compounds represented by at least one of the formula [II] and amine derivatives represented by the formula [III].

19. The electrophotographic photosensitive member of claim 2, wherein said carrier generating layer contains bisazo compounds represented by the formula [Ia-2] and said carrier transporting layer contains hydrazone compounds represented by the formula [IV].

20. The electrophotographic photosensitive member of claim 2, wherein said carrier generating layer contains bisazo compounds represented by the formula and said carrier transporting material is the styryl compound

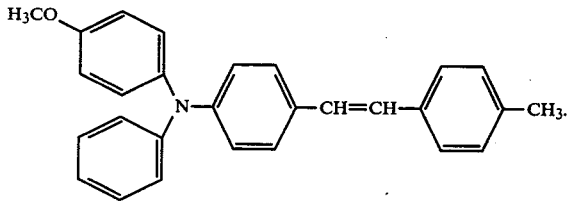

27. The electrophotographic photosensitive member of claim 2, wherein said bisazo compound is

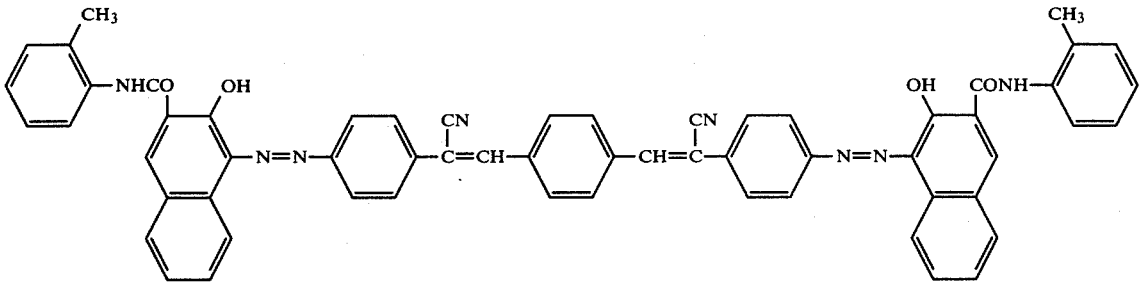

and said carrier transporting material is the hydrazone compound

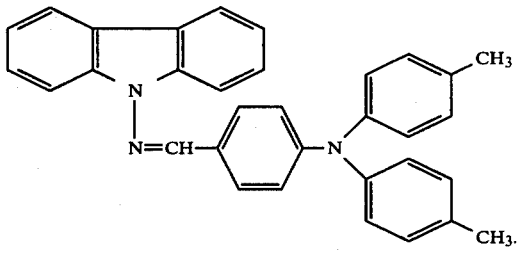

28. The electrophotographic photosensitive member of claim 2, wherein said bisazo compound is

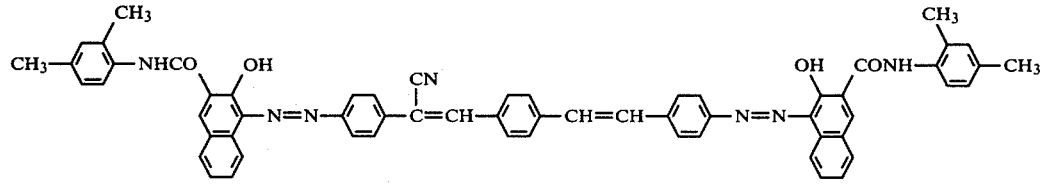

and said carrier transporting material is the hydrazone compound

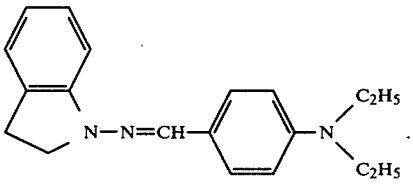

29. The electrophotographic photosensitive member of claim 2, wherein said bisazo compound is

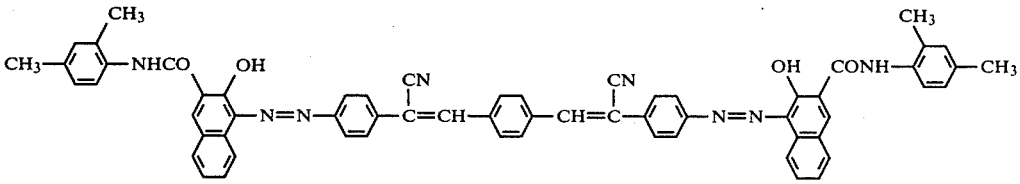

and said carrier transporting material is the hydrazone compound

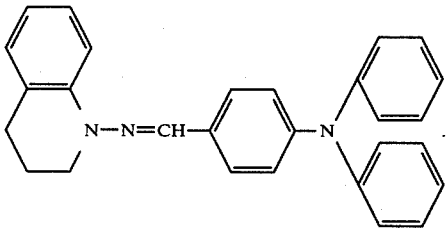

30. The electrophotographic photosensitive member of claim 2, wherein said bisazo compound is

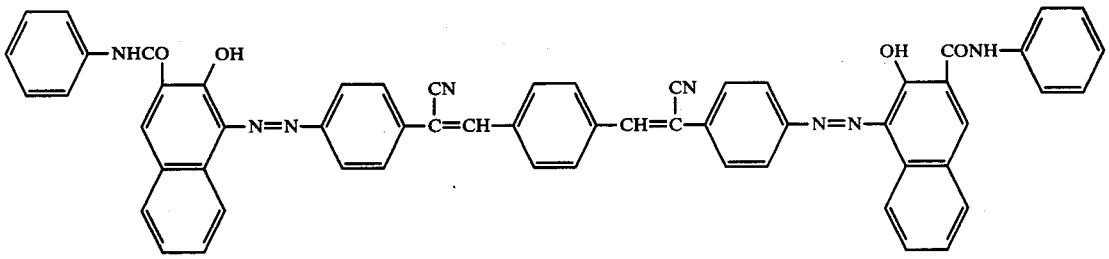
and said carrier transporting material is the carbazole compound
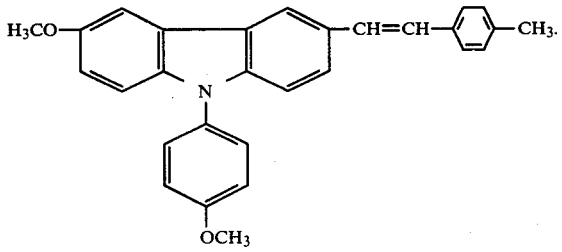
31. The electrophotographic photosensitive member of claim 2, wherein said electron attracting group $R_1$, $R_2$, $R_3$ and $R_4$ in said bisazo compound is CN, Cl, Br, or $NO_2$.
* * * * *